US005861895A

United States Patent [19]

Tajika et al.

[11] Patent Number: 5,861,895

[45] Date of Patent: Jan. 19, 1999

[54] INK JET RECORDING METHOD AND APPARATUS CONTROLLING DRIVING SIGNALS IN ACCORDANCE WITH HEAD TEMPERATURE

[75] Inventors: Hiroshi Tajika; Yoshiaki Takayanagi, both of Yokohama; Masayuki Hirose; Souhei Tanaka, both of Kawasaki; Hiromitsu Hirabayashi, Yokohama; Noribumi Koitabashi, Yokohama; Yasuhiro Yamada, Yokohama; Yasuhiro Numata, Yokohama; Hitoshi Sugimoto, Yokohama; Miyuki Matsubara, Tokyo, all of Japan

[73] Assignee: Canon Kabushiki Kaisha, Tokyo, Japan

[21] Appl. No.: 486,296

[22] Filed: Jun. 7, 1995

Related U.S. Application Data

[62] Division of Ser. No. 104,261, May 17, 1993, which is a continuation of Ser. No. 821,773, Jan. 16, 1992, abandoned.

[30] Foreign Application Priority Data

| | | | |
|---|---|---|---|
| Jan. 9, 1991 | [JP] | Japan | 3-004742 |
| Jan. 18, 1991 | [JP] | Japan | 3-004390 |
| Jan. 18, 1991 | [JP] | Japan | 3-004392 |
| Jan. 18, 1991 | [JP] | Japan | 3-004713 |
| Oct. 2, 1991 | [JP] | Japan | 3-255192 |
| Jan. 10, 1992 | [JP] | Japan | 4-003228 |

[51] Int. Cl.[6] ..... B41J 2/05

[52] U.S. Cl. ..... 347/14; 347/57

[58] Field of Search ..... 347/10, 11, 14, 347/17, 60, 57, 189, 194

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,490,728 | 12/1984 | Vaught et al. . | |
| 4,558,333 | 12/1985 | Sugitani et al. . | |
| 4,563,689 | 1/1986 | Murakami et al. . | |
| 4,660,057 | 4/1987 | Watanabe et al. . | |
| 4,723,129 | 2/1988 | Endo et al. . | |
| 4,740,796 | 4/1988 | Endo et al. . | |
| 4,746,937 | 5/1988 | Realis Luc et al. . | |
| 4,860,034 | 8/1989 | Watanabe | 347/14 |
| 4,908,635 | 3/1990 | Iwasawa et al. | 347/14 |
| 4,947,194 | 8/1990 | Kyoshima . | |
| 4,982,199 | 1/1991 | Dunn . | |
| 5,023,626 | 6/1991 | Kawamura | 347/14 |
| 5,036,337 | 7/1991 | Rezanka . | |
| 5,130,726 | 7/1992 | Fukushima et al. . | |

FOREIGN PATENT DOCUMENTS

| | | | |
|---|---|---|---|
| 0354982 | 2/1990 | European Pat. Off. | B41J 2/045 |
| 0373894 | 6/1990 | European Pat. Off. | B41J 3/04 |
| 0376346 | 7/1990 | European Pat. Off. | B41J 29/00 |
| 0390202 | 10/1990 | European Pat. Off. | B41J 2/05 |
| 54-056847 | 5/1979 | Japan | B41M 05/26 |
| 55-065567 | 5/1980 | Japan | B41J 3/04 |
| 57-047666 | 3/1982 | Japan | B41J 3/04 |
| 57-170776 | 10/1982 | Japan | B41J 3/20 |
| 59-123670 | 7/1984 | Japan | B41J 3/04 |

(List continued on next page.)

*Primary Examiner*—Joseph W. Hartary
*Attorney, Agent, or Firm*—Fitzpatrick, Cella, Harper & Scinto

[57] ABSTRACT

In the recording method and apparatus, ink is ejected by thermal energy produced by a heat generating element of a recording head in response to application of driving signals thereto, the driving signals being of plural waveforms including a fixed waveform. The method includes the steps of detecting a temperature of the recording head and applying the driving signals to the heat generating element of the recording head. The waveforms of the driving signals are changed in accordance with the temperature of the recording head when the temperature of the recording head is below a predetermined level, and the waveforms of the driving signals comprise the fixed waveform when the temperature of the recording head exceeds the predetermined level.

18 Claims, 45 Drawing Sheets

FOREIGN PATENT DOCUMENTS

| | | | |
|---|---|---|---|
| 59-138461 | 8/1984 | Japan | B41J 3/04 |
| 60-071260 | 4/1985 | Japan | B41J 3/04 |
| 63-042871 | 2/1988 | Japan | B41J 3/04 |
| 63-094854 | 4/1988 | Japan | B41J 3/04 |
| 1290439 | 11/1989 | Japan | B41J 3/04 |
| 2004085 | 1/1990 | Japan | B41J 2/175 |
| 2074351 | 3/1990 | Japan | B41J 2/05 |
| 2134264 | 5/1990 | Japan | B41J 2/51 |
| 2281952 | 11/1990 | Japan | B41J 2/05 |
| 3234535 | 10/1991 | Japan | B41J 2/045 |
| WO90 10541 | 9/1990 | WIPO | B41J 2/05 |
| WO90010540 | 9/1990 | WIPO | B41J 2/05 |

Po = CONST, Ra(ηa) > Rb(ηb)
Ta < Tb

V (V)
Vop
P1
P2
P3
O
t1
t2
t3
T (μsec)
t1 (μsec)
t2 (μsec)
t3 (μsec)
T1
T2
T3
Tx (°C)
x (μm)
a
b
c
d
e
a'
b'
c'
d'
e'

| TAB. # / CON | (1) | (2) | (3) | (4) | (5) | (6) | (7) | (8) | (9) | (10) | (11) |
|---|---|---|---|---|---|---|---|---|---|---|---|
| HEAD TEMP $T_H$ (°C) | <26 | ≧26 <28 | 28 ~30 | 30 ~32 | 32 ~34 | 34 ~36 | 36 ~38 | 38 ~40 | 40 ~42 | 42 ~44 | ≧44 |
| PRE-HEAT PULSE WIDTH $P_1$ (Hex) | 0A | 09 | 08 | 07 | 06 | 05 | 04 | 03 | 02 | 01 | 00 |

$1_{Hex}$ = 0.187 (μsec)

FIG. 10

| CON \ TAB. # | 1 | 2 | 3 | 4 | 5 | 6 | 7 | 8 | 9 | 10 | 11 |
|---|---|---|---|---|---|---|---|---|---|---|---|
| HEAD TEMP $T_H$ (°C) | < 26 | ≧ 26 < 30 | 30 ~ 33 | 33 ~ 36 | 36 ~ 38 | 38 ~ 40 | 40 ~ 41 | 41 ~ 42 | 42 ~ 43 | 43 ~ 44 | ≧ 44 |
| PRE-HEAT PULSE WIDTH $P_1$ (Hex) | 0A | 09 | 08 | 07 | 06 | 05 | 04 | 03 | 02 | 01 | 00 |

1Hex = 0.187 (μsec)

FIG. 20

| CON \ TAB. # | 1 | 2 | 3 | 4 | 5 | 6 | 7 |
|---|---|---|---|---|---|---|---|
| HEAD TEMP $T_H$ (°C) | < 20 | ≧ 20 < 24 | 24 ~ 28 | 28 ~ 32 | 32 ~ 36 | 36 ~ 40 | ≧ 40 |
| PRE-HEAT PULSE WIDTH $P_1$ (μsex) | 1.60 | 1.50 | 1.40 | 1.20 | 0.90 | 0.50 | 0.00 |

FIG. 22

| DRIVE COND POINTER # $T_{A1}$ (HEX) | 15 | 16 | 17 | 18 | 19 | 1A | 1B | 1C |
|---|---|---|---|---|---|---|---|---|
| MAIN HEAT PULSE WIDTH $P_3$ (μ sec) | 4.675 | 4.488 | 4.301 | 4.114 | 3.927 | 3.74 | 3.553 | 3.366 |

※ $P_3 = P_3 - T_{A1}$ (= $T_2$)

FIG. 29

USABLE

| | | | | | | | | | | | | | | | | | |
|---|---|---|---|---|---|---|---|---|---|---|---|---|---|---|---|---|---|
| | EJECTION AMT $V_{DM}$(ng/dot) | 25.5 ~ 26.1 | 26.1 ~ 26.7 | 26.7 ~ 27.3 | 27.3 ~ 27.9 | 27.9 ~ 28.5 | 28.5 ~ 29.1 | 29.1 ~ 29.7 | 29.7 ~ 30.3 | 30.3 ~ 30.9 | 30.9 ~ 31.5 | 31.5 ~ 32.1 | 32.1 ~ 32.7 | 32.7 ~ 33.3 | 33.3 ~ 33.9 | 33.9 ~ 34.5 | 34.5 ~ 35.1 |
| | RWM POINTER # $T_{A3}$ | 9 | A | B | C | D | E | F | 0 | 1 | 2 | 3 | 4 | 5 | 6 | 7 | 8 |
| THEORETICAL | PRE-HEAT PW $P_1$ (HEX) | 11 | 10 | F | E | D | C | B | A | 9 | 8 | 7 | 6 | 5 | 4 | 3 | 2 |
| THEORETICAL | CORR. AMT (1) $V_{DC}$ (ng/dot) | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 | 29.7 ~ 30.3 |
| EMBODIMENT | PRE-HEAT PW $P_1$ (HEX) | C | C | C | C | C | C | B | A | 9 | 8 | 8 | 8 | 8 | 8 | 8 | 8 |
| EMBODIMENT | CORR. AMT (2) $V_{DC}$(ng/dot) | 26.7 ~ 27.3 | 27.3 ~ 27.9 | 27.9 ~ 28.5 | 28.5 ~ 29.1 | 29.1 ~ 29.7 | 29.7 ~ 30.3 | 29.7 ~ 30.3 | 29.7 ~ 30.3 | 29.7 ~ 30.3 | 29.7 ~ 30.3 | 30.3 ~ 30.9 | 30.9 ~ 31.5 | 31.5 ~ 32.1 | 32.1 ~ 32.7 | 32.7 ~ 33.3 | 33.3 ~ 33.9 |

NON-USABLE USABLE NON-USABLE

※ 1 (HEX) = 0.187 (μ sec)

FIG. 30

| Table No. / COND | (1) | (2) | (3) | (4) | (5) | (6) | (7) | (8) | (9) | (10) |
|---|---|---|---|---|---|---|---|---|---|---|
| HEAD TEMP $T_H$ (°C) | <26 | ≧26 <28 | 28 ~ 30 | 30 ~ 32 | 32 ~ 34 | 34 ~ 36 | 36 ~ 38 | 38 ~ 40 | 40 ~ 42 | ≧42 |
| PRE-HEAT PW $P_1$ (Hex) | 0A | 09 | 08 | 07 | 06 | 05 | 04 | 03 | 02 | 01 |

FIG. 31A

| Table No. / COND | (1) | (2) | (3) | (4) | (5) | (6) | (7) | (8) | (9) | (10) |
|---|---|---|---|---|---|---|---|---|---|---|
| HEAD TEMP $T_H$ (°C) | <26 | ≧26 <28 | 28 ~ 30 | 30 ~ 32 | 32 ~ 34 | 34 ~ 36 | 36 ~ 38 | 38 ~ 40 | 40 ~ 42 | ≧42 |
| PRE-HEAT PW $P_1$ (Hex) | 0B | 0A | 09 | 08 | 07 | 06 | 05 | 04 | 03 | 02 |

FIG. 31B

| Table No. | (1) | (2) | (3) | (4) | (5) | (6) | (7) | (8) | (9) | (10) |
|---|---|---|---|---|---|---|---|---|---|---|
| HEAD TEMP $T_H$ (°C) | <26 | ≧26 <28 | 28 ~ 30 | 30 ~ 32 | 32 ~ 34 | 34 ~ 36 | 36 ~ 38 | 38 ~ 40 | 40 ~ 42 | ≧42 |
| PRE-HEAT PW $P_1$ (Hex) | 09 | 08 | 07 | 06 | 05 | 04 | 03 | 02 | 01 | 00 |

FIG. 31C

INK JET RECORDING METHOD AND APPARATUS CONTROLLING DRIVING SIGNALS IN ACCORDANCE WITH HEAD TEMPERATURE

This application is a division of application Ser. No. 08/104,261 filed May 17, 1993, which is a continuation of application Ser. No. 07/821,773, filed Jan. 16, 1992, abandoned.

FIELD OF THE INVENTION AND RELATED ART

The present invention relates to an ink jet recording method, apparatus and recording head using thermal energy.

In conventional ink jet recording machines, various controls are effected for the purpose of stabilizing the ink ejecting direction (accuracy in the record spot) and stabilizing the ejection amount (Vd (Pl/dot)) in order to minimize the image density variation or non-uniformity in the recorded image or the like.

The controls include controlling the ink temperature (temperature control) and controlling ink viscosity which is influential to the ink ejection amount. In the type of the recording apparatus in which a bubble is formed in the ink by thermal energy, and the ink is ejected by the expansion of the bubble, the bubble creating conditions or the like are controlled to stabilize the ejection amount. As for the specific structures for the ink temperature control, the use is made with a heater (exclusively for this purpose or an ejection heater commonly used for this purpose) for heating the recording head containing the ink and a temperature for detecting the temperature relating to the recording head. The temperature detected by the temperature sensor is fed back to the heater. As an alternative, the temperature feedback is not effected, and the recording head is simply heated by the heater.

The heater and the temperature sensors may be mounted on a member constituting the recording head or on an outside portion of the recording head.

For another method for the control of the ejection amount or the like or a method usable with the above-described method, there is a method in which a pulse width of a single pulse (heat pulse) applied for the purpose of production of the thermal energy to an electrothermal transducer (ejection heater) for producing the thermal energy in the above-described type of ejection, so that the quantity of the generated heat is controlled to stabilize the amount or quantity of ejection.

The types of the control are classified in the following four groups:

(1) The head temperature control is carried out at all times (outside/neighborhood) with the temperature feedback:

(2) The head temperature control is carried out if necessary (outside/neighborhood) with the temperature feedback:

(3) The high temperature head control (higher than the ambient temperature) is carried out with the temperature feedback: and (4) Pulse width modulation of a single heat pulse.

In group 1, since the recording head temperature is always controlled, the evaporation of the water content of the ink due to the heating is promoted. Therefore, increase or solidification of the ink in the ejection outlet of the recording head may be brought about with the possible result of deviation of the ejection direction or the ejection failure. In addition, the density change or non-uniformity may result due to the relatively high dye content in the ink. They ultimately degrade the image quality. Another influence by the continuous heating by the heater is the change in the head structure and the deterioration of the material constituting the recording head with the result of decrease in the reliability and durability of the recording head. Generally speaking, this control is easily influenced by the change in the ambient temperature and the self temperature rise due to the printing operation. More particularly, the ejection amount varies with the result of density variation or non-uniformity.

In group 2 system, the temperature control operation is carried out if necessary, and therefore, it is an improvement of group 1 type. However, since the temperature control is carried out after the printing instruction is produced, the predetermined temperature is required to be reached in a relatively short period, and therefore, large energy (heat generating quantity (W) of the heater) is required for the heating. This results in increase of the temperature ripple increase in the temperature control with the result of impossibility of correct temperature control. If this occurs, the ejection quantity may change due to the temperature ripple with the result of image density variation or non-uniformity. If an attempt is made to correctly effect the temperature control, it is required that the energy supply is reduced. If this is done, the time required for reaching the target temperature becomes longer, and the waiting period for the start of the printing increases.

In group 3 system, the target temperature is made higher than the ambient temperature so as to avoid the influence of the temperature change due to the ambient temperature change or the self temperature increase due to the printing operation. By this, it is possible to reduce the variation in the ejection quantity of the ink during the printing of low duty. However, in the high duty printing operation, for example in a solid black printing, the influence of the temperature rise cannot be avoided since the temperature rise due to the printing is high.

As for a temperature control, the temperature outside the recording head may be controlled. This is advantageous in that the influence of the ambient temperature can be reduced. However, the response to the self temperature rise is not satisfactory, and therefore, it is easily influenced by the self temperature rise.

If the temperature control in the neighborhood of the recording head is carried out, for example, by mounting the heater or the temperature sensor on an aluminum plate functioning as a base plate for supporting the heater board having the ejection heater, then, the response is improved and is effective against the temperature rise due to the printing. However, since the thermal capacity of the base aluminum plate is large, the temperature ripple results. Because of the temperature ripple, the ejection quantity may vary.

In group 4 system, a pulse width is modulated using a single pulse. However, it is considered that a further improvement is required in order to increase the reproducibility to permit correct ejection amount control from the standpoint of increasing the high image quality, because the controllable range of the ejection amount capable of accommodating the ejection amount variation resulting from the temperature change in the bubble forming ink jet system, and because it is difficult to provide the linearity in the ejection amount with the increase of the pulse width therein.

In addition to the problem of the ejection amount variation, the problem resulting from the self-temperature rise of the recording head is that ejection property variation during the printing due to the ink temperature variation is brought about and that the controlling property variation is brought about because of the variation in the head structure. These may lead to the variation in the ejecting direction, ejection failure and the refilling frequency reduction. If these occurs, the image quality can be extremely degraded.

Since the ink head cartridge is mass-produced, some variations are unavoidable in the area of the heater board, the resistance, the film structure, the sizes of the ejection outlets or the like formed in a silicone chip through a semiconductor manufacturing process. Therefore, the variations possibly exist in the ink ejection quantities for the ink indivisual ejection outlets in one recording head and in the performance of the individual recording head.

The variation in the ejection property of the recording head may result in the variation in control properties during the printing as well as the initial ejection quantity of the ink. Among various recording head ejection properties, what is particularly significant in the image formation are variation in the ink ejection quantity of the individual recording heads and the variation in the control property.

Another problem is that a non-uniform temperature distribution is produced depending on the number of nozzles used, with the result of non-uniformity or the like.

More particularly, it is not the fact that the printing operation is effected using all of the nozzles. For example, it is probable that the printing operation is carried out using only one half of the nozzle. In other words, the printing region is not an integer multiple of a printing width of the recording head, and therefore, on the bottom line of the printing, only a part of the nozzles is used for the printing.

When the ink jet recording apparatus is operated in response to a control signal supplied from external equipment such as a reading apparatus, the number of nozzles of a recording head is required to be changed from the normal printing operation. For example, in the serial printing type ink jet recording apparatus, it is so designed that the sheet feeding accuracy is stabilized in the normal feeding (head width), and therefore, if the sheet feeding speed is changed for a reduced printing, the accuracy is influenced with the result of connecting stripe (disturbance to the image). In view of this, two-pass-printing in which two printing operation is effected for one feeding of the sheet, is effective. In such a case, it is required that the printing operation is carried out with changed number of ejecting nozzles.

If the number of printing nozzles of a recording head is changed, a non-uniform temperature distribution is produced depending on which ejection heaters are actuated. This non-uniform temperature distribution results in variation in the ejection amount. In an ink jet recording apparatus in which the head drive is controlled by the temperature sensor, the print density becomes non-uniform unless the control is made in consideration of the temperature distribution.

In the recent ink jet recording apparatus, the clearance between the recording head and the recording material is changed depending on the material of the recording material (plain paper, coated sheet, OHP sheet or the like) or the recording system (one path or two paths). This may result in the deterioration of the ink deposition position accuracy.

This problem is directly influential to the image quality of the print. Particularly, in the case of a full-color print produced by four ink materials, i.e., cyan, magenta, yellow and black ink materials, for example, the ejection property variation results in the ejection amount variation if ejection property different from the normal properties appear in one recording head. As a result, the color balance is disturbed, so that the coloring and the color reproducing property is deteriorated (increase in the color difference). In the case of a monochromatic recording in a black color, a red color, a blue color or a green color, a density variation such as a production of a stripe due to the ink ejection failure in a solid image, becomes remarkable. In addition, the fine line reproducibility and the character quality are degraded due to the deviation in the ejecting direction.

As an advantage of an ink jet recording apparatus, the recording is possible on a wide range of recording mediums. Examples of relatively frequently used mediums include usual recording sheet of paper, thick paper such as envelope, an overhead projector (OHP) transparent sheet or the like. Among these recording material or mediums, the OHP sheet is required to have a high density printing so that the printed character and the images are clear when it is projected through an overhead projector.

Therefore, it is desirable to control the variation in the ejection amount, and that the printing is effected with a desired high image density particularly on the OHP sheet.

SUMMARY OF THE INVENTION

Accordingly, it is a principal object of the present invention to provide an ink jet recording method and apparatus wherein the amount or quantity of the ink ejection is stabilized irrespective of the temperature change attributable to the ambient temperature change and the self temperature rise (due to the printing operation).

It is another object of the present invention to provide an ink jet recording method and apparatus capable of reducing the influence of the self temperature rise.

It is a further object of the present invention to provide an ink jet recording apparatus using a recording head detachably mountable thereto in which the variation in the initial ink ejection quantity resulting from the manufacturing steps for the recording head can be corrected to provide proper ejection quantity.

It is a further object of the present invention to make it possible to make rejection heads because of too much or less ejection quantities usable, thus increasing the yield of the recording heads, so that the head manufacturing cost is reduced.

It is a yet further object of the present invention to provide an ink jet recording method and apparatus in which the variation in the ink ejection quantity attributable to the non-uniform temperature distribution depending on the individual ejection outlets, can be reduced.

It is a further object of the present invention to provide an ink jet recording method and apparatus wherein even if the temperature of the recording head varies due to the ambient temperature and the self temperature rise, the ink ejection speed and the ink refilling frequency can be properly controlled.

It is a further object of the present invention to provide an ink jet recording method and apparatus wherein when the recording is effected on an OHP sheet, the recording density can be increased to provide proper ejection quantity.

It is a further object of the present invention to provide an ink jet recording method and apparatus wherein the quantity of the ejected ink can be stably changed in a wide range.

According to an aspect of the present invention, there is provided a recording method in which ink is ejected by thermal energy produced by a heat generating element of a recording head in response to application of a driving signal thereto, comprising the steps of: changing a waveform of the driving signal in accordance with a temperature of the recording head; and selecting a fixed waveform of the drive signal when the temperature of the recording head exceeds a predetermined level.

According to another aspect of the present invention, there is provided an ink jet recording apparatus in which ink is ejected, comprising: a recording head having a heat generating element to eject the ink by thermal energy produced by the heat generating element in response to a drive signal thereto; temperature detecting means for detecting a temperature of the recording head; drive signal changing means for changing a waveform of the driving signal in accordance with an output of said detecting means; and control means for disabling said changing means and providing a predetermined waveform of the driving signal when the output of said detecting means is indicative of a predetermined temperature or higher.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 10 shows recording head temperatures and corresponding pre-heat pulse modulation control table, used in an embodiment of the present invention.

FIGS. 20 and 21 show a modulation control table for the pre-heat pulse and a graph showing a relation between the printing time and the self temperature rise of the recording head, according to a further embodiment of the present invention.

FIG. 22 shows a modulation control table for a pre-heat pulse according to a further embodiment of the present invention.

FIG. 29 shows a relation between a table pointer TA1 and a main heat pulse width P3 obtained from the point TA1.

FIG. 30 shows a relation between a table pointer TA3 and a pre-heat pulse width P1.

FIGS. 31A, 31B and 31C show relations between the recording head temperature TH and a pre-heat pulse width P1.

DETAILED DESCRIPTION OF THE PREFERRED EMBODIMENTS

Referring to the accompanying drawings, the embodiments of the present invention will be described in detail.

Embodiment 1

Figure 1:
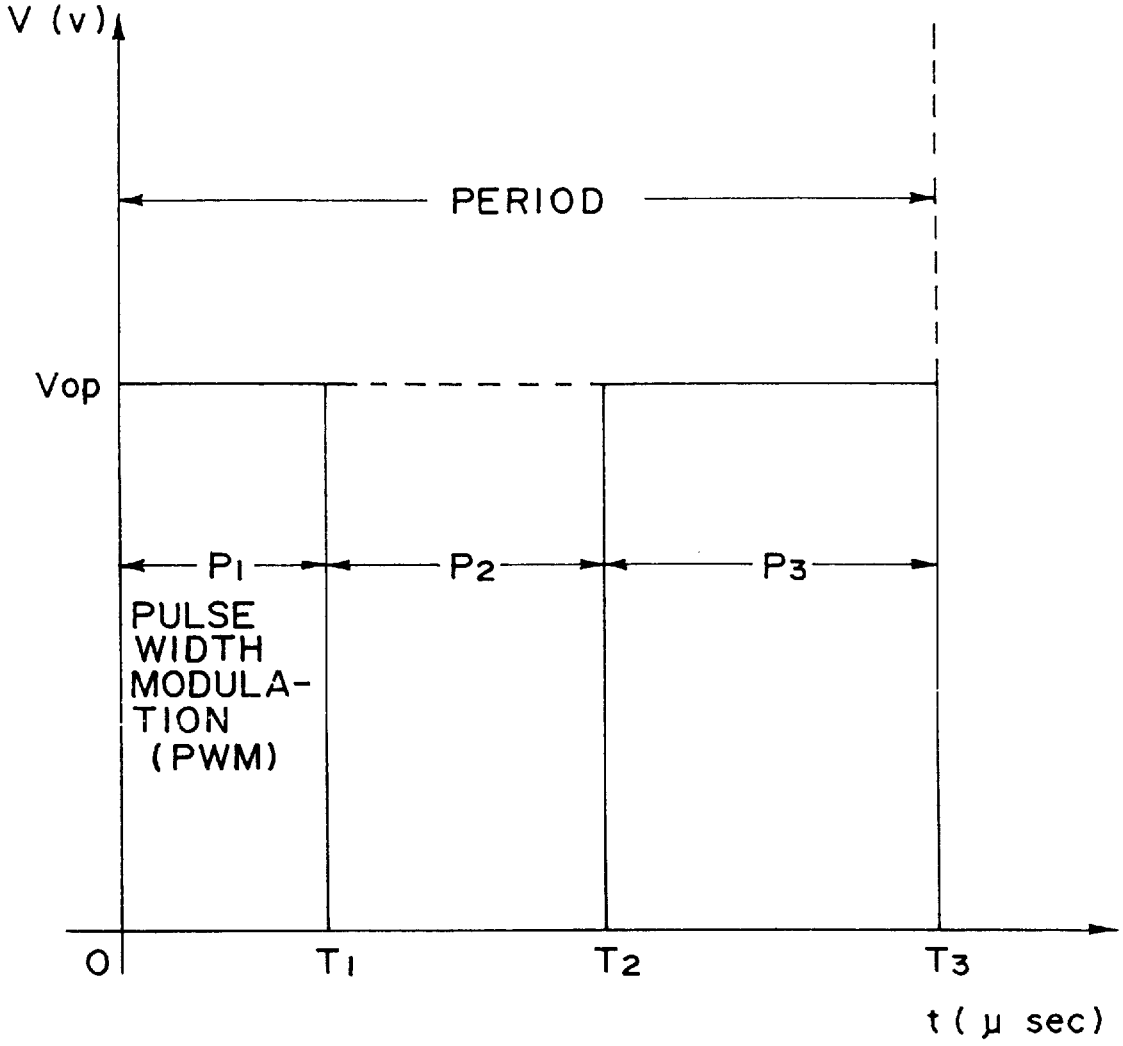
FIG. 1 shows a pulse waveform in a pulse width modulation driving method for divided pulses, according to an embodiment of the present invention.

FIG. 1 is a graph illustrating divided pulses used in an apparatus according to an embodiment of the present invention.

In FIG. 1, Vop designates a driving voltage; P1, a pulse width of a first heat pulse (pre-heat pulse) of divided pulses; P2, an interval pulse time period; and P3, a pulse width of a second pulse (main heat pulse). In addition, T1, T2 and T3 designate times determining the pulse widths P1, P2 and P3. The driving voltage Vop provides an electrothermal transducer with electric energy for producing thermal energy in the ink within an ink passage constituted by a heater board and a top plate. The amount of the electric energy is dependent on the area of the electrothermal transducer, resistance, film structure, the rigid passage structure or the like of the recording head. In the divided pulse width modulation driving method, the pulses are applied sequentially with the widths P1, P2 and P3. The pre-heat pulse mainly controls the temperature of the ink in the liquid passage and plays an important roll in the ejection amount control according to the present invention. The pre-heat pulse width is so selected that the thermal energy produced by the electrothermal transducer supplied with the pre-heat pulse is not enough to create a bubble in the ink.

The interval pulse time is provided so as to prevent the interference between the pre-heat pulse and the main heat pulse and in order to make the temperature distribution uniform in the ink in the ink passage. The main heat pulse is effective to create a bubble in the ink within the ink passage to eject the ink through an ejection outlet. The width P3 thereof is determined depending on the area of the electrothermal transducer, resistance thereof, the film structure thereof and the structure of the ink passage of the recording head.

Figure 2A:
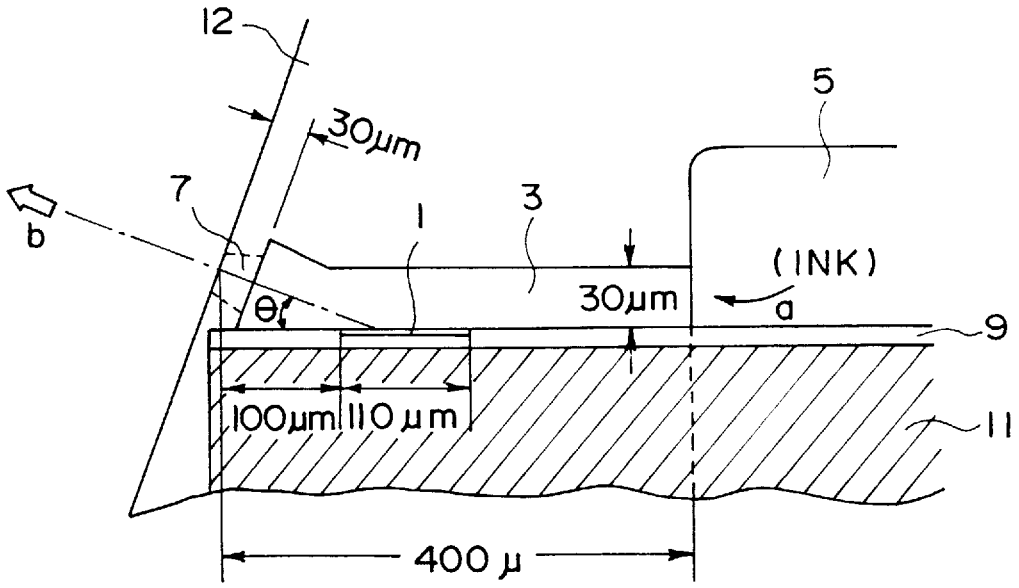
FIGS. 2A and 2B are a sectional view and front view of a recording head used in the embodiment of the present invention.
Figure 2B:
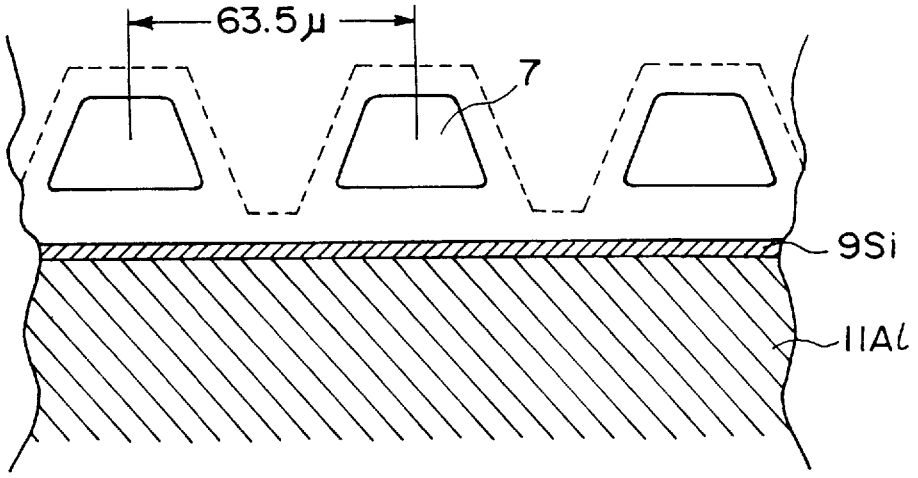

The function of the pre-heat pulse will be described in conjunction with a recording head having a structure shown in FIGS. 2A and 2B. FIGS. 2A and 2B are longitudinal sectional view and a front view of a recording head according to an embodiment of the present invention.

In FIGS. 2A and 2B, designated by a reference numeral 1 is an electrothermal transducer (ejection heater) for producing heat by application of divided pulses, and is mounted on a heater board 9 together with electrode wiring or the like for applying the divided pulses thereto. The heater board 9 is made of silicon (Si), and is supported on an aluminum plate 11 constituting a base plate of the recording head. A top plate 12 is provided with grooves for providing ink passages or the like, and when it is joined with the heater board 9 (aluminum plate 11), the ink passages 3 and a common liquid chamber 5 for supplying the ink to the ink passages 3, are constituted. The top plate 12 is provided with ejection outlets 7, and the ink passages 3 communicate with the ejection outlets 7.

In the recording head shown in FIG. 2, the driving voltage Vop=18.0 V, the main heat pulse width P3 is 4.114 micro-sec, and the pre-heat pulse width P1 is changed within a range of 0–3.000 micro-sec. Then, the relation shown in FIG. 3 was obtained between the ink ejection amount Vd (ng/dot) and the pre-heat pulse width P1 (micro-sec).

Figure 3:
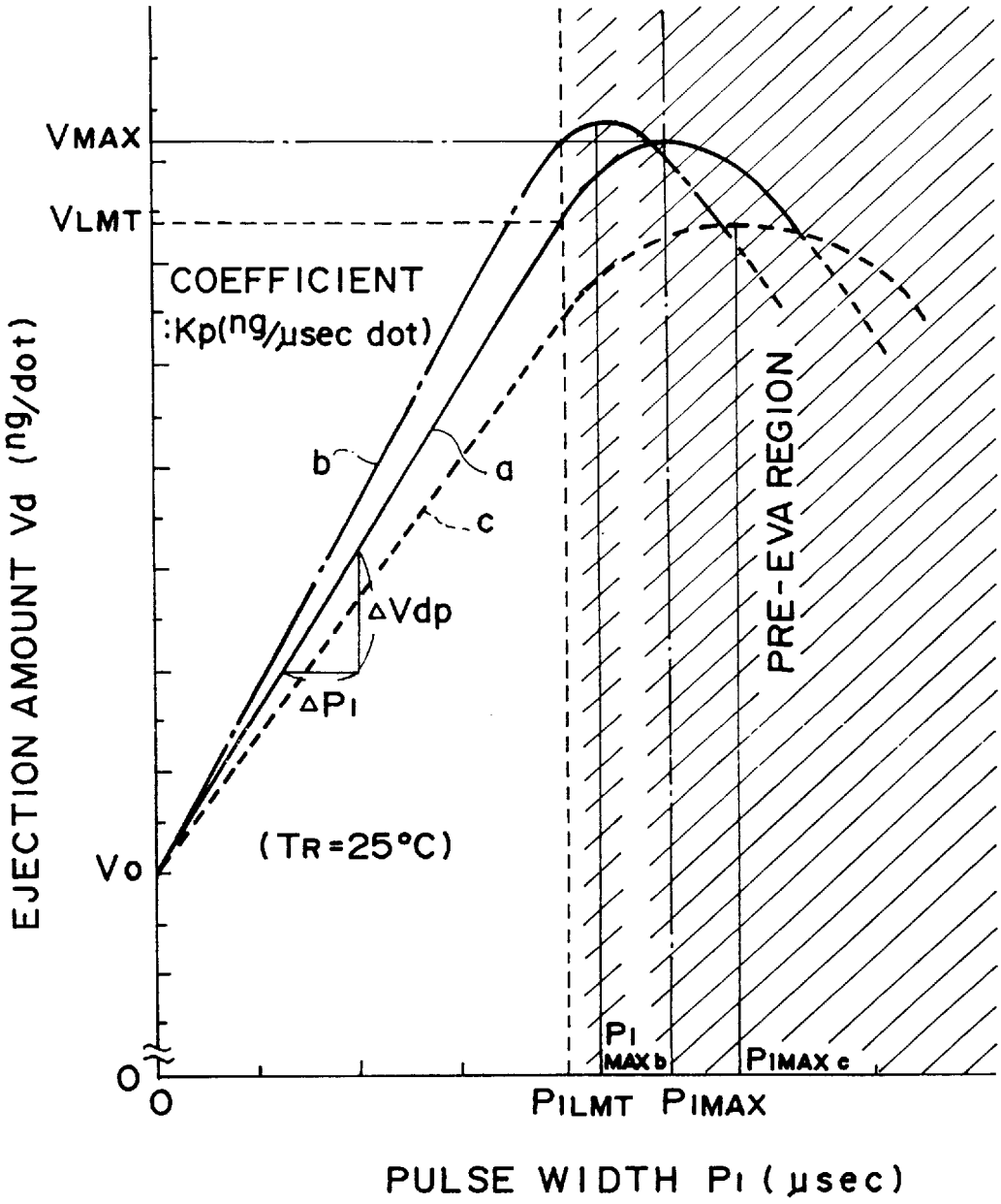
FIGS. 3 and 4 are graphs showing a relation between ink ejection amount and a pulse width in an embodiment of the present invention, and a relation between an ink ejection amount and a head temperature, respectively.

FIG. 3 is a graph of the dependency of the ejection amount on the pre-heat pulse. In this Figure, V0 is the ejection amount when P1=0 (micro-sec), and ejection amount is dependent on the head structure of FIG. 2. In this embodiment, the ejection amount V0=18.0 (ng/dot) under the ambient temperature TR=25° C.

As indicated by a curve a in FIG. 3, the ejection amount Vd increases with increase of the pre-heat pulse width P1 within the range of pulse width from 0 to P1LMT with linear nature. Beyond the limit P1LMT, the change becomes non-linear, and saturate to the maximum at the pulse width of P1MAX.

Within the range in which the ejection amount Vd linearly changes with the change of the pulse width P1, that is, within the range up to the pulse width of P1LMT, the ejection amount control by changing the pulse width P1 is effective. In the curve a, P1LMT is 1.87 micro-sec, and the ejection amount at this time (VLMT) is 24.0 (ng/dot). The pulse width P1MAX when the ejection amount Vd saturates P1MAX=2.1 (micro-sec), and the ejection amount at this time, VMAX=25.5 (mg/dot).

When the pulse width is larger than P1MAX, the ejection amount Vd is smaller than VMAX. The reason for this is as follows. When the pre-heat pulse having such a large pulse width is applied, fine bubbles are produced on the electrothermal transducer (the state immediately before the film boiling), and before extinction of the bubbles, the next main heat pulse is applied. Then, the fine bubbles disturb the creation of the bubble by the main heat pulse, and therefore, the ejection amount reduces. This zone is called bubble pre-creation region, and the ejection amount control using the pre-heat pulse becomes difficult in this zone.

The inclination of the line in the graph of ejection amount vs. pulse width within the range P1=0–P1LMT (micro-sec) in FIG. 3, is defined as a pre-heat pulse dependency coefficient. The coefficient is expressed as follows:

$Kp=\Delta VdP/\Delta P1$ (ng/micro-sec.dot)

The coefficient Kp is independent from the temperature but is dependent on the head structure, driving condition, the nature of the ink or the like. In FIG. 3, curves b and c are for other recording heads. It will be understood that the ejection property is different if the recording head is different. Thus, since the upper limit P1LMT for the heat pulse P1 is different if the recording head is different, the ejection amount control is effected with the upper limit P1LMT determined for each of the recording heads, as will be described hereinafter. With the recording head and the ink indicated by the curve a in this embodiment, Kp was 3.209 (ng/micro-sec.dot).

Another factor influential to the ejection amount of the ink jet recording head is a temperature of the recording head (ink temperature).

Figure 4:
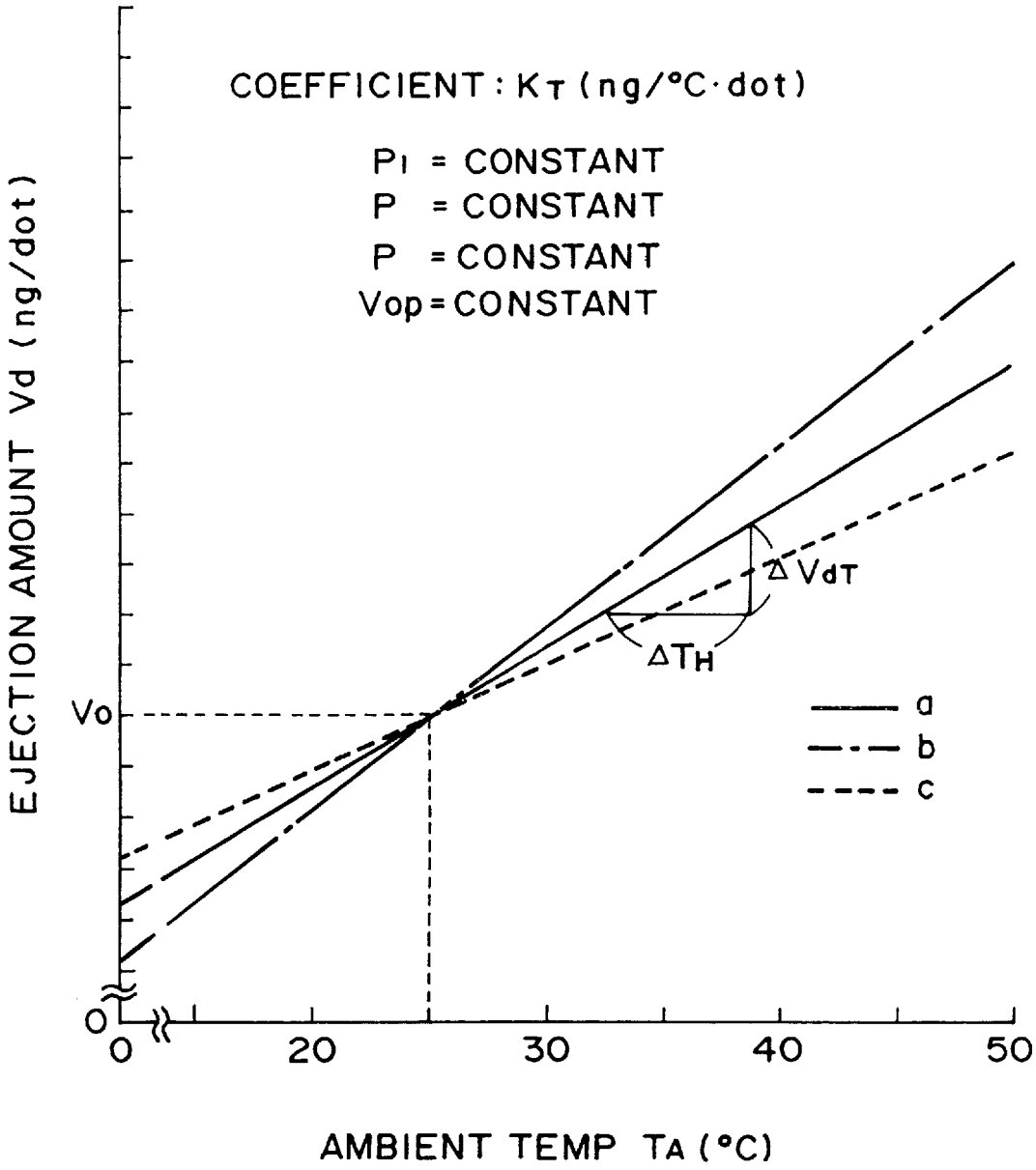

FIG. 4 shows the dependency of the ejection amount on the temperature. As indicated by a curve a in FIG. 4, the ejection amount Vd linearly increases with increase of the ambient temperature TR (=head temperature TH) of the recording head. The inclination of the line is defined as a temperature dependency coefficient and is expressed as:

$KT=\Delta VdT/\Delta TH$ (ng/°C.dot)

The coefficient KT is dependent or the driving conditions and is dependent on the head structure, the ink nature or the like. In FIG. 4, curves b and c indicate the cases of other recording heads. In the recording head of this embodiment KT is 0.3 (ng/°C.dot).

Using the relationships shown in FIGS. 3 and 3, the ejection amount is controlled in the embodiment of the present invention.

The description will be made as to the ejection amount control method using double pulses.

Figure 5:
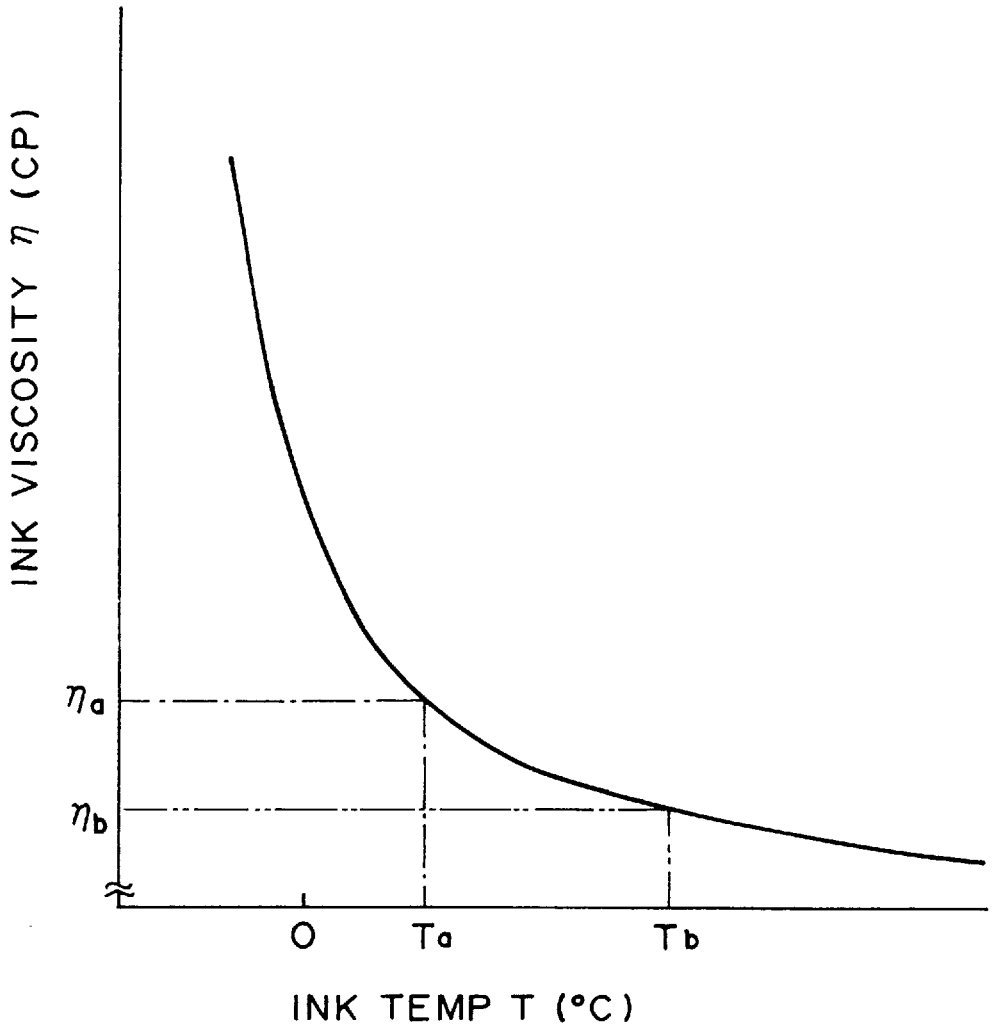
FIGS. 5, 6 7(A), 7(B) and 7(C) illustrate the principle of divided pulse width modulation driving method, according to an embodiment of the present invention.

FIG. 5 shows a relation between an ink temperature Tink (°C.) and ink viscosity η (T) (cp). This graph shows the decrease of the ink viscosity with the increase of the ink temperature. Therefore, if the ink temperatures are Ta<Tb, then ηa>ηb.

FIG. 6 shows the bubble creation when a predetermined energy required for the bubble creation is applied by the main pulse P3. When the ink temperature is different, that is, when the ink viscosity is different, the bubble expansion boundary is different, as will be understood from this Figure.

In the case of (A) of FIG. 6, the temperature Ta is low, and therefore, the ink viscosity ηa is high. Against the pressure p0 expanding the bubble, the resistance Ra (η) due to the ink viscosity is large, and therefore, the bubble expansion boundary is relatively small as indicated by chain lines. In the case of (B) of FIG. 6, the ink temperature Tb is high, and therefore, the ink viscosity ηb is low. In this case, against the pressure p0 expanding the bubble, the resistance due to the ink viscosity Rb (η) is small, and the bubble expansion boundary is extended as indicated by the chain line. In actual head, the flow passage impedances are different at an upstream and downstream sides so as to stabilize the ejection property and the refilling property, and therefore, the bubble is not symmetrical.

In order to increase the ejection amount of the ink, and therefore, to increase the bubble expansion region or bubble volume, it is desirable that the ink temperature not only adjacent the heater but also the ink temperature away from the heater. The embodiment is based on this.

Figures 7A, 7B, 7C:
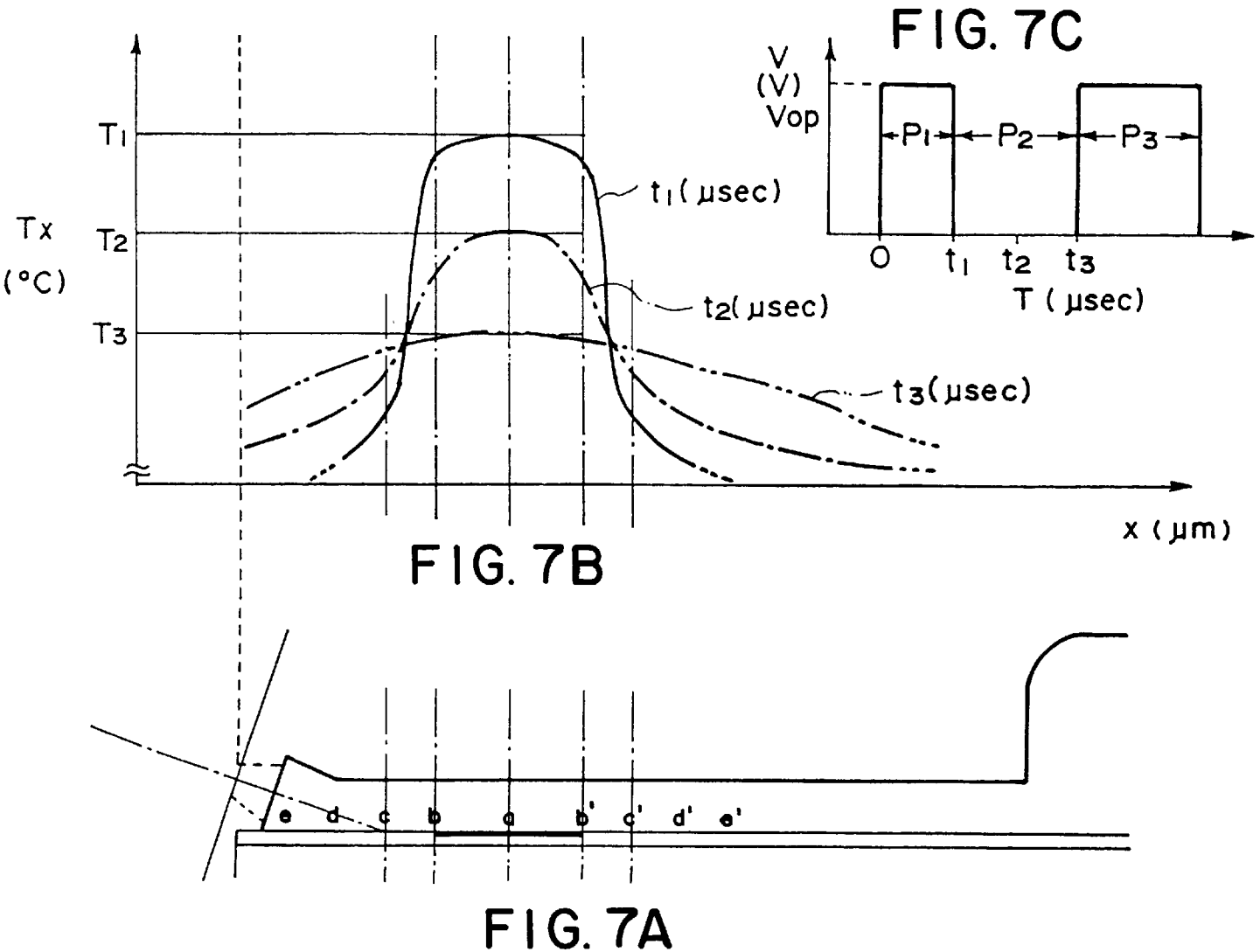

FIG. 7(A) shows a sectional view of a ink jet recording head using thermal energy in the neighborhood of its nozzle, and FIG. 7(B) is a graph showing the ink temperature distribution change with time. After the pre-heat pulse P1 is applied. FIG. 7(C) shows a relation between the pre-heat pulse P1 and the main heat pulse P3.

Immediately after the pulse energy P1 is applied t1 (micro-sec), the temperature of the ink very close to the heater (a, b, b') is high, but the ink temperature at a position slightly away from the heater (c, c') becomes steeply low, as indicated by a solid line in FIG. 7(B).

At time t2 (micro-sec) which is about 1 micro-sec after application of the pulse P1, the temperature of the ink close to the heater (a, b, b') is low, whereas the temperature slightly away from the heater (c, c') is increased from the temperature t1, and the temperature of the ink further away from the heater (d, d') is slightly increased, as shown by one-dot chain line.

At time t3 which is immediately before the application of the main heat pulse P3 and which is several micro-sec after the application of the pulse P1, the ink temperature at a position close to the heater (a, b, b') further decreases; the ink temperature at the position slightly away from the heater (c, c') further increases; and at a position further away from the heater (d, d') approaches the ink temperature at the position close to the heater, as indicated by two-dot chain line.

As will be understood from the foregoing, in order to increase the ink temperature at the position fairly away from the heater, a certain period of time (interval time P2) is required after the application of the pulse energy. In the process of the ink temperature distribution change due to the heat transfer with time, the total energy is constant in an adiabatic system.

When the main heat pulse P3 is applied at the time t2, the bubble expansion region is smaller than when it is applied at time t3, since at the time t2, the ink temperature adjacent the heater (c, c') is not sufficiently increased, while the ink temperature at the position close to the heater (a, b, b') is high. And therefore, the ink ejection amount is not large. It will be understood that the interval time P2 is long enough to expand the energy of the pre-heat pulse P1, since otherwise the neighborhood ink temperature attributable to the expansion of the bubble is not high enough with the result of relatively small bubble expansion. In other words, the interval time P2 is effective to permit the energy of the pre-heat pulse P1 to extend to the bubble expansion boundary around the heater, in other words, effective to provide a desired ink temperature distribution around the heater. Therefore, it has been found that the length of the interval time P2 as well as the pre-heat pulse P1 is a significant parameter from the standpoint of the ejection amount control.

As will be understood from the foregoing, the ejection control principle in this embodiment is that the variable energy for increasing the ink temperature is supplied by a variable heat pulse P1, and the applied energy is transferred to the bubble expansion boundary region by the provision of the interval time P2 so as to provide a desired ink temperature distribution, and thereafter, the main heat pulse P3 is applied to eject a desired amount of the ink.

In other words, by using both of the pre-heat pulse P1 of the double pulses and the interval time P2 prior to the main heat pulse P3 application, the supplied energy and the time elapse thereafter are both effectively used to provide the desirable ink temperature distribution T (x, y, z) around the heater up to the bubble expansion boundary region, and therefore, the ink viscosity distribution η (x, y, z) around the heater up to the boundary region, thus controlling the bubble expansion to control the ejection amount.

As will be described in detail in conjunction with FIG. 9, [1], [2] and [3], in order to efficiently convert the pre-heat pulse P1 energy to the ejection energy, the length of the interval time P2 is desirably larger than the pre-heat pulse P1 width even when the ink ejection amount is around the maximum, that is, even if the length of the pre-heat pulse P1 is the maximum. With the longest pre-heat pulse P1, the supplied energy is the maximum, and the ink temperature adjacent the heater becomes highest. However, unless the interval time P2 is sufficiently long, the bubble expansion does not become the maximum.

By increasing the ink temperature close to and around the heater, the bubble expansion speed is increased, and the amount of the ink evaporated increases. This cooperates with the expansion of the bubble expansion region to increase the ink ejection amount.

Figure 8:
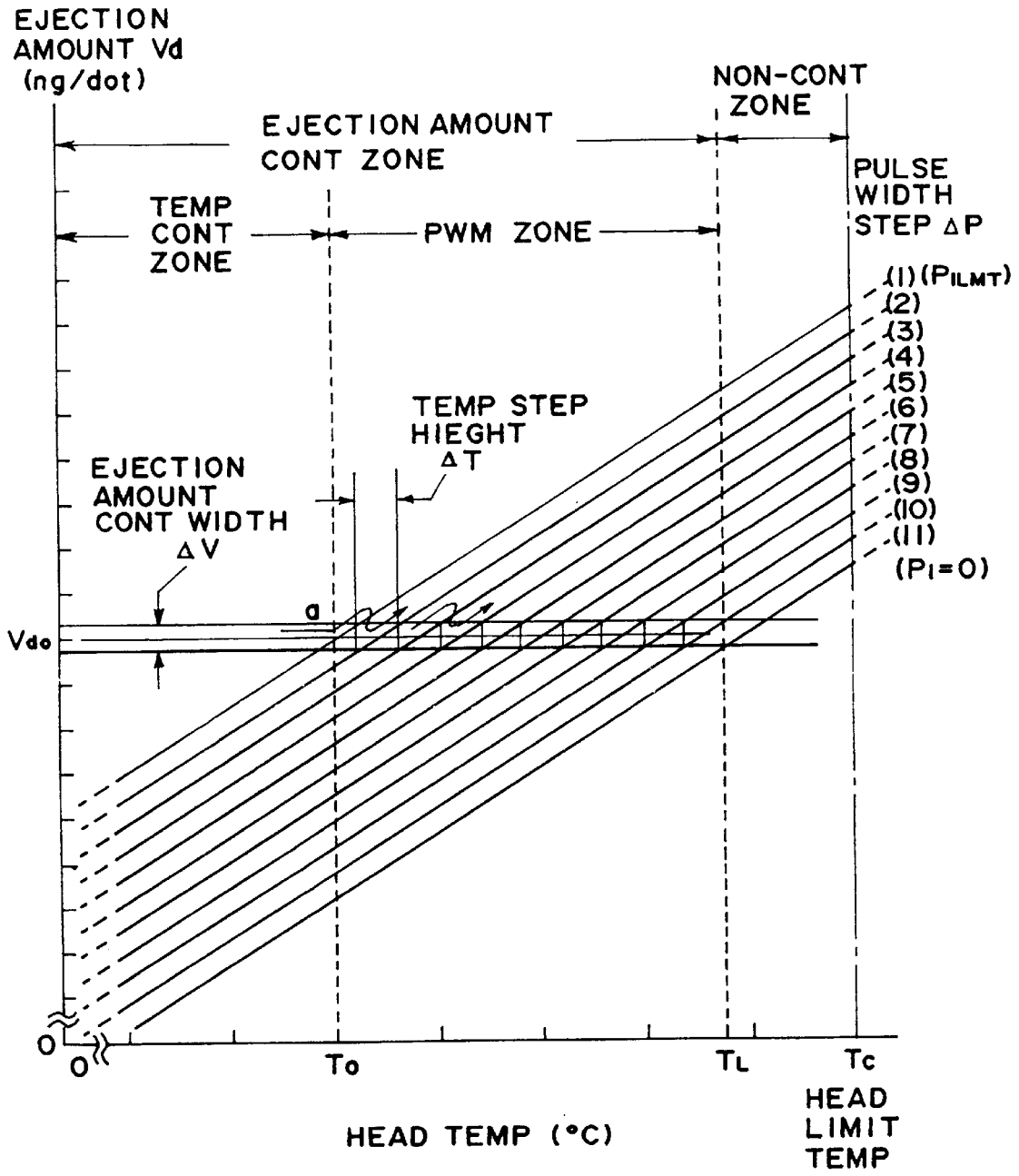
FIG. 8 illustrates an ejection amount control method according to an embodiment of the present invention.

FIG. 8 is a graph explaining the ejection amount control according to an embodiment of the present invention. Referring to this Figure, the description will be made as to the ejection amount control principle.

As shown in FIG. 8, the ejection amount control includes the following three aspects:

In accordance with the recording head temperature, (1) TH≦T0: ejection amount control by temperature control (2) T0<TH≦TL: ejection amount control by divided pulse width modulation (3) TL<TH<TC: no control (P1=0).

Here, when TH≧TC, the bubble creation limit of the ink jet recording head is exceeded.

As will be understood, when the recording head temperature TH is not higher than a relatively low temperature T0 (25° C., for example), the ejection amount control is effected by the recording head temperature described hereinbefore, and when it is relatively high, that is, higher than the temperature T0, the ejection amount is controlled by changing the pulse width of the pre-heat pulse described in the foregoing in conjunction with FIG. 3 (PWM control).

The reason why the ejection amount control mode is changed in accordance with the head temperature is that in the region of relatively low temperature, the bubble creation upon the application of the heat to the ink is sometimes not stable, and therefore, the ink ejection is not stable because of the ink viscosity, and therefore, the ejection amount control by the pulse width modulation becomes difficult. Therefore, when the head temperature is low, the head temperature is controlled to a predetermined temperature (T0) by the temperature control so as to provide a constant amount of ink ejection. When the head temperature is high enough, the pre-heat pulse is modulated to control the ejection amount of the ink.

The temperature T0 is a target temperature of the recording head of the temperature control. When the temperature of the recording head is T0, the target ejection amount Vd0 (30 (ng/dot), for example) is provided in the ejection amount control of this embodiment. The temperature TL indicated in FIG. 8 where the ejection amount control reaches the limit, may be selected at a temperature corresponding to the control limit ejection amount VLMT shown in FIG. 3, in consideration of the relation between the temperature and the ejection amount shown in FIG. 4.

The mode (1) enumerated above corresponds to the temperature control region in FIG. 8, and is carried out to maintain the predetermined ejection amount mainly under the low temperature ambience, in which the temperature of the recording head (the temperature of the ink) is controlled to be the target temperature T0 by the temperature control. By doing so, the ejection amount Vd0 at the time of TH=T0, can be provided.

In this embodiment, T0=25° C. in order to minimize the problems with the temperature control (ink viscosity increase and ink solidification attributable to the evaporation of the water content of the ink and the temperature control ripple). Under the usual ambient conditions, for example, the room temperature is maintained at 20°–25° C. If the temperature of the recording head is maintained at this temperature, the above described problems can be eased. The pulse width P1 of the pre-heat pulse is selected to be P1LMT so as to provide the maximum ejection amount VLMT at t1=25° C. The control mode (1) in this embodiment, as shown in FIG. 9 which will be described hereinafter, P1=1.87 (micro-sec), P2=2.618 (micro-sec), P3=4.114 (micro-sec). They correspond to 1 in the table in FIG. 10.

Figure 11:
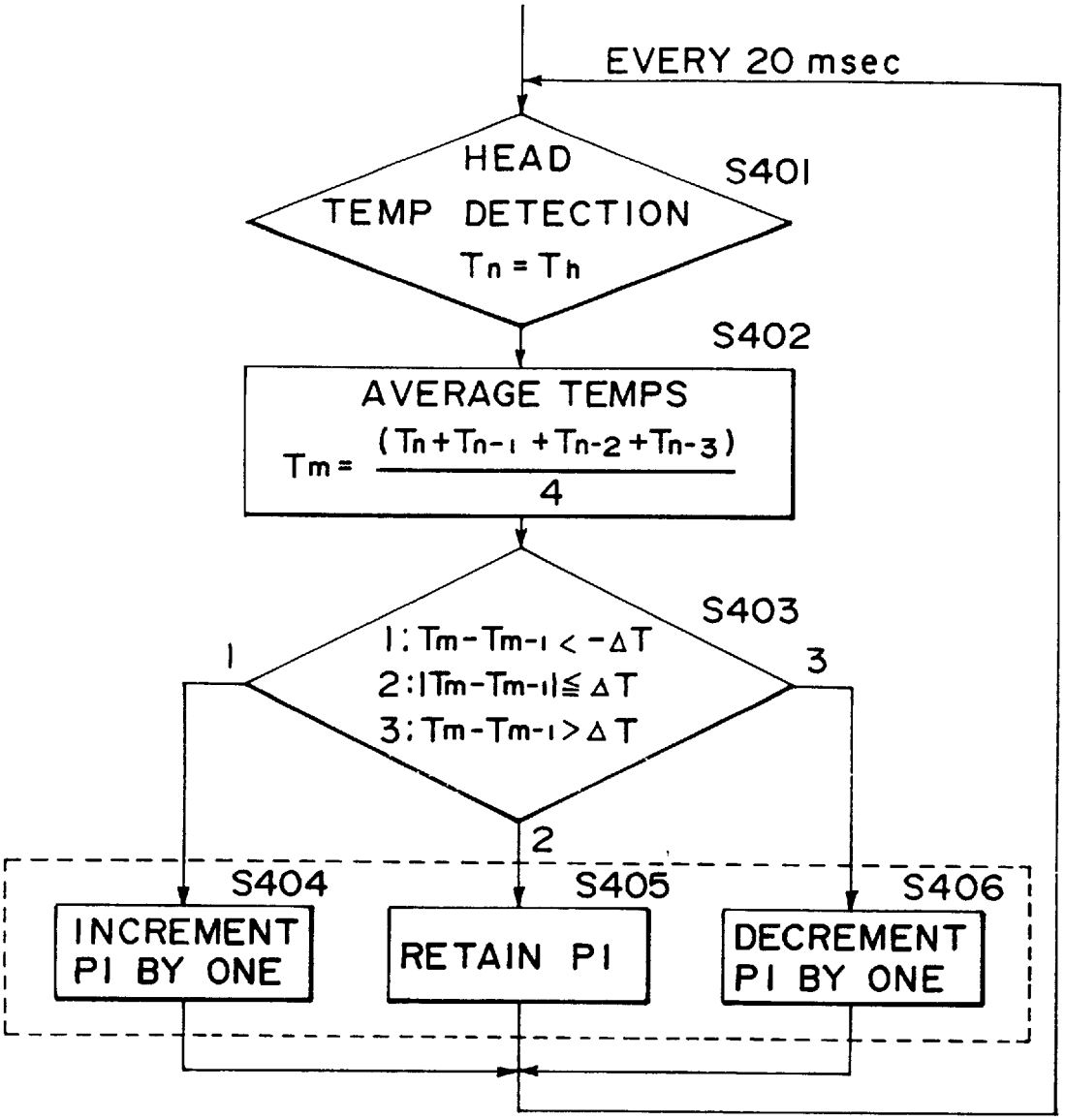
FIG. 11 is a flow chart of a pulse width modulation sequential operations in an embodiment of the present invention.

The control mode (2) enumerated above corresponds to the pulse width modulation zone in FIG. 8. In this zone, the recording head temperature is relatively high, that is, not lower than T0 (26° C.–44° C., for example) because of the self temperature rise due to the printing operation performed or the increase of the ambient temperature. The temperature is detected by the temperature sensor, and the pre-heat pulse width P1 is changed in accordance with the table shown in FIG. 10. FIG. 9 shows the pulse widths corresponding to the numbers in the table of FIG. 10. FIG. 11 is a block diagram of sequential operations in the pulse width modulation. In the case of the recording head in this embodiment, the upper limit P1LMT of the pulse width P1 takes the value indicated by 1 of FIG. 9, i.e.,.OA (Hex) indicated by table No. 1 in FIG. 10. As will be described hereinafter, the upper limit is set by a table pointer information.

Referring to FIG. 11, the ejection amount control using the pulse width modulation shown in FIG. 8 will be described. The sequential operation shown in FIG. 11 is started in response to interruption which is made for each 20 msec, for example. At step S401, the temperature of the recording head is detected. Then, at step S402, an average temperature of the previous three head temperatures detected at step 401 is obtained to prevent erroneous detection attributable to the heat flux entering the temperature sensor and/or attributable to the electrical noise. At step S403, the average temperature Tm is compared with the previous average temperature Tm−1, and a difference T=Tm−(Tm−1) is obtained. Then, the discrimination is made as to whether the temperature difference T is smaller than a predetermined temperature step width ΔT, that is, whether or not the difference T is smaller than the temperature range in which the ejection amount does not change even if the pulse width P1 is changed by unit pulse width (0.187 micro-sec) which correspond to the pulse width change at the position corresponding to the table number in FIG. 10 (±ΔT corresponds to the temperature range of ±1° C. (2° C.) in FIG. 10). If so, at step S405, the pulse width P1 is retained. If the difference T is larger than +ΔT, a step S406 is carried out, where the table number in the table of FIG. 10 is incremented by one so that the pulse width P1 is lowered by one to reduce the ejection amount. If the difference is smaller than −ΔT, a step S404 is executed where the table number is lowered by one so that the pulse width P1 is increased by one step to increase the ejection amount. In this manner, the control is carried out to maintain a constant ink ejection amount Vd0. The reason why the pulse width P1 change in response to the temperature change is one unit pulse width is that an erroneous feed back operation such as erroneous temperature detection by the sensor is prevented so as to avoid the image density jumps. In this embodiment, the recording head temperature is provided as an average of outputs of right and left (2) temperature sensors.

The temperature is detected as an average of four detections because the erroneous temperature detection due to the noise or the like of the sensor so as to accomplish a smooth feedback control. In addition, the density variation resulting from the control is minimized to prevent or suppress production of joint stripe due to the density change in a serial printing.

With the above-described control, the temperature range controllable by the table of FIG. 10 is ±ΔV relative to the target ejection amount Vd0. The ejection amount changes as indicated by an arrow a in FIG. 8.

If the ejection amount change is within such a range, the density variation occurring in one print can be suppressed to ±0.2 even in the case of 100% duty printing, and therefore, the image density non-uniformity or the joint stripe occurrence is not remarkable even in the serial printing system. If the number of data to obtain the average is increased, the influence of the noise is reduced, and the change becomes smoother. However, in the case of real time control, the detection accuracy is deteriorated so that the correct control is obstructed. If the number is reduced, the influence of the noise is remarkable, and the change becomes more abrupt. However, in the real time control, the detection accuracy is enhanced, and the correct control is possible.

The control mode (3) corresponds to the non-control region shown in FIG. 8. In this region is usually outside the normal printing operation of the recording head, and therefore, it is not frequently used. However, if the recording head is operated continuously at 100% duty, for example, the temperature may fall in this region. In case of such a situation, only the main heat pulse (single pulse) is applied for printing (P1=0) to minimize the self temperature rise. The temperature TC is the limit of the usable range of the recording head.

In this embodiment, the table of FIG. 10 is used, and the sequential operations of FIG. 11 are carried out, by which the control is possible up to the head temperature TH=46° C., and the ejection amount can be controlled within the range of ΔV=±0.3 (ng/dot) relative to the central ejection amount Vd0=30 (ng/dot).

Figure 12:
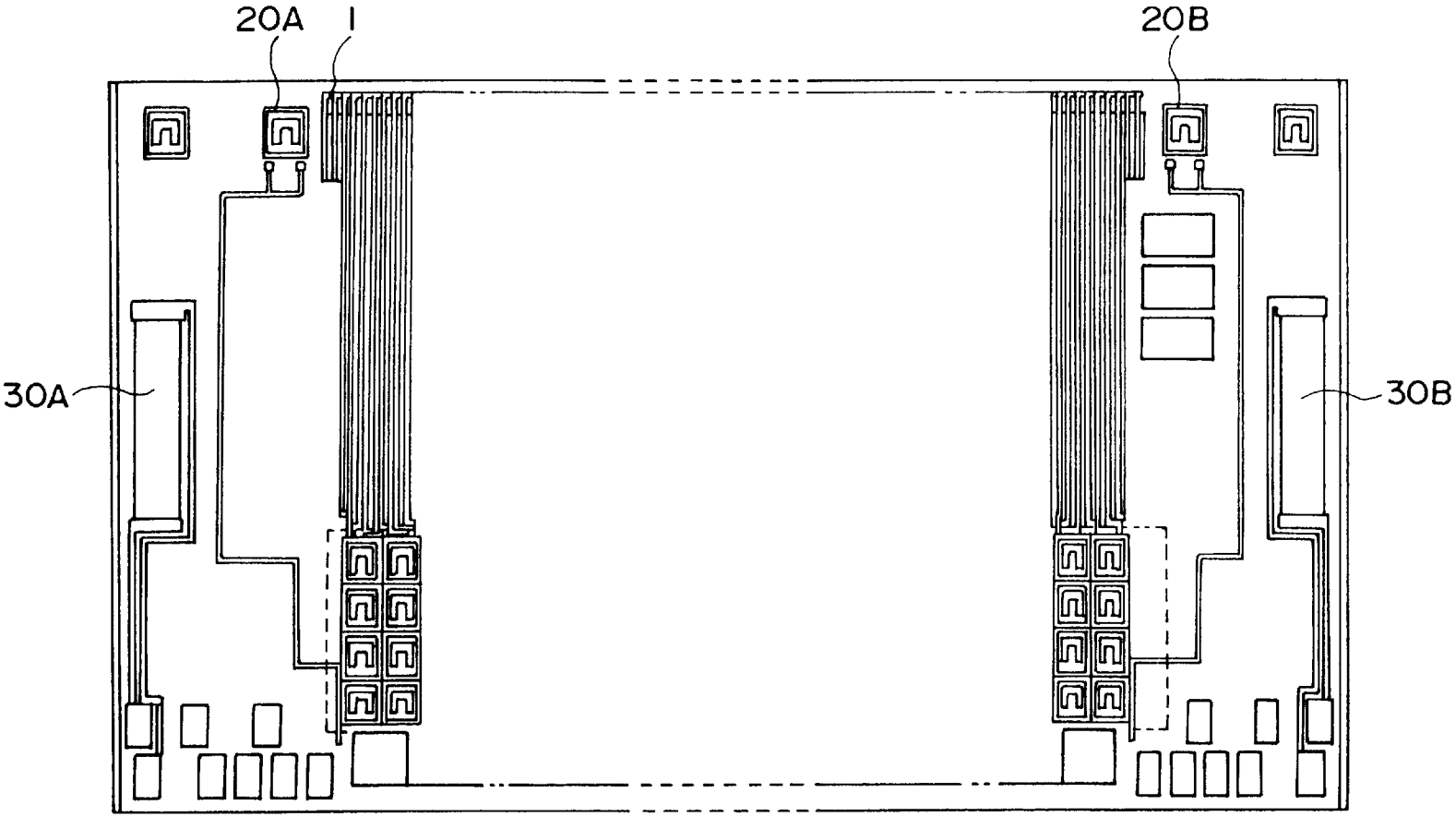
FIG. 12 is a top plan view of a heater board, used in an embodiment of the present invention.

FIG. 12 shows a heater board of the recording head usable in the foregoing embodiment. The heater board is provided with temperature sensors, temperature control heaters and ejection heaters thereon.

As shown in the top plan view of the heater board of FIG. 12, temperature sensors 20A and 20B are disposed at the right and left of an array of ejection heaters 1 on the Si base 9. The ejection heaters 1, temperature sensors 20A and 20B and temperature control heaters 30A and 30B disposed at the right and left of the heater board, are patterned and formed through a semiconductor manufacturing process. In this embodiment, the detected temperature is obtained as an average of the outputs of the temperature sensors 20A and 20B.

Figure 13:
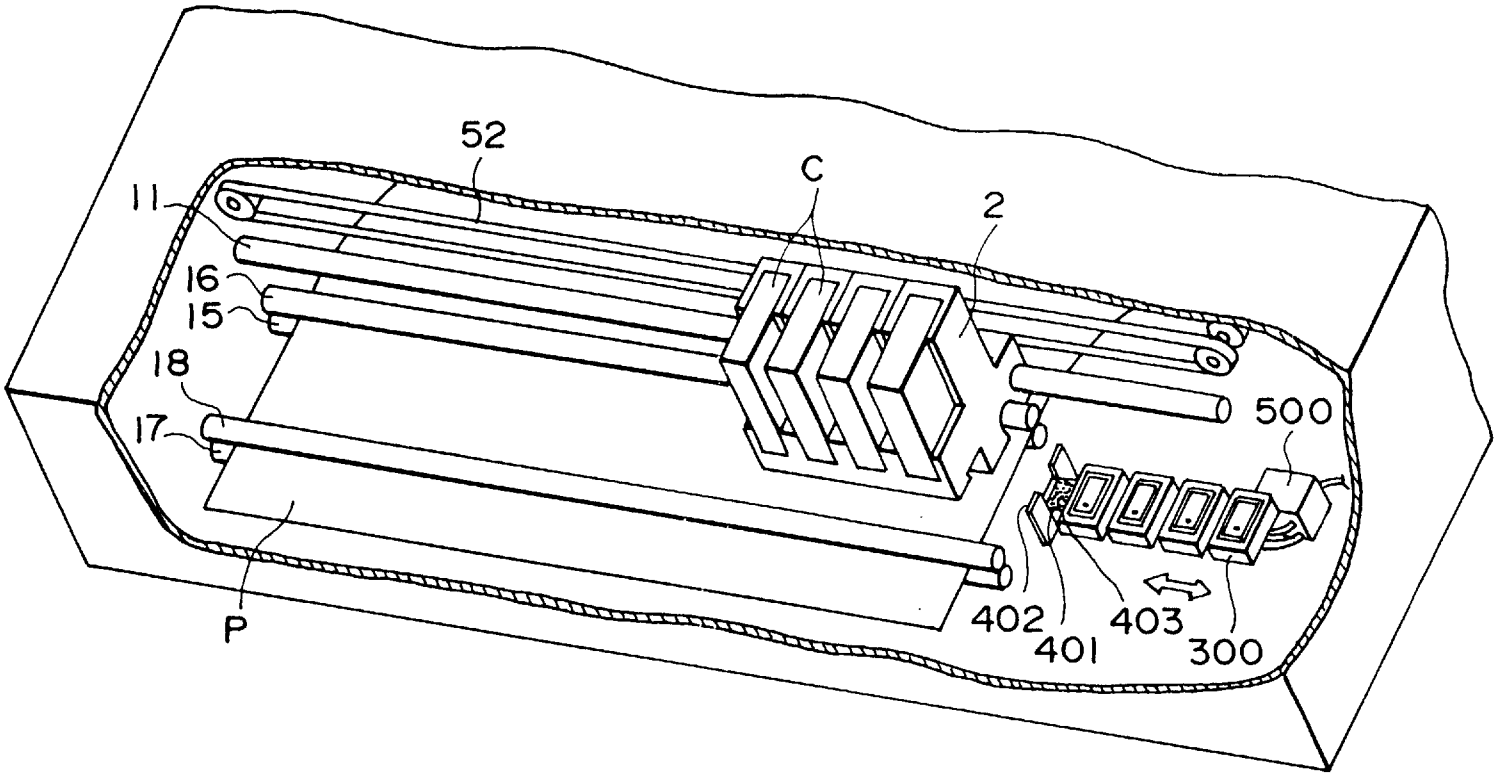
FIG. 13 is a perspective view of a color printer according to an embodiment of the present invention.

FIG. 13 shows an ink jet recording apparatus incorporating the ejection amount control system according to this embodiment of the present invention. The printer is in the form of a full-color serial type printer usable with detachably mountable recording heads for black color (BK), cyan color (C), magenta color (M) and yellow color (Y). Each of the recording heads used with this printer has the performance of 400 dpi of resolution power, 4 kHz of the driving frequency and is provided with 128 ejection outlets.

In FIG. 13, four recording head cartridges C are provided for yellow, magenta, cyan and black ink material each of the cartridges comprises a recording head and an ink container for supplying the ink to the recording head. Each of the recording head cartridge C is detachably mountable to a carriage of the printer by an unshown mechanism. The carriage 2 is slidable along a guide shaft 11 and is connected with a part of a driving belt 52 moved by an unshown main scan motor. Thus, the recording head cartridge C can scanningly move along the guide shaft 11. Feeding rollers 15, 16 and 17, 18 are disposed substantially parallel with the guiding shaft 11 at the rear and front sides of the recording region of the scanning recording head cartridge C. The feeding rollers 15, 16 and 17 and 18 are driven by sub-scan motor to feed the recording material P. The recording material P is faced to an ejection side surface of the recording head cartridge C to provide a recording surface.

Figure 14:
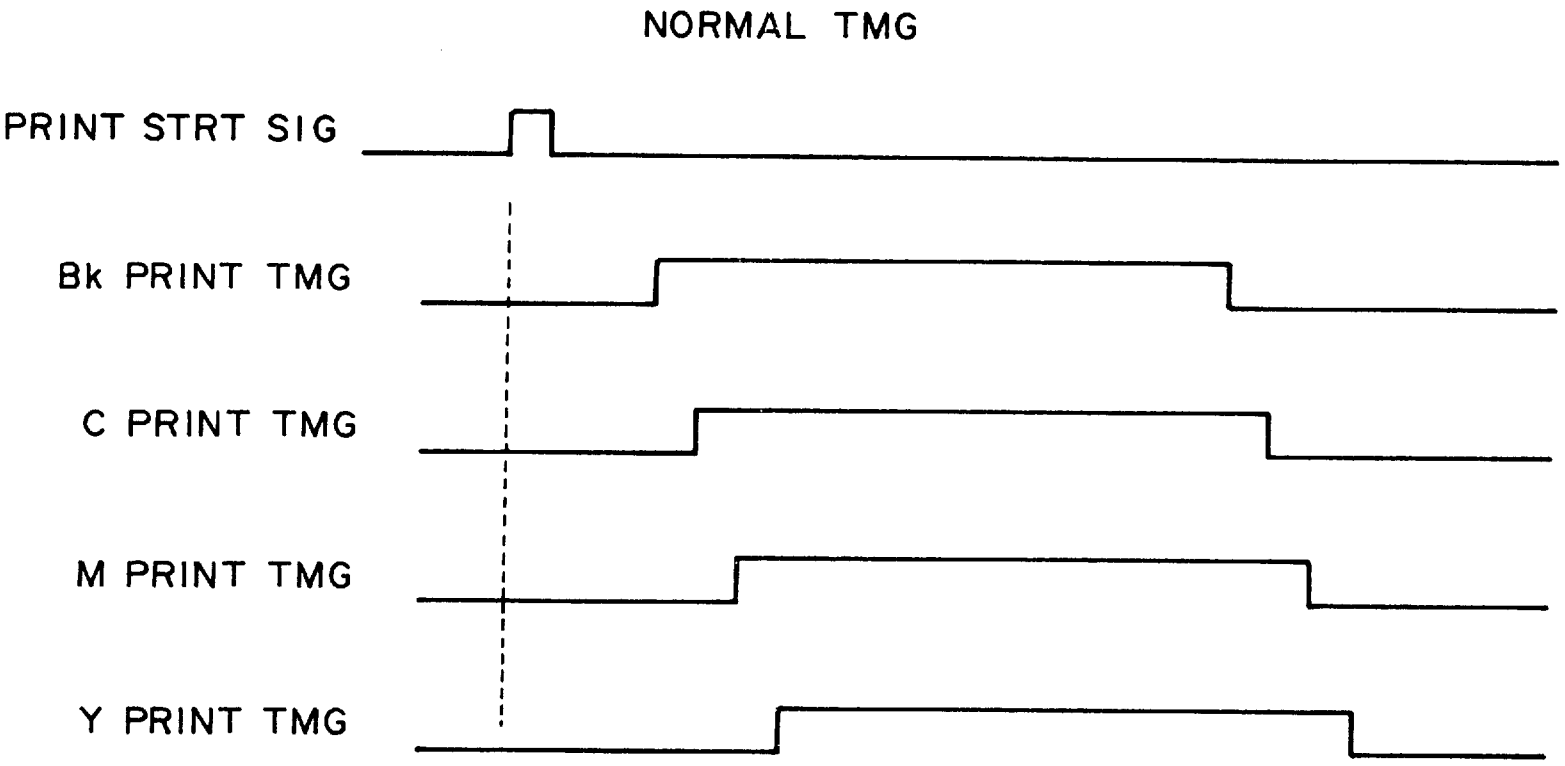
FIG. 14 shows print timing for each color in a full-color printing operation.

FIG. 14 shows the print timing for the four colors in the full color printing operation. The recording head cartridges for the respective colors are mounted on the carriage at predetermined intervals, and the recording operation is effected during movement of the carriage. Therefore, the printing actions of the recording heads occur at different timings to compensate for the intervals between the respective recording heads.

A recovery system unit is disposed to face to a part of a movable range of the cartridge C. The recovery unit comprises a cap unit 30 disposed correspondingly to the respective cartridge C having the recording heads. It is slidably movable to the right or left together with movement of the carriage 2, and is vertically movable. When the carriage 2 is at the home position, the cap unit is contacted to the recording heads to cap them. The recovery unit comprises wiping members in the form of first and second blades 401 and 402, and a blade cleaner 403 made of ink absorbing material to clean the first blade 401.

The recovery system comprises a pump unit 500 for sucking the ink or the like from the ejection outlet of the recording head and from the neighborhood thereof with the aid of the capping unit 300.

Figure 15:
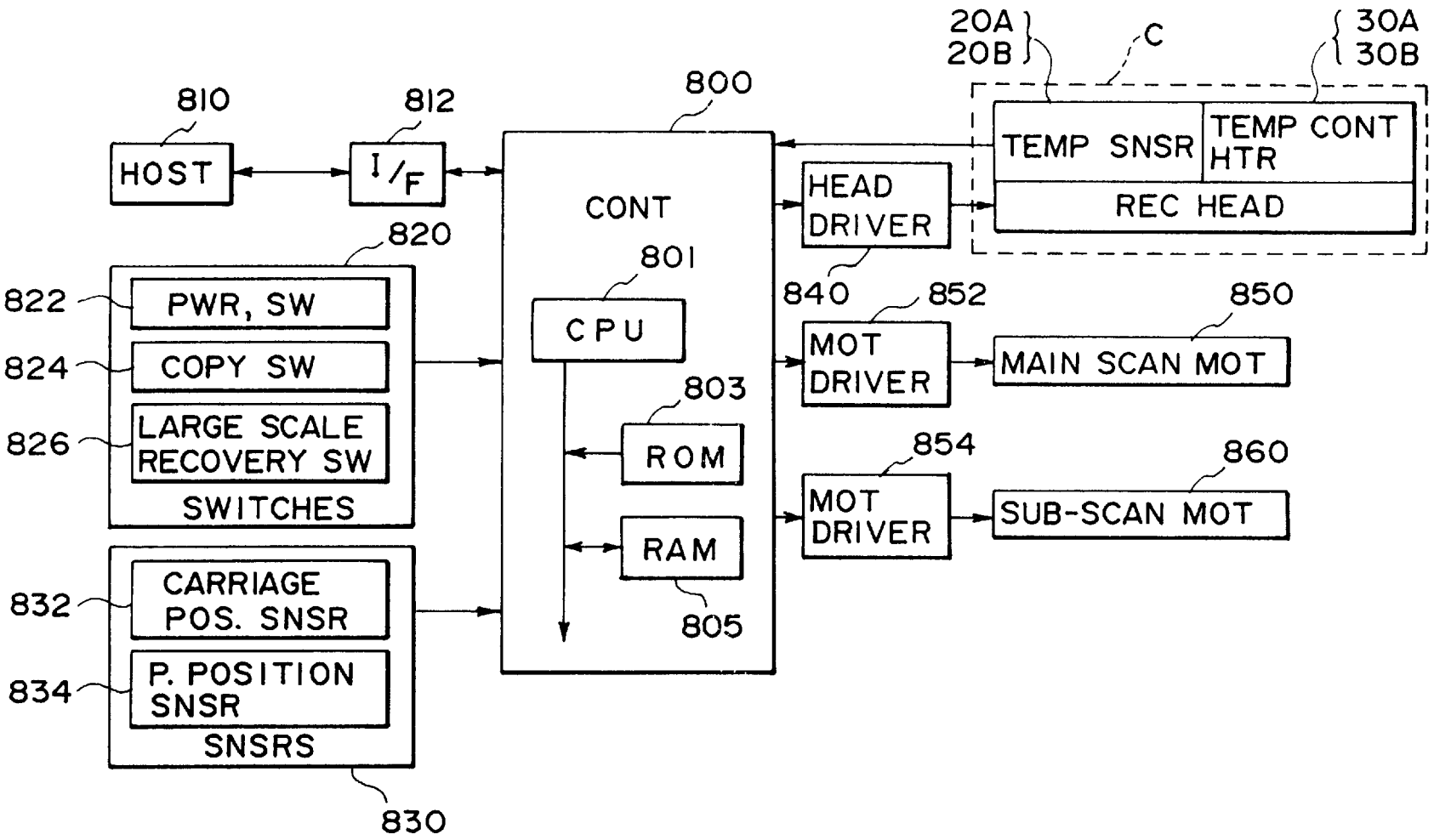
FIGS. 15 and 16 are a block diagram illustrating the control system structure for a printer according to an embodiment of the present invention, and a partly broken perspective view of a recording head cartridge used with the apparatus.

FIG. 15 is a block diagram of a control system of the ink jet recording apparatus.

The control system comprises a controller 800 functioning as a main control device. It comprises a CPU 801 in the form of a microcomputer for executing the sequential operations having been described in conjunction with FIG. 8, ROM 803 for storing the program for performing the sequential operations, the table of FIG. 10, the voltage level of the heat pulse, the pulse widths and another fixed data, RAM 805 having an area for processing the image data and a working area. Designated by a reference numeral 810 is a host apparatus (an image reader, for example) functioning as a source of image data. The image data, command and status signals or the like are transferred between the controller through an interface (I/F) 812.

Designated by a reference numeral 820 is a group of switches main switch 822, copy switch 824 for instructing start of copy or recording operation, a large scale recovery switch 826 for instructing to perform a large scale recovery operation. These switches are operable by the operator. Designated by a reference numeral 830 is a group of sensors including a sensor 832 for detecting a home position of the carriage 2, a start position thereof or the like, a sensor 834 for detecting pump position including a leaf switch 530, and other sensors for detecting the state of the apparatus.

A head driver 840 drives the electrothermal transducer (heater) of the recording head in accordance with the record data or the like (the driver for only one color is shown). A part of the head driver is used to drive the temperature heaters 30A and 30B. The temperature detection by the temperature sensors 20A and 20B are supplied to the controller 800. A main scan motor 805 moves the carriage 2 in the main scan direction (right-left direction in FIG. 10). The motor 850 is driven by a driver 852. A sub-scan motor 860 is used to feed the recording material in the sub-scan direction.

The recording head usable with FIGS. 13 and 15 will be described.

Figure 16:
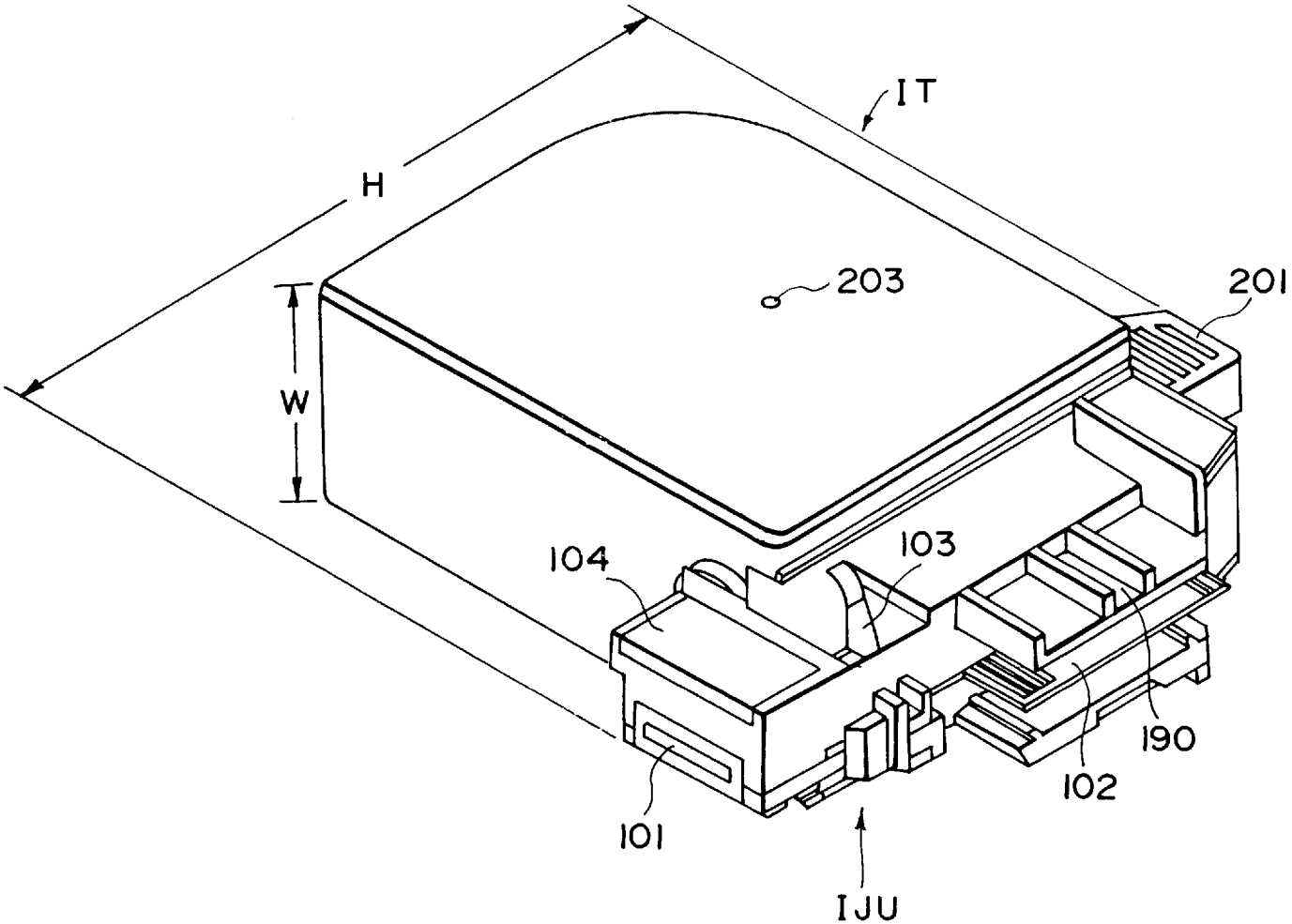

FIG. 16 shows an example of a recording head cartridge detachably mountable to the carriage of the ink jet recording apparatus shown in FIG. 13. The cartridge of this embodiment comprises integral ink container unit IT and recording head unit IJU. They are detachably mountable relative to each other. A wiring connector 102 functions to receive the signals or the like for driving the ink ejector 101 of the recording head unit and also effective to output the ink remaining amount detection signal. The connector is positioned in alignment with the head unit IJU and the ink container unit IT. By doing so, the height H can be reduced when the cartridge is mounted on the carriage which will be described hereinafter, and therefore, the thickness of the cartridge can be reduced. Therefore, as shown in FIG. 13, when the cartridges are juxtaposed, the size of the carriage can be reduced.

The head cartridge can be mounted using a grip 201 on the ink container unit IT with the ejection outlets 101 facing down. The grip 201 is engaged with a lever of the carriage which will be described hereinafter. When the recording head is mounted, a pin or pins of the carriage are engaged with a pin engaging portion 103 of the head unit IJU, so that the head unit IJU is correctly positioned.

The recording head cartridge of this embodiment is provided, at the ink ejection side 101, with an absorbing material 104 for wiping the surface of the ink ejecting side 101 to clean it. An air vent 203 is formed substantially at the center of the ink container unit 200 for introducing air in accordance with consumption of the ink therein.

Figure 17A:
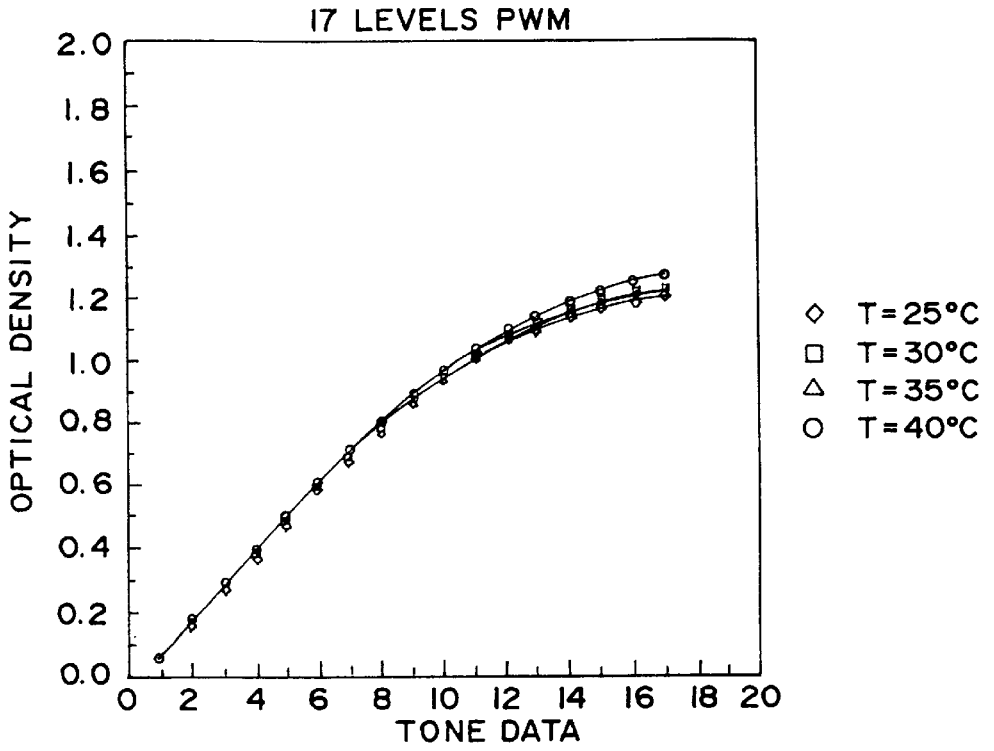
FIGS. 17A and 17B are a graph of tone reproducibility in a conventional apparatus and an apparatus according to an embodiment of the present invention.

Using the apparatus shown in FIGS. 13 and 15, various printing pattern are printed with the above-described PWM control, and it has been confirmed that the density variation in a scanning line peculiar to a serial type printer can be suppressed, and also that the image density variation in a page or between pages can be suppressed. Particularly, the ejection amount variation attributable to the ambient temperature change can be avoided. When the pre-heat pulse width modulation operation is effected as shown in FIG. 17A, the tone density reproducibility (gamma-curve) is constant despite the temperature variation due to the ambience or the printing duty. Therefore, the balance of colors provided by the cyan, magenta, yellow and black colors is stabilized, and therefore, full color images can be produced with a constant color reproducibility maintained.

Figure 17B:
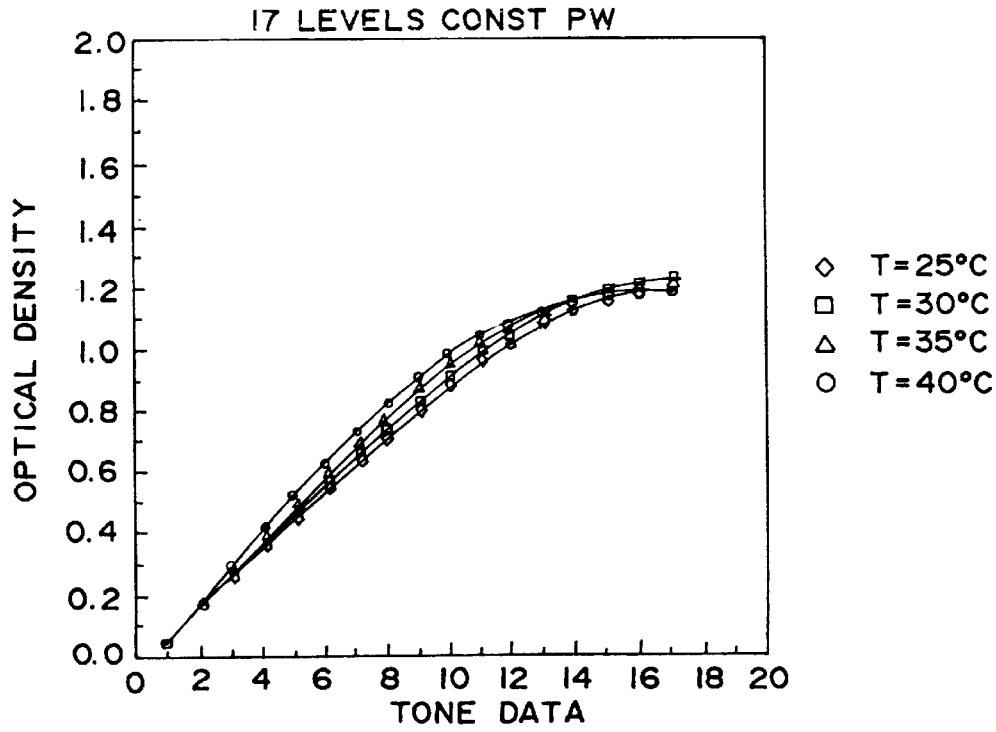

FIG. 17B represent the case of no pre-heat pulse width modulation. As will be apparent from this Figure, the reproducibility varies depending on the temperature.

In FIG. 17, the density data 0–255 corresponds to 17 tone data 1–16.

In this embodiment, the range in which the ejection amount control by the pulse width modulation is possible is made to correspond to the temperature range which is frequently used in the actual printing operation, and in the low temperature region, the temperature is controlled by the heater, and in addition, in the high temperature region, a single pulse is used to reduce the temperature rise. By doing so, the ejection amount can be stabilized, and the image quality is stabilized, in a wide usable ambient condition range.

Description will be made as to a monochromatic serial printer (black color only) of a permanent type recording head, incorporating the PWM control described hereinbefore.

The recording head has a performance of 360 dpi of the resolution power, 3 kHz of a driving frequency and is provided with 64 ejection outlets. In this case, only one temperature sensor is used, and the ejection amount control method does not include the temperature control for simplification. As for the pulse width modulation sequential operation, an average temperature in one scan is detected, and the pulse width P1 is changed for each scanning line.

Since the printer is a black monochromatic printer, the production of the joint stripe between lines or the image density difference between lines can be suppressed despite the simplification, and therefore, the simplified control is still effective.

The description will be made as to a permanent type full-line multi-nozzle recording head to meet a high speed printing. This is also a monochromatic printer incorporating the PWM control.

The recording head has a performance of 200 dpi of the resolution power, 2 KHZ of the driving frequency and is provided with 1600 ejection outlets. The ejection outlets are grouped into 100 blocks each including 16 ejection outlets. The temperature sensor is provided for each of the blocks in accordance with the driving system. The temperature obtained by the temperature sensor for each of the blocks is used for controlling the associated block for the pulse width modulation, independently of the other blocks. By doing so, even if the temperature distribution becomes non-uniform in the recording head because of the existence of ejecting outlets and non-ejecting outlets peculiar to the full-line recording head, the ejection amount control is possible for each of the blocks independently of the other blocks, and therefore, high quality and high speed printing is possible without non-uniformity of the image density.

The description will be made as to the effects of reducing the self temperature rise of the recording head due to the printing operation, by the PWM control of this embodiment.

Figure 18:
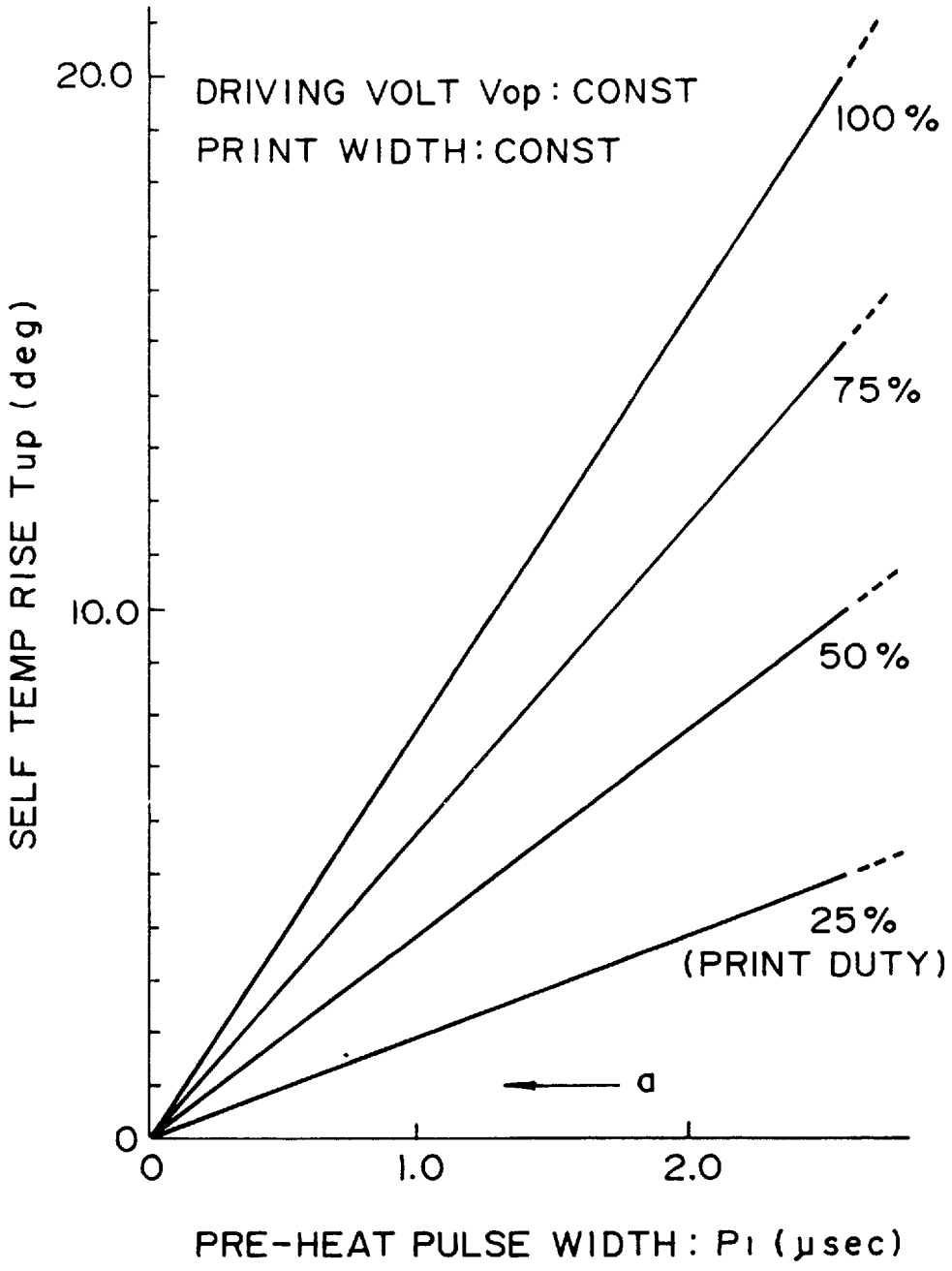
FIGS. 18 and 19 are a graph showing a relation between a pre-heat pulse width and the self temperature rise of the recording head with the parameter of printing duty in an apparatus according to an embodiment of the present invention, and a graph showing a relation between the printing period and the self temperature rise therein.

FIG. 18 shows a relation between a pre-heat pulse width P1 and the self temperature rise TUP of the recording head due to the printing operation. The printing duty is changed from 25% to 100% with 25% increment. The value of the self temperature rise TUP is the one after one line printing. It will be understood that the self temperature rise TUP due to the printing operation of the recording head increases with increase of the pre-heat pulse P1 width and with increase of the printing duty (ejection nozzle number or number of the ejections per unit time). In view of this, it will be understood that when the printing duty is high, the pre-heat pulse P1 width is positively made shorter to suppress the self temperature rise. In view of the fact that the head temperature increases with increase of the printing duty and with the increase of printing time, the embodiment of the invention detects the temperature of the recording head adjacent the ejection heater of the recording head, and in accordance with the detected temperature, the pre-heat pulse P1 is controlled. By using the PWM control in this manner, the self temperature rise can be efficiently suppressed.

Figure 19:
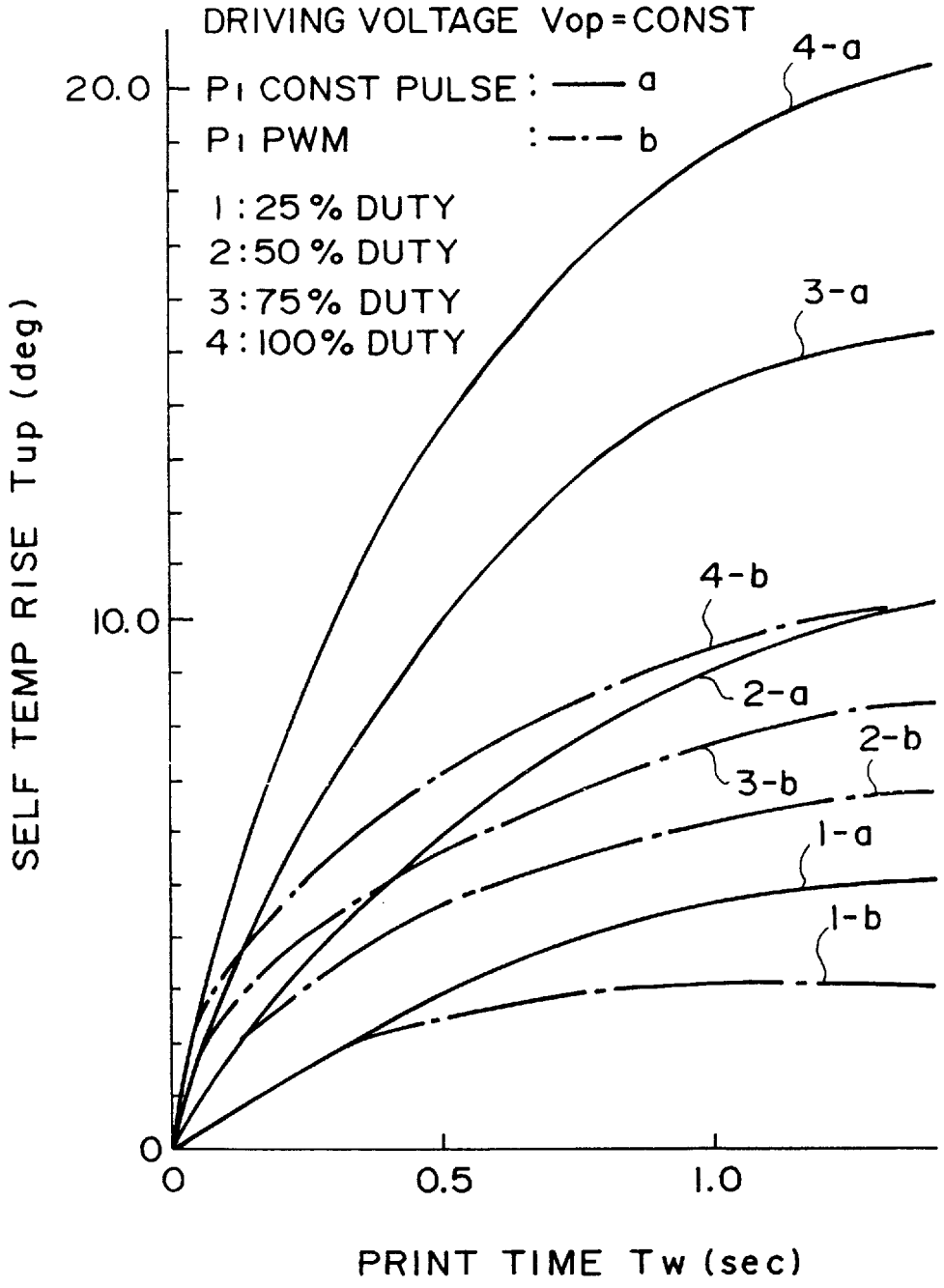

FIG. 19 shows the head temperature change corresponding to the printing period with various printing duties, more particularly, 25% (1), 50% (2), 75% (3) and 100% (4). In FIG. 19, a represents the case of fixed pulse width mode; b indicates the case in which the pre-heat pulse width P1 is changed to be the proper width corresponding to the head temperature by the PWM control. It will be understood from the Figure that the PWM control is effective to efficiently lower the self temperature rise of the recording head, particularly during the high duty printing and under high temperature situation.

More particularly, when the printing operation is performed with the duties shown in FIG. 18, the pre-heat pulse width P1 is decreased in the direction a in FIG. 8 by the PWM control in accordance with the self temperature rise due to the printing operation, by which the thermal energy applied per unit type is decreased so that the self temperature rise due to the printing can be lowered.

The description will be made as to a color printer using a permanent recording head, particularly with respect to the self temperature rise control.

In this embodiment, the pulse table is not divided by constant temperature ranges as in FIG. 10 of the first embodiment, but the pulse switching occurs more quickly with the increase of the temperature of the recording head. When the temperature of the recording head is relatively low, the unit temperature step width $\pm\Delta T$, that is, the temperature width of the pre-heat table of FIG. 7 is relatively large, and with the increase of the recording head temperature, the width step $\pm\Delta T$ is decreased. By doing so, the self temperature rise due to the printing under the high temperature condition can be further efficiently reduced.

This control is effected in the range of recording head temperature TH of 26.0° C.–44.0° C. in the PWM region of FIG. 8, wherein the self temperature rise due to the printing and the ambient temperature change is detected as the recording head temperature, and on the basis of the detected temperature, the pre-heat pulse width P1 is changed in accordance with the table of FIG. 20 with the temperature width step or increment of $\pm\Delta T$=4° C.–1° C.

The sequential operations are the same as shown in FIG. 11.

Because of the characteristics of the recording head, a problem hardly arises under the low temperature situation (from room temperature to 40° C. approximately), the recording head becomes sensitive to the temperature under high temperature conditions, because of the thermal problems such as instability in the bubble creation and the reduction of the refilling frequency, peculiar to a heating type ink jet recording apparatus. Therefore, the operation in the high temperature range should be avoided as much as possible. In view of this, the control is effected so as to avoid the high temperature side.

Figure 21:
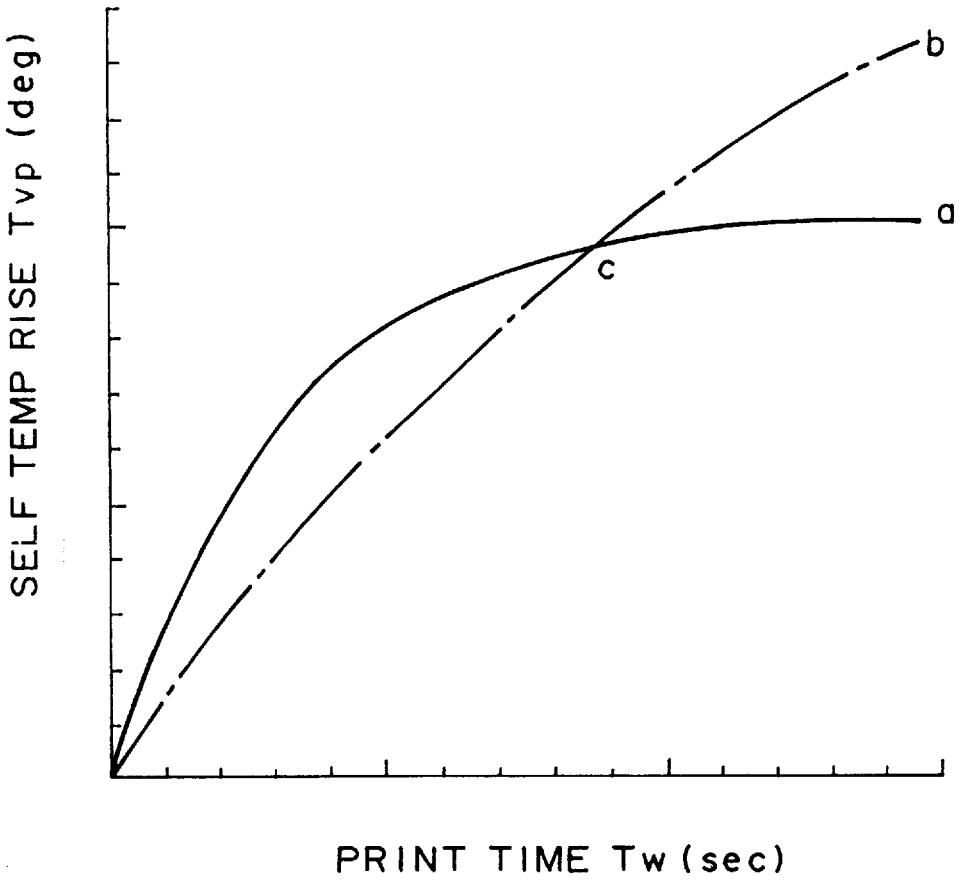

Using the control table of FIG. 20, the pre-heat pulse width P1 is switched more quickly with the increase of the head temperature, and therefore, the self temperature rise due to the printing can be suppressed more at the high temperature side. This is shown in FIG. 21. In this Figure, curve a is a self temperature rise curve when the present invention is used, and curve b is a self temperature rise curve when the temperature width for switching the pre-heat pulse width P1 is constant.

As will be understood from this Figure, the self temperature rise due to the printing operation is high when the head temperature is relatively low (lower than 40° C.), but the tendency is reversed beyond a cross-point C, and under the further high temperature of the recording head (not lower than 40° C.), the quick switching of the heat pulse width P1 is effective to suppress the self temperature rise.

In this embodiment, the temperature width is changed as shown in FIG. 10, but the degree of the change may be selected in accordance with the operating conditions.

The description will be made as to a monochromatic printer incorporating the self temperature rise suppressing control.

The printer of this embodiment is usable with a replaceable type recording head. In such a case it is desirable that the ejection amount control (control temperature width and/or control pulse width) is set to the proper ejection amount control condition each time the recording head is replaced. In this embodiment, the printer is a monochromatic one, and therefore, relatively rough ejection amount control is permissible. Therefore, the reduction ratio of the pre-heat pulse width P1 is decreased with the increase of the temperature to suppress the self temperature rise of the recording head.

As will be understood from the control table shown in FIG. 22, the change of the pre-heat pulse width P1 by the pulse switching is increased with the increase of the recording head temperature, and therefore, the self temperature due to the printing can be further suppressed. This is similar to the tendency shown in FIG. 21.

As will be understood from the foregoing, according to the present invention, when a heat generating element of the recording head is actuated by plural pulses, too, for example, the first pulse is changed in the pulse energy by, for example, pulse width modulation in accordance with the recording head temperature, by which the ejection amount of the ink can be controlled, and the temperature rise of the recording head can be suppressed.

As a result, the energy supplied to the heat generating element is minimized to reduce the self temperature rise of the recording head due to the printing operation, and the ink ejection amount can be controlled. Accordingly, the image density change can be avoided, and the color balance can be stabilized.

The embodiment of the present invention is effective to remove or suppress the ink ejection property variation during the printing operation due to the ejection amount variation and ink temperature variation attributable to the self temperature rise of the recording head, ejecting direction variation, ejection failure, refilling frequency reduction or the like due to the control property change resulting from the recording head structure change attributable to the self temperature rise of the recording head.

As a secondary advantageous effect, the service life of the recording head can be remarkably increased, because the temperature of the recording head is lowered.

The description will be made as to the recording head temperature detecting means. It may be in the form of a direct detection of the temperature of the recording head. It may be a contact or non-contact type. Preferably it is integrally formed with the base having the heat generating elements of the recording head. As for indirect temperature detecting means there is a prediction of the temperature relating to the recording head driving on the basis of the temperature or the like of the control device (CPU, capacitor or the like). The prediction type sensor is advantageous in that the variation in the temperature detection is reduced, and the same temperature sensor is used by the main assembly of the printer, and therefore, the control is stabilized.

As for the waveform selection (change or modification) for the driving signal, the following is usable. As for the fundamental waveform, there is the one shown in FIG. 9. The waveform may be selected, modified or changed by changing the leading part P1 in its pulse width (application period) in accordance with the temperature, by changing the rest period P2 in accordance with the temperature, by changing the ratio of the leading portion P1 and the rest period portion P2 in ia period of a predetermined riving signal, or the like.

In the embodiments of the present invention, it is preferable to use a constant main drive pulse P3, and the leading pulse P1 is changed between 0 and predetermined period. However, the present invention covers the change of the main drive pulse P3.

In the foregoing descriptions, the voltage in the rest period P2 is zero, which is preferable. However, in the rest period P2, a predetermined voltage which is lower than the voltage in the period of P1 and P3 may be supplied. The pulses P1 and P3 may be in the form of sine wave to supply the voltage by switching the waveforms.

As for the electric circuit, a combination of a leading pulse generator and a main drive pulse generator. In an alternative circuit, a part of an output of a constant pulse generator is selected to supply the selected one to the heat generating element or the electrothermal transducer. In another alternative, supply timings of the leading pulse P1 and the main drive pulse P3 may be selected or designated, and the selected or designated one is supplied to the electrothermal transducers. Other alternatives may be used property by one skilled in the art.

The driving signal means the entirety of the signal for causing bubble creation in the electrothermal transducer on demand. When the driving signal comprises plural pulse components, the leading pulse is called "main pulse". The leading pulse may contain plural pulses. In the case of the plural leading pulses, the driving signal may be called plural driving signals. When plural leading pulses are used, the rest period is the interval between the last leading pulse and the main pulse.

Embodiment 2

In this embodiment, the variations, in the amount of ink ejection, of individual recording heads, resulting from the manufacturing process of the recording head, is corrected.

Figure 23:
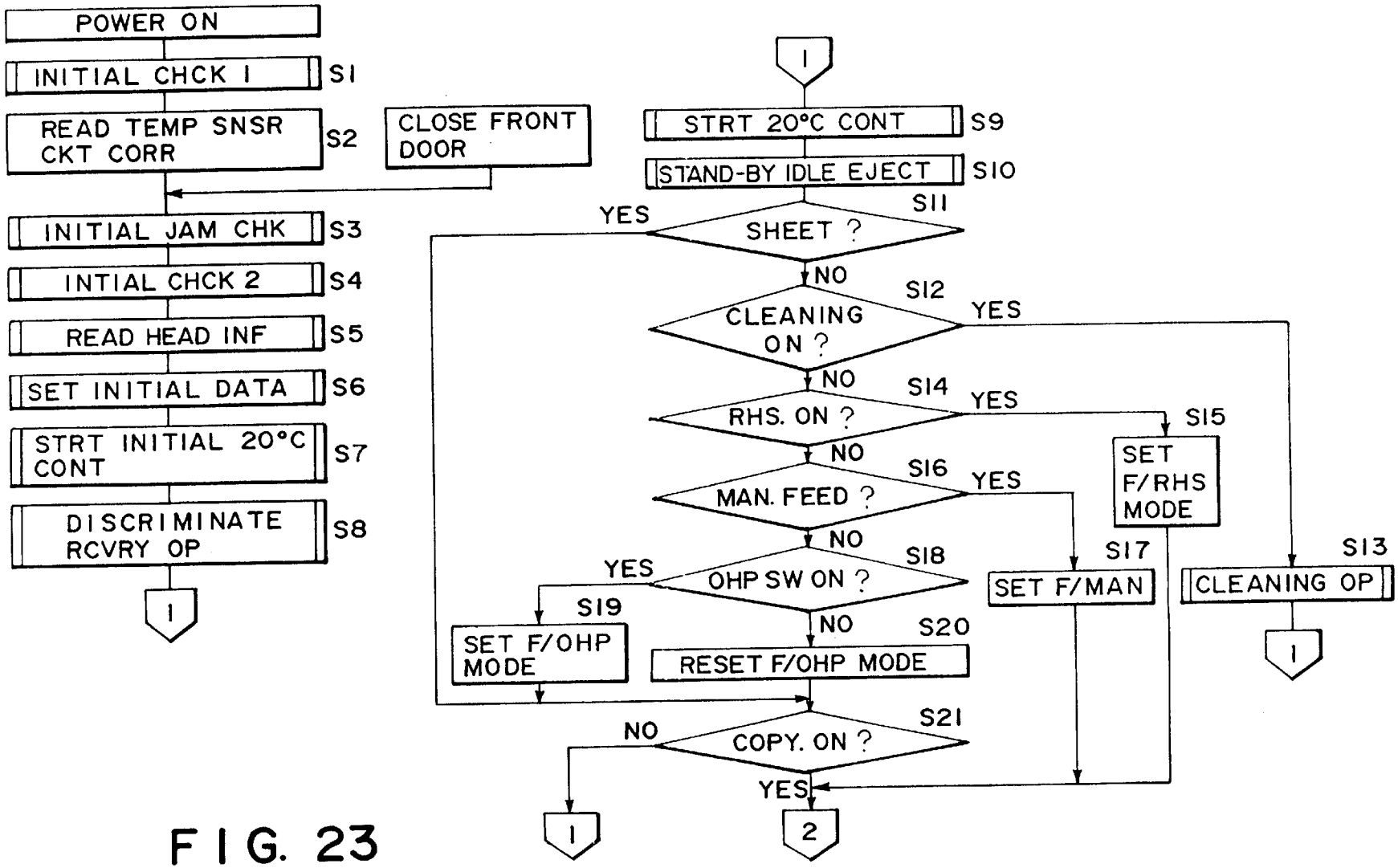
FIGS. 23, 24 and 25 are flow charts of main control operation of the ink jet recording apparatus according to an embodiment of the present invention.
Figure 24:
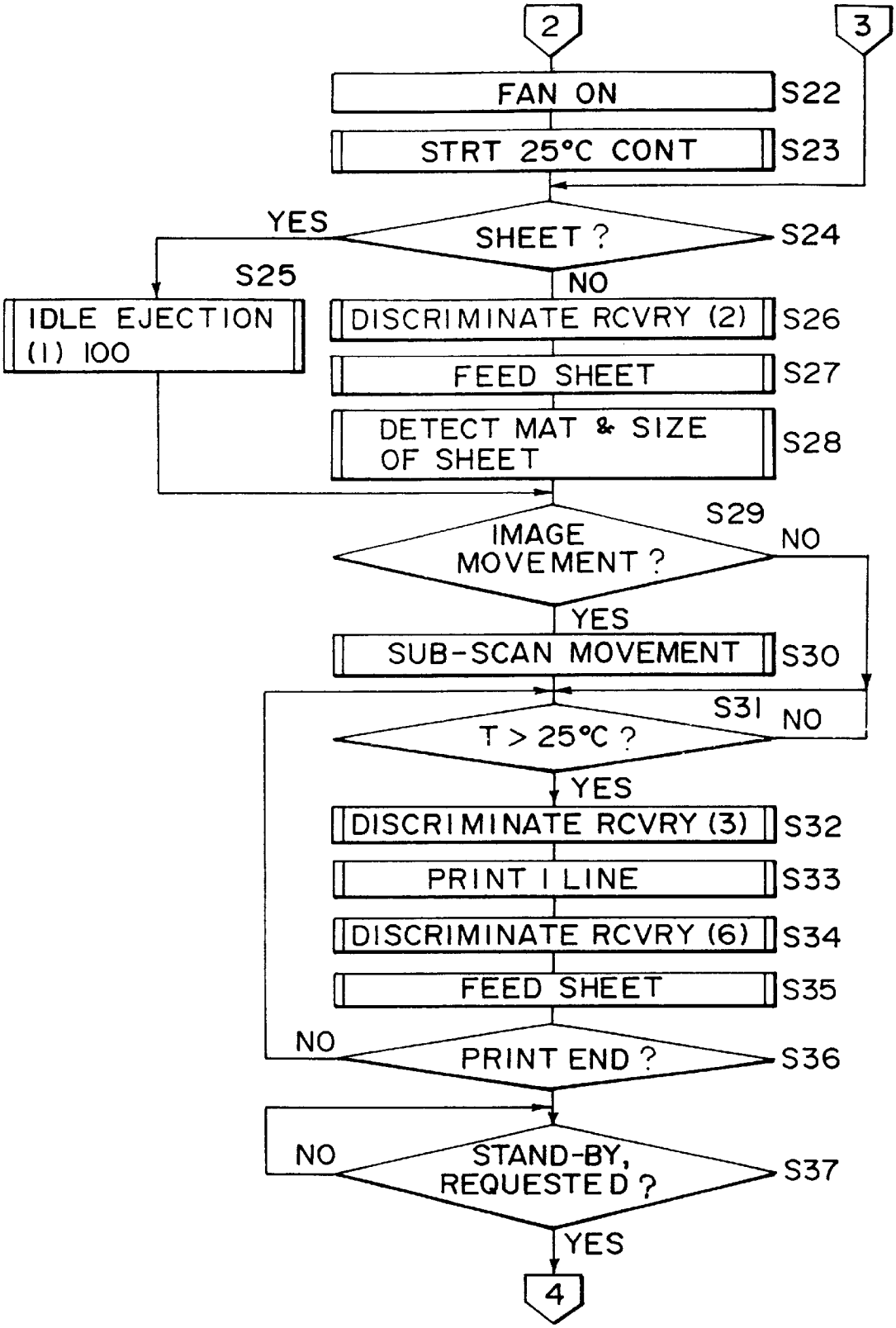
Figure 25:
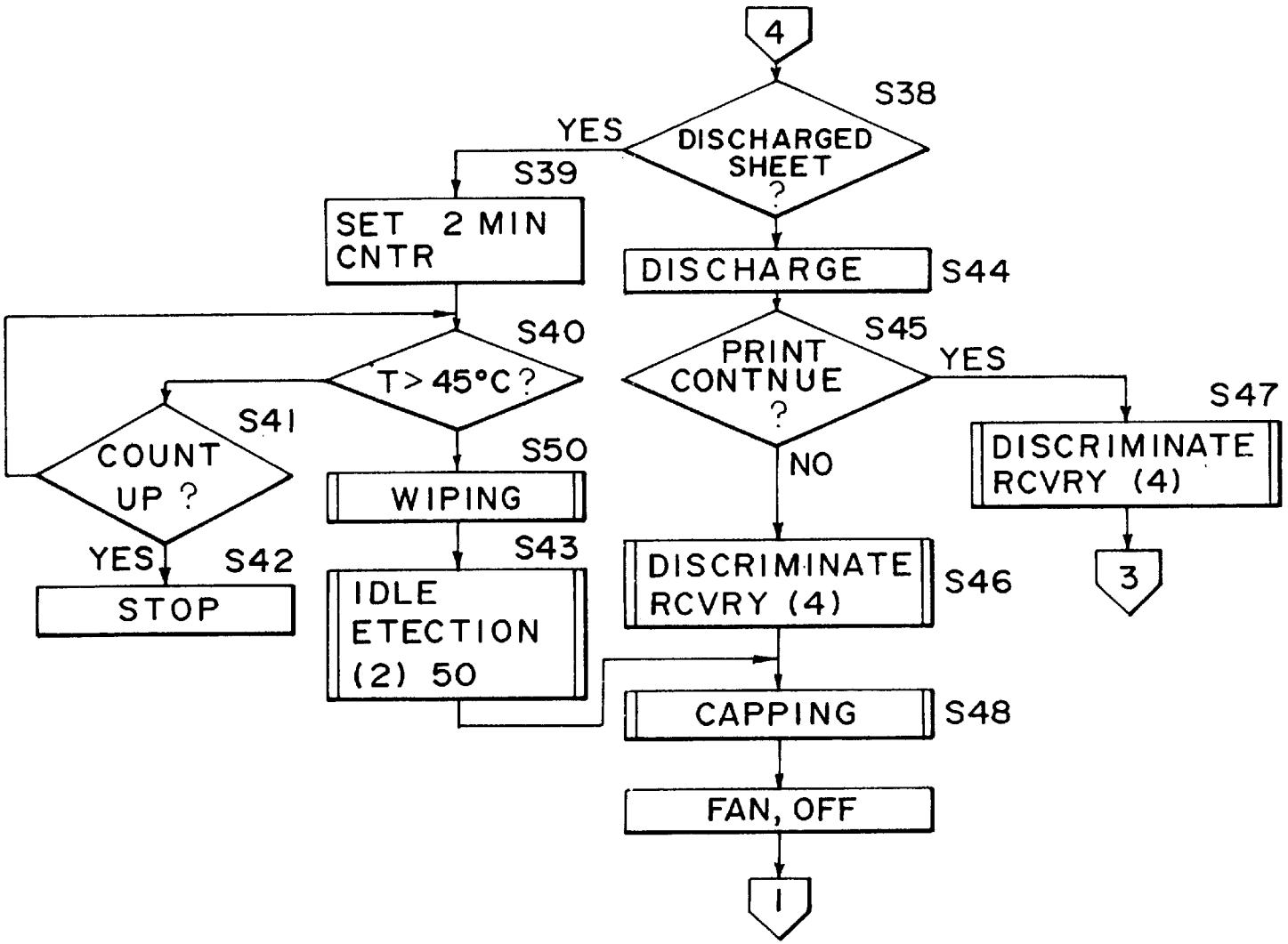

FIGS. 23, 24 and 25 are flow charts of main control of the ink jet recording apparatus according to an embodiment of the present invention. The description will first be made with respect to the main control, referring to the flow charts. When the main switch is actuated, the apparatus performs initial checking operations at step S1. In the initial checking operation, ROM and the RAM are checked so as to confirm that the program and the data are proper for the correct operations. At step S2, the correcting value of the temperature sensor circuit is read in. Then, at step S3, initial jam checking operation is performed. In this embodiment, even if the front door is closed, the initial jam checking operation is carried out at step S3. At step S4, the apparatus is checked in the items required for reading the information of the recording head at the next step. At step S5, the data is read from a ROM built in the recording head. At step S6, the initial data are set in.

At step S7, initial 20° C. temperature control is started, and at step S8, the necessity for the recovery operation is discriminated [1] (the discrimination whether the sucking recovery operation is necessary or not) when the main switch is actuated.

Figure 26A:
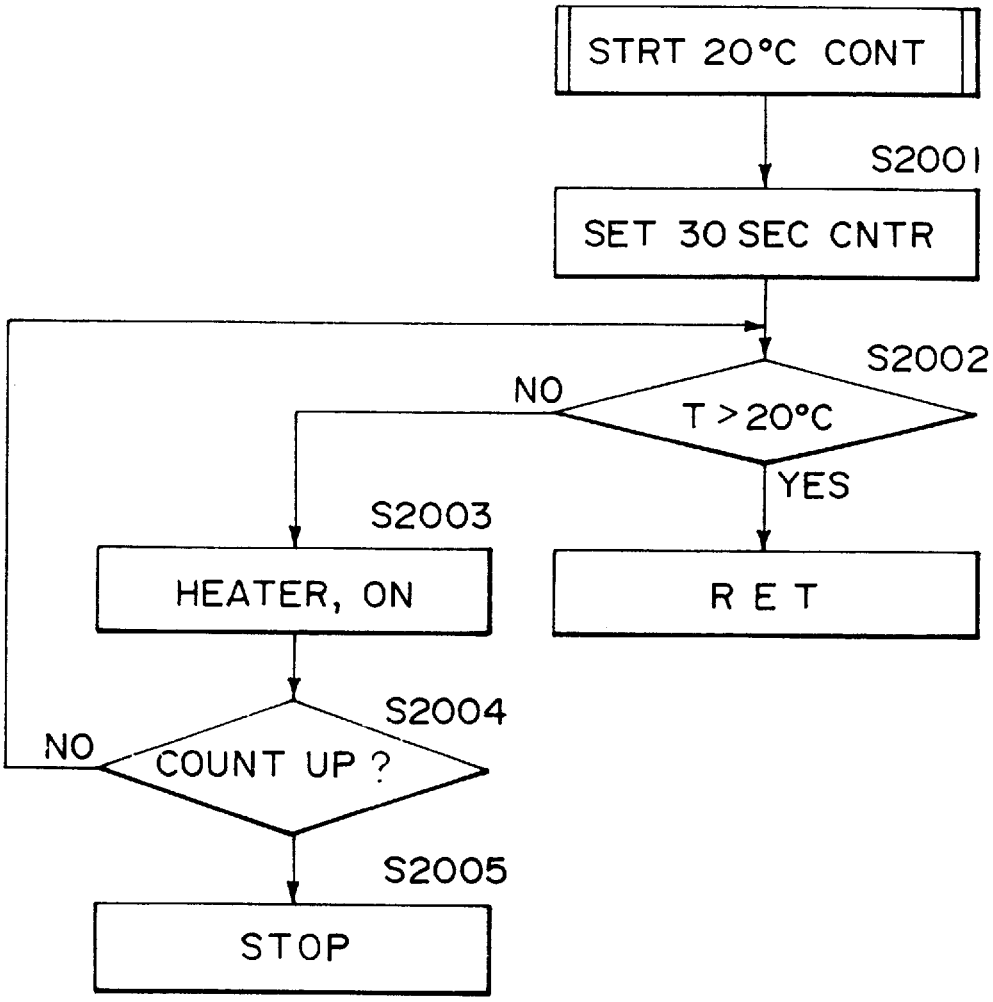
FIGS. 26A, 26B and 26C are flow charts of operations for an initial 20 degrees temperature control, a 20 degrees temperature control and a 25 degrees temperature control.

FIG. 26 shows the initial 20° C. temperature control routine. In this flow chart, at step S2001, 30 sec is set in a timer counter, and thereafter, if the temperature is higher than 20° C., the operation of this routine is completed at step S2002. If the temperature is lower than 20° C., the heater of the recording head is energized at step S2003. At step S2004, the discrimination is made as to whether the timer period of 30 sec has elapsed. If so, emergency stop is effected at step S2005. If not, the operation returns to step S2002.

The foregoing is the description of the sequential operation up to the record waiting state.

Sequential operation during the stand-by state will be described. At step S9, the 20° C. temperature control is carried out. At step S10, the stand-by idle ejection operation is carried out. At step S11, the presence of the sheet is checked. If there is no sheet, the operation proceeds to step S21, where the discrimination is made as to whether or not the cleaning button is depressed. If so, at step S13, the cleaning operation is carried out. At step S14, if RHS button is depressed, the RHS mode flag is set at step S15. Here, "RHS" means recording head shading process for correcting the density non-uniformity. The density non-uniformity of the printed pattern is read by the reader, and the non-uniformity is corrected.

If the sheet is manually supplied at step S16, a manual feed flag is set at step S17, and the operation proceeds to step S22 (copy start sequence). If an OHP button is actuated at step S18, an OHP mode flat is set at step S19. If not, the OHP mode flag is reset at step S20. If the copy button is depressed at step S21, the operation proceeds to a copy start sequence (step S22). If not depressed, the operation returns to step S9. If the completion of the cleaning operation is discriminated at step S13, the operation returns to step S9, too.

The description will be made as to the copy sequential operations. At step S22, a fan is driven to suppress the inside temperature rise. At step S23, the 25° C. temperature control is started. At step S24, the discrimination is made as to whether or not the sheet is fed. If not, the idle ejection operation [1] (N=100) is carried out at step S25. Then, the operation proceeds to step S29. Here, N is the number of idle ejections. At step S26, the necessity for the recovery operation [2] (the discrimination whether the sucking recovery operation is to be carried out before the sheet feed) is discriminated. Then, the sheet is fed at step S27. At step S28, the width and material of the sheet is detected. At step S29, the discrimination is made as to whether or not the image movement is carried out. If so, the sub-scan movement (paper movement) is effected at step S30. If the image movement is not required, the operation proceeds to S31, where the investigation is made whether or not the head temperature is not lower than 25° C. If so, the necessity for the recovery operation [3] (the recovery operation is effected on the basis of the evaporation amount of the ink in the non-capping period) is discriminated, and at step S33, the recording operation for one line is carried out. Thereafter, at step S34, the necessity for the recovery operation [6] (the discrimination whether the recovery operation is carried out on the basis of the wiping timing) is discriminated, and the sheet is fed at step S35.

At step S36, the discrimination is made as to whether the recording operation is completed or not. If so, the data indicating the number of prints or the like are written in the ROM, and the operation proceeds to step S37. If not, the operation returns to step S31. At step S37, the discrimination is made as to whether or not the apparatus should be transferred to its stand-by state or not. If so, the operation proceeds to step S38.

The operations after the step S38 are for a routine for carrying out a sheet discharge operation, the discrimination for the necessity of the recovery operation after one sheet printing operation [4] (removal of bubbles after the printing, removal of bubbles after the printing, removal of bubbles in the chamber, cooling in the case of impermissible high temperature, recovery). At step S38, the investigation is made as to the necessity for the sheet discharging action. If not, the temperature decrease down to 45° C. or lower at step S39, S40 and S41. If the temperature does not decrease enough in 2 minutes, the emergency stop is carried out at step S42. When the temperature lowers to 45 degrees or lower, a wiping operation is carried out at step S50, and at step S43, idle ejecting operations (N=50) are performed. At step S48, the ejection outlets are capped. If the sheet discharging operation is necessary, the sheet is discharged at step S44. At step S45, the discrimination is made as to whether or not the continuous printing is instructed. If so, the necessity for the recovery operation [4] is discriminated at step S47, and the operation returns to step S24. If not, the recovery operation discrimination [4] is carried out at step S46. After the discrimination, the ejection outlets are capped at step S48, similarly to the case of non-necessity for the sheet discharge. At step S49, the fan is stopped. Then, the operation returns to step S9, and the copy operation is completed.

Figure 26B:
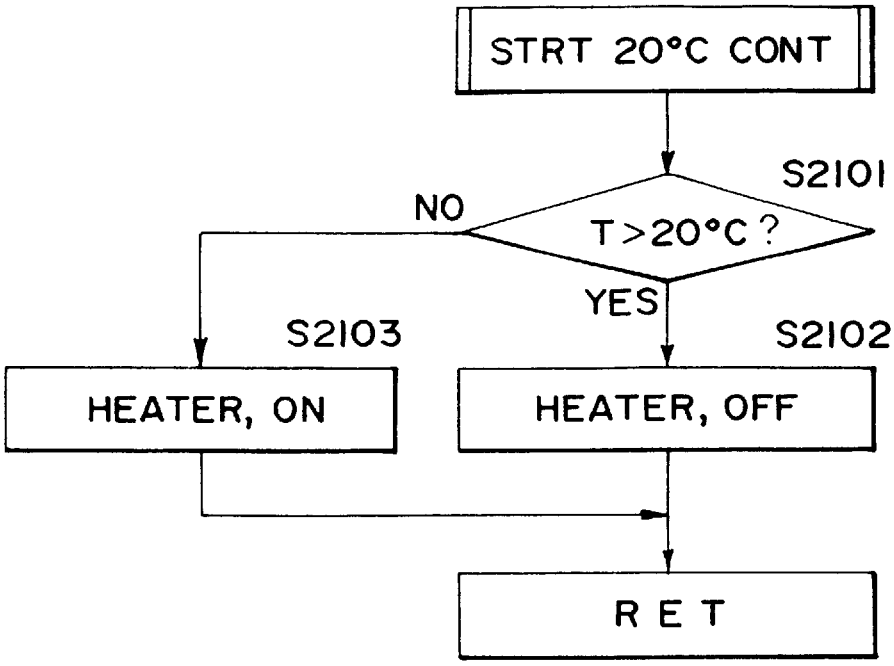
Figure 26C:
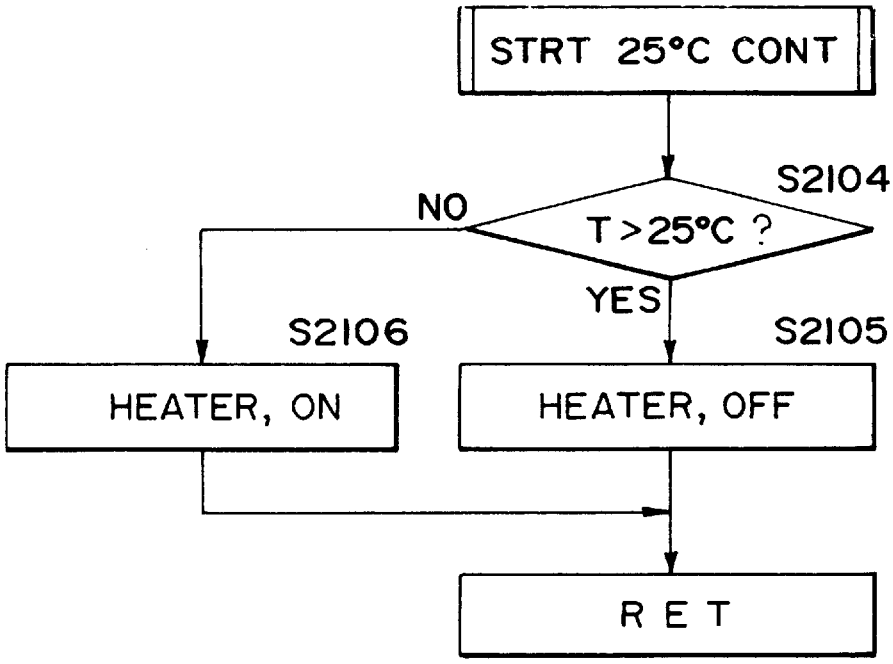

FIGS. 26B and 26C are flow charts of sequential operations for 20° C. and 25° C. temperature control. At step S2101, the discrimination is made as to whether or not the head temperature is higher or lower than 20° C. If it is higher, the head heater is deactuated at step S2102, and if it is lower than 20° C., the heater is actuated at step S2103, and the 20° C. temperature control routine ends. The operations in the 25° C. temperature control routine including steps S2104–S2106 are the same as the 20° C. temperature control routine including steps S2101–S2103. Therefore, the detailed description is omitted.

Figure 27:
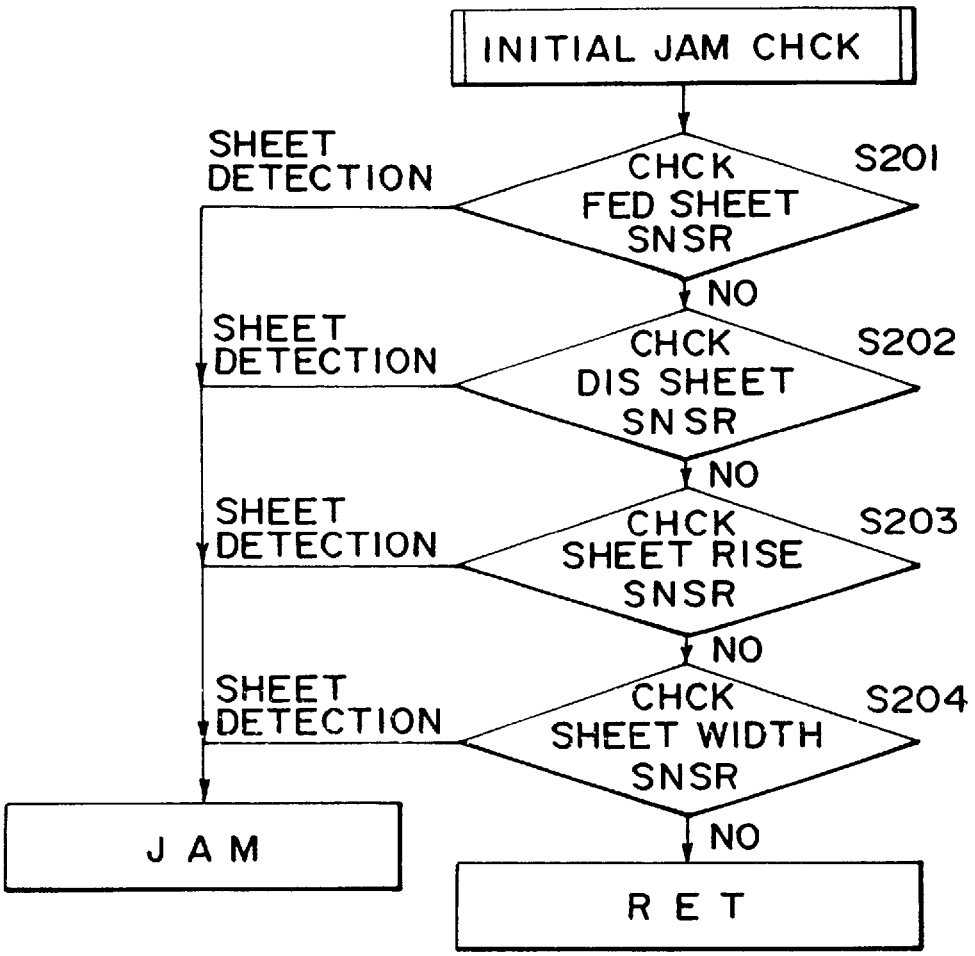
FIG. 27 is a flow chart of operations in an initial jam check routine at step S4.

FIG. 27 is a detailed flow chart of the initial jam check routine at the above-described step S3. This routine is executed immediately after the main switch is actuated to check jamming. At steps S201–S204, the investigation is made as to whether the recording sheet or the like is present in the feeing passage or adjacent the carriage by the feed sheet sensor, discharge sheet sensor, sheet rise detection sensor and a sheet width sensor, respectively. If so, the jamming is detected to produce a warning signal. If not, the operation returns to the main flow.

Figure 28:
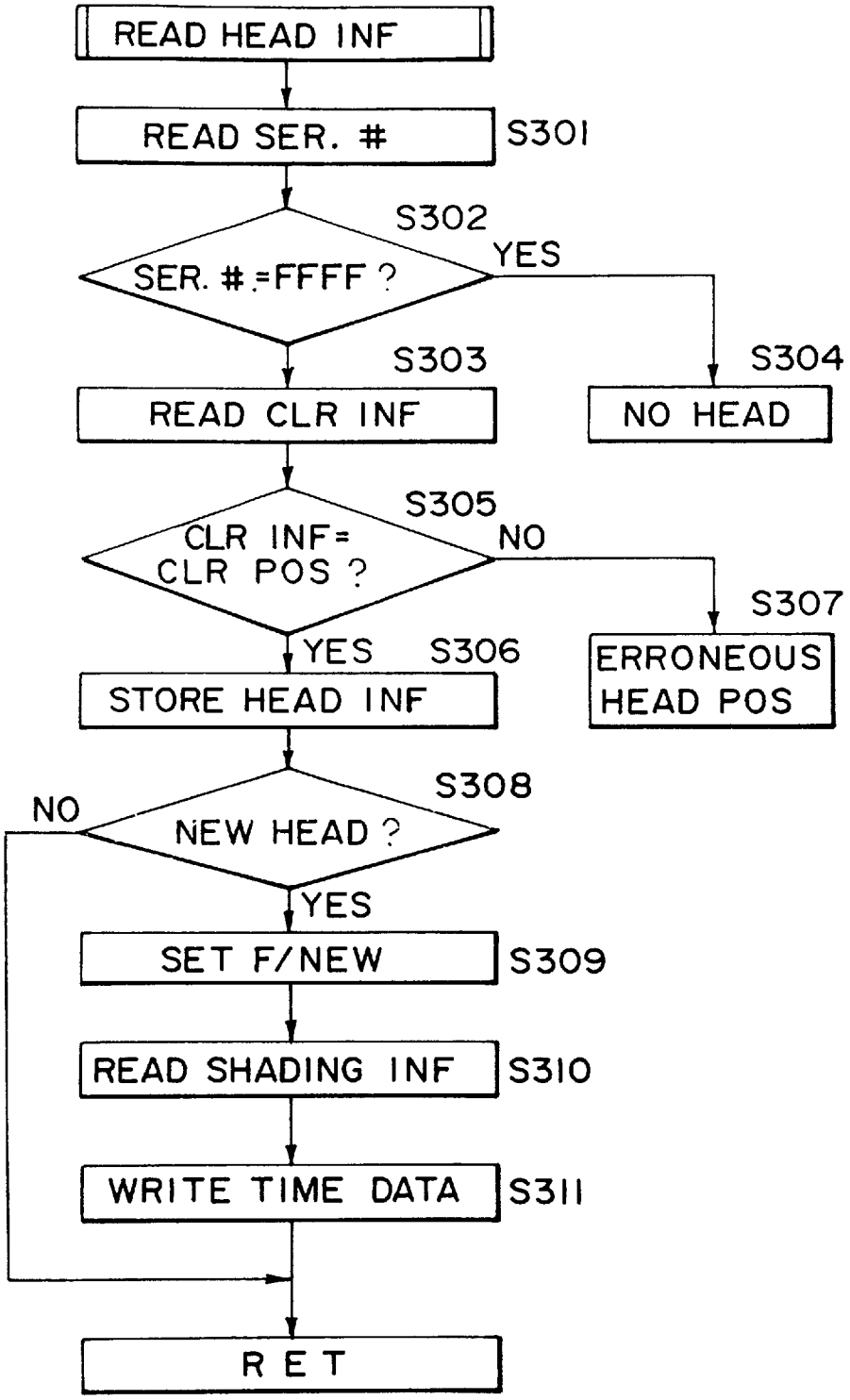
FIG. 28 is a flow chart showing details of recording head information reading routine at step S5.

FIG. 28 is a detailed flow chart of recording head information reading routine at the above described step S5. At step S301, a serial number peculiar to the recording head is read at step S301, and the discrimination is made as to whether the read serial number is FFFFH at step S302. If the serial number is FFFFH, absence of the head is discriminated at step S304 (error). If the serial number is not FFFFH, the color information of the recording head is read at step S303. At step S305, the discrimination is made as to whether the recording head is set in the right position predetermined for each of the colors, on the basis of the color information read out. If the recording head is mounted at the right position, the operation proceeds to step S306. If it is mounted at a wrong position, the operation proceeds to step S307.

At step S306, the rest of the head information such as printing pulse width, temperature sensor correction, number of prints, number of wiping operations or the like, and the data are stored. At step S308, the discrimination is made as to whether the mounted head is new one or not on the basis of the serial number of the recording head. The serial number of the recording head is always stored in a back-up RAM, and therefore, can be compared with the new data. If the serial numbers are different, new recording head is discriminated, and if they are the same, it is discriminated that the recording head is not replaced. In this embodiment, the above discriminations are made for each of black, cyan, magenta and yellow colors. If the recording head is not new, the recording head information reading routine ends. If it is a new head, the recording head information such as serial number, color information, printing pulse width, PWM pointer number, temperature sensor correcting term, print number, wiping operation number or the like are stored in the memory of the apparatus, at step S309. In addition, a flag indicating that a new recording head is mounted (or data) is stored in the memory. At step S310, HS data (shading information) of the recording head are read, and at step S311, the time at which the new head starts to be used is written in a non-volatile memory, using a clock in the apparatus, and the recording head information reading routine ends.

The description will be made as to the using method of the ROM which is a recording head information storing means.

In the apparatus in which the present invention is used with a replaceable recording head (cartridge type). Therefore, it includes the advantage that the user can exchange the recording head at any time. Since the recording heads are mass-produced, the individual heads have different properties because of unavoidable manufacturing tolerance or variation. Therefore, in order to stably provide high image quality, it is desired that the variations are corrected.

As for a method of correcting the variation in the driving conditions, the driving conditions stored in the individual ROM are read in, and the correction is made on the basis of them, or the ejection amount variation in one head due to the distribution of the ejection outlet sizes of the recording head and the resultant density non-uniformity can be controlled. This is called head shading (HS).

If such a correction is not made for individual recording heads, particularly the ejection speed, ejection direction (accuracy of shot), amount of ejection (image density), ejection stability (refilling frequency, non-uniformity, wetting) are not completely assured. This makes it difficult to provide stabilized high quality images, and results ejection failure during printing or remarkable image disturbance due to the deviation of the dot position.

Particularly in the case of full-color images, the image is formed by four heads, i.e., cyan recording head, magenta recording head, yellow recording head and black recording head, and therefore, if one recording head has different ejection amount or control property from the other recording heads, the image quality is highly deteriorated. Among them, the variation in the ejection amount results in disturbance to the entire color balance, and therefore, the coloring and the color reproducibility are deteriorated (increase in the color difference), and therefore, degrading of the image quality. In the case of a monochromatic image as in black, red, blue or green or the like, the image density varies. The variation in the control property changes the reproducibility of the half tone image. In consideration of the above, the ejection properties are corrected in this embodiment.

In this embodiment, the head drive is accomplished by the divided pulse width modulation driving method as described in the first embodiment. The structure of the recording head is the same as in the recording head used in the first embodiment. The recording head of this embodiment is provided with a ROM (EEPROM) storing the properties of the individual head. The information is read by the main assembly of the printer, by which the variations in the individual recording heads are compensated.

The description will now be made as to the method for correcting the variations of the ejection properties of the individual heads to provide high quality and precision images. As described in the foregoing, when the main switch of the main assembly already carrying the recording head is actuated, the information (ROM information) stored in the ROM during the manufacturing of the recording head is read by the main assembly of the printer. More particularly, the information is read in, such as recording head ID number, color information, TA1 (driving condition table pointer of the recording head corresponding to the printing pulse width), TA3 (PWM table pointer), temperature sensor correcting level, number of prints, number of wiping operations or the like. In accordance with the table pointer TA1 read, the main assembly determines the width P3 of the main heat pulse in the divided pulse width modulation drive control which will be described hereinafter. The detailed description will be made in the following paragraphs.

(1) Determination of TA1:

During the recording head manufacturing, the ejection properties of each of the recording heads is measured under the normal driving conditions, i.e., the head temperature TH of 25° C., the driving voltage Vop of 18.0 V, pulse width P1 of 1.87 micro-sec and the pulse width P3 of 4.114 micro-sec. Then, the optimum driving conditions are determined for each of the recording heads, and the driving conditions are written in the ROM of the recording head.

(2) Driving condition setting:

The main assembly permits setting in the main assembly the pre-heat pulse width P1, interval timing width P2 and the main heat pulse width P3 in the divided pulse width driving, the rising time for the pre-heat pulse is set T1, T2 and T3 as shown in FIG. 1, and T3 is fixed in the main assembly at 8.602 micro-sec in this embodiment. Depending on the pulse width T2 and TA1 (4.488 micro-sec, for example) determined on the basis of the pointer read from the recording head, the pulse width P3 determined as P3=T3−T2=4.114 micro-sec, for example.

FIG. 29 shows a relation between a table pointer TA1 and a main heat pulse width P3 determined on the basis of the pointer TA1.

Correction by PWM:

The description will be made as to the method for utilizing the PWM control method to correct the variation in the ejection amounts of the individual recording heads so as to effect the proper image formation. The PWM control condition is read as a part of the recording head ROM information together with the ID number, color, driving condition and HS data, by the main assembly when the main switch of the main assembly is actuated.

In this embodiment, a table pointer TA3 as the control condition for the PWM control. As will be described hereinafter, the number TA3 is expressed as a number corresponding to the ejection amount (VDM) of the recording head. In accordance with the read TA3, the main assembly determines the upper limit of the heat pulse width in the PWM control. The description will be made as to the PWM correction.

(1) Determination of the table pointer TA3:

During the head manufacturing, the ejection amount of each of the recording heads is detected under the normal driving conditions, i.e., the recording head temperature TH of 25.0° C., the driving voltage Vop of 18.0 V, the pulse width P1 of 1.87 micro-sec and the pulse width P3 of 4.114 micro-sec. The measured amount is VDM. Then, the difference from the reference ejection amount VD0=30.0 (ng/dot) is determined (ΔV=VD0−VDM). On the basis of ΔV, the relation between the ΔV and the table pointer TA3 is determined as shown in FIG. 30. As will be understood, depending on the ejection amount, the rank of the recording head is determined, and the datum TA3 is stored in the ROM for each of the recording heads.

When the table is produced using ΔV, it is desired to be equal to ΔVp which is the change, in one table, of the pre-heat pulse width P1 controllable by the divided pulse width modulation driving method which will be described, because the ejection amount is corrected by changing the pre-heat pulse width P1.

(2) Reading of the table pointer:

As described in paragraph (1), the recording head bearing the information in the ROM is mounted on the main assembly of the ink jet recording apparatus. upon actuation of the main switch, the information stored in the recording head ROM is stored in SRAM of ,the main assembly in accordance with the sequential operations shown in FIG. 22.

(3) Determination of the PWM control table:

1. In the case of the high ejection amount recording head (for example, VDM=31.2 (ng/dot)), the pulse width P1 of the pre-heat pulse at the ambient temperature (head temperature) of 25.0° C. is made shorter than the standard driving condition (P1=1.867micro-sec) (for example, P1=1.496 micro-sec) to reduce the ejection amount to make the ejection amount closer to the standard ejection amount VD0=30.0 (ng/dot).

2. In the case of the small ejection amount recording head (for example, VDM=28.8 (ng/dot)), the pulse width P1 of the pre-heat pulse at the ambient temperature (recording head temperature) of 25.0° C. is made longer than the standard driving condition (P1=1.867 micro-sec) (for example, P1=2.244 micro-sec) to increase the ejection amount to make it closer to the standard ejection amount VD0.

3. As shown in FIG. 30, in the above described operation, the relation is determined between the table printer TA3 and the pre-heat pulse width P1 in accordance with the ejection amount of each of the recording heads so that the standard ejection amount VD0 can be always provided.

4. In this manner, the main assembly can have 16 PWM tables for the standard ejection amount VD0 (30.0 ng/dot). Therefore, the ejection amount increment by one pointer shown in FIG. 21 is 0.6 (ng/dot), the total correctable ejection amount range is theoretically ±4.8 (ng/dot). Actually, however, in order to effectively use the above-described ejection amount control method, the variation correcting amount of the ejection amount is preferably ±1.8 (ng/dot).

This is because, as shown in FIG. 3, if the pre-heat pulse width P1 is too large, the pre-creation of the bubble occurs, whereas if the pulse width P1 is too small, the temperature controllable range of the PWM ejection amount control is too small.

In this embodiment, from the standpoint of good image density design and the color reproducible range, five steps are used for the change of the pulse width. Conventionally, from the standpoint of sufficient ink ejection amount and prevention of the production of white stripe and other image qualities, only the recording heads providing the standard ejection amount: VD0=30.0±2.0 (ng/dot). Using the correcting method, the recording heads providing VD0'=30.0±3.8 (ng/dot) are usable. As described in the foregoing, the main assembly reads the ROM information as the PWM control table pointer TA3, and the main assembly driving conditions are set in response to the information, so that the variation in the ejection amounts of the individual recording heads can be corrected. Accordingly, the main assembly using the detachably mountable recording heads is capable of stabilizing the color image quality without difficulty. In addition, it is possible to increase the yield of the recording head manufacturing, and therefore, the total manufacturing cost of the cartridge can be reduced.

The pre-heat pulse width P1 may be changed for the proper range of the recording head temperature TH, as shown in FIG. 31. Or, it can be carried out in accordance with the sequential operations shown in FIG. 11.

FIG. 31A represents the case in which the reference value of the pulse width P1 is 0A, and the pre-heat pulse width P1 changed by one step (1H) for each 2.0° C. FIGS. 31B and 31C represent the cases in which the reference values are 0B and 09, respectively. The reference values may be stored in the ROM of the recording head, which is read by the main assembly to produce a table or tables. Alternatively, tables for different reference values are stored in the main assembly, and proper one of them is selected in accordance with the ROM information.

Figure 32A:
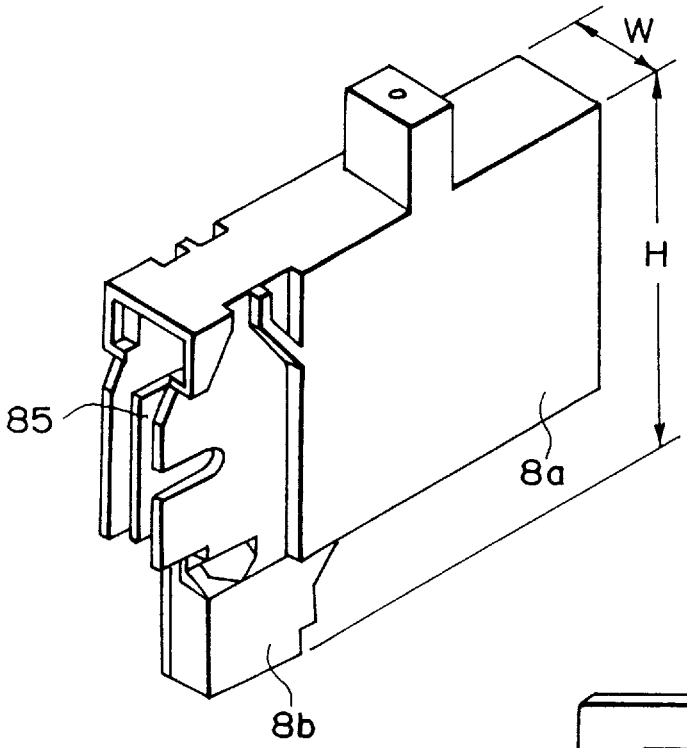
FIGS. 32A and 32B show an ink jet cartridge according to an embodiment of the present invention.
Figure 32B:
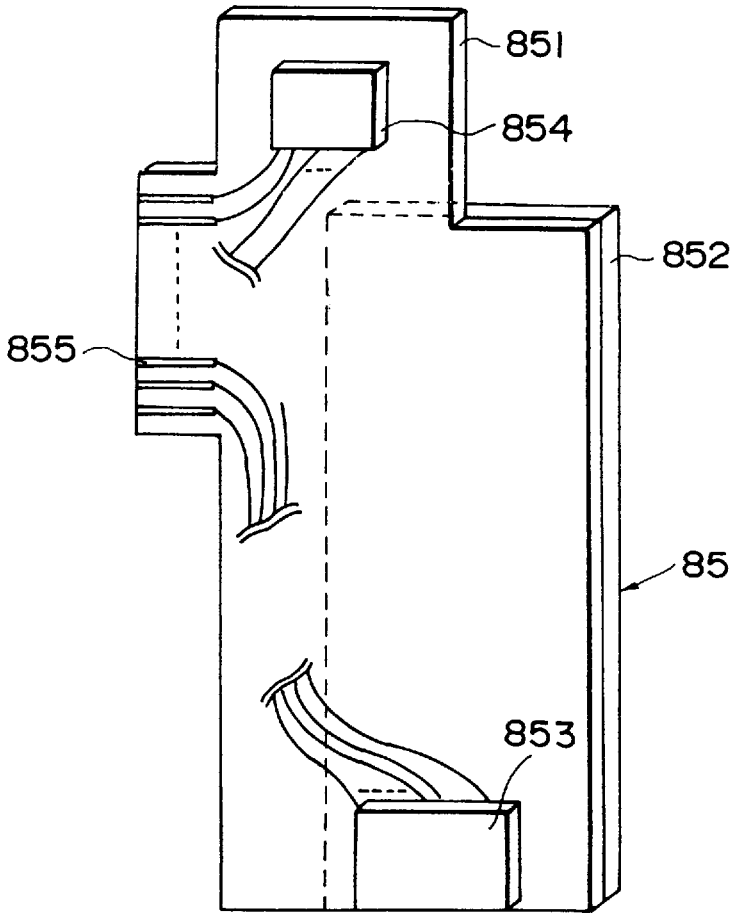

FIG. 32A shows an outer appearance of an ink jet cartridge according to this embodiment. FIGS. 32B show a print board 85 of the cartridge of FIG. 32A. In FIG. 32B, there are shown a print board base 851, aluminum heat radiation plate 852, a heater board 853 comprising heat generating elements and diode matrix, an EEPROM (non-volatile memory) storing beforehand density non-uniformity information or the like, and contact electrodes 855 for electric connection with the main assembly. The ejection outlets arranged in a line are omitted for simplicity.

In order to store the image non-uniformity information or the like peculiar to each of the recording heads, the EEPROM 854 is formed on the print board base 851 of the ink jet recording head 8*b* including the heat generating elements and the drive controller. By doing so, when the recording head 8*b* is mounted on the main assembly, the main assembly reads the information relating to the recording head property such as density-non-uniformity, from the recording head 8*b*, and the main assembly carries out the predetermined control for improving the recording property in accordance with the read information. Therefore, high image qualities are assured.

Figure 33A:
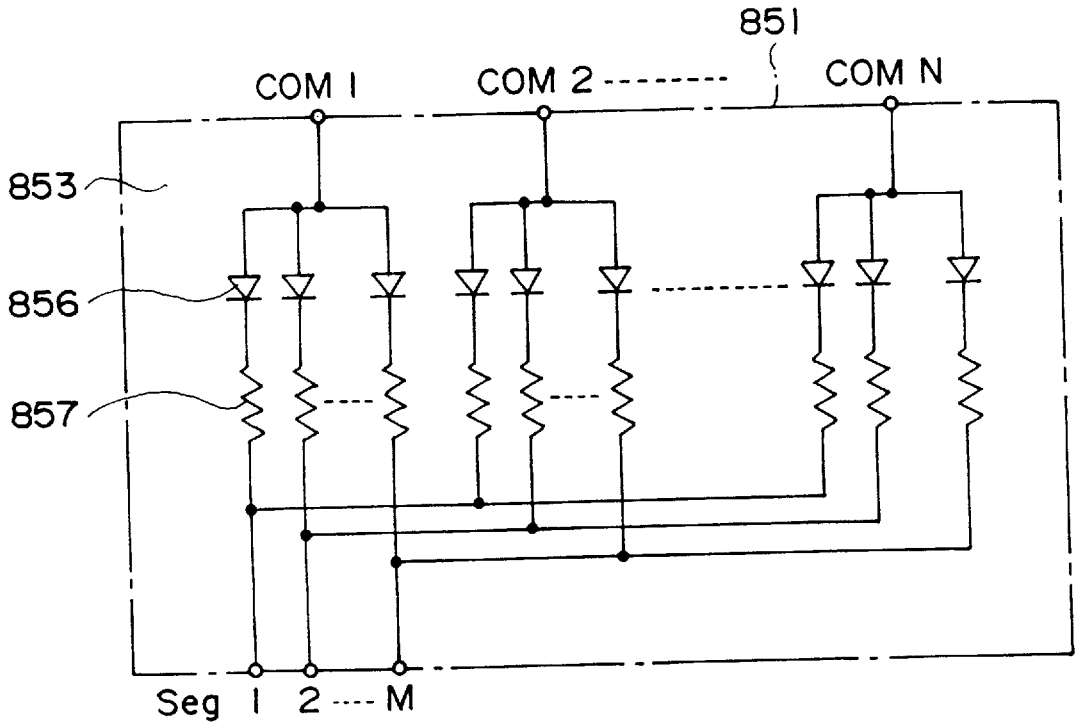
FIGS. 33A and 33B show the circuit structure of a major part of a printed board 851.
Figure 33B:
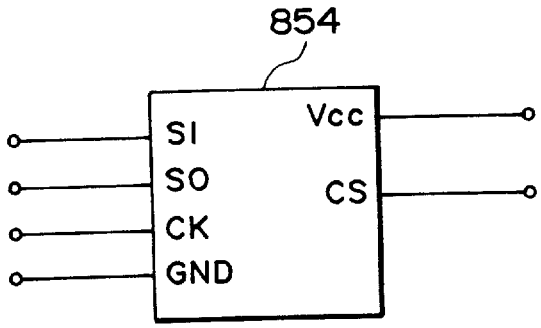
Figure 34:
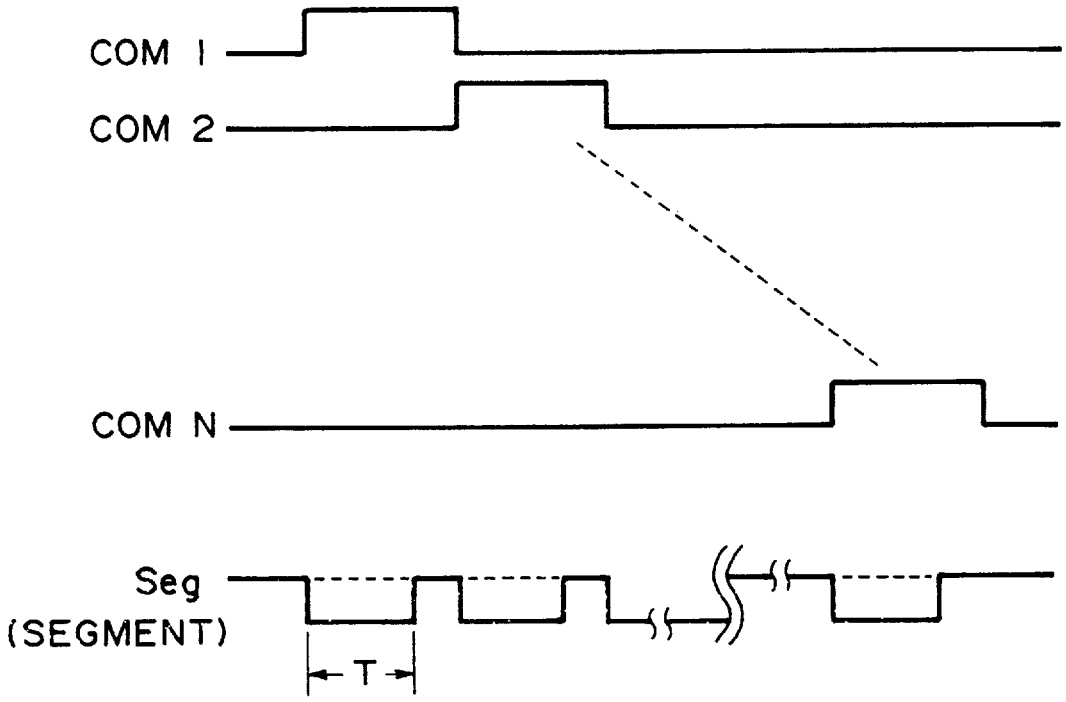
FIG. 34 is a timing chart for driving the heat generating elements 857 for each of the blocks in a time shared manner.

FIG. 33A and 33B show the major part of the circuit on the print board base 851 in FIG. 32. The elements within the frame defined by one-dot chain line are on the heater board 853. The heater board 853 is in the form of a matrix structure of N×M (16×8 in this example) each having series connection of the heat generating element 857 and a diode 856 for preventing unintended flow of the current. The heat generating elements 857 are driven in time-shared manner for each of the blocks. The control of the supply of the driving energy is effected by controlling the pulse width (T) applied to the segment (seg) side.

FIG. 33B shows an example of the EEPROM 854 of FIG. 32B. It stores the information relating to the density non-uniformity or the like. The information is supplied through serial communication in response to an instruction signal (address signal) D1 from the main assembly.

The information for the individual recording heads is stored in the ROM, and the variation in the ejection properties of the individual recording heads are corrected. What is required is the means for transmitting the information to the main assembly.

Figure 35A:
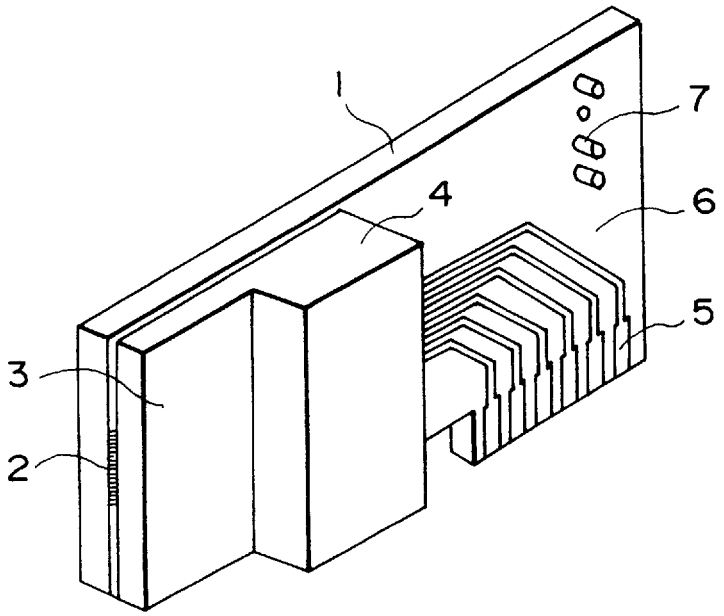
FIGS. 35A and 35B show a recording head according to a further embodiment of the present invention.
Figure 35B:
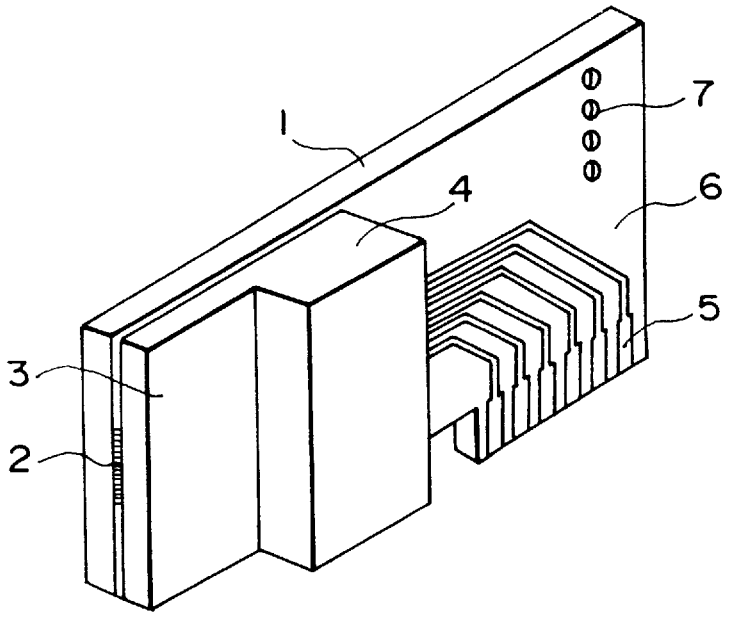

FIGS. 35A and 35B show recording heads according to further embodiments. In those recording heads, in place of the ROM for bearing the information to be transmitted to the main assembly, plural pits or projections are formed on the recording head chip. By the combination of the projections or pits, the information is given. In FIG. 35A, the information is in the form of a combination of projections, and in FIG. 35B, it is in the form of a combination of pits. The information can be transmitted at low cost and with simple structure in these examples. When the recording head is mounted on the main assembly, the main assembly mechanically, electrically or optically reads the information relating to table pointer or table or the like represented by the pits or projection, and the control parameters are changed, accordingly in this printer, the recording head is replaceable, and it is desirable that the optimum control parameters are set each time the head is replaced. The information providing means are not limited to those shown in FIGS. 35A or 35B, it may be in the form of cut-away portions or the like, if the same functions can be performed.

Because of the manufacturing tolerances, the individual recording heads have different properties shown in FIGS. 3 and 4. Under the condition that the recording head temperature (TH) is constant, the relationship between the pre-heat pulse width P1 and the ejection amount VD is as shown by curves b (or c) in FIG. 3, that is, below P1LMT of the pulse width, the inclination is large (small), and the increase is linear; and beyond the P1LMT, the bubble creation by the main heat pulse P3 is disturbed by the pre-creation of the bubble; and beyond P1MAXb (P1MAXc), the ejection amount decreases. Under the condition that the pre-heat pulse width P1 is constant, the relationship between the recording head temperature TH and the ejection amount VD is as shown by curves b (or c) of FIG. 4, that is, the increase is linear with large (small) inclination relative to increase of the head temperature TH. The coefficients in the linear zone are as follows:

Pre-heat pulse dependency coefficient of the ejection amount: $KP=\Delta VDP/\Delta P1$ (ng/$\mu$s.dot)

Recording head temperature dependency coefficient of the ejection amount: $KTH=\Delta VDT/\Delta TH$ (ng/C.dot)

In the case of the recording head having the structures shown in FIG. 2 and having the property represented by curve b in FIG. 4, KP=3.53 (ng/$\mu$sec.dot), and KTH=0.35 (ng/$\mu$sec.dot). The recording head having the property of curve c in FIG. 4 shows KP=3.01 (ng/$\mu$sec.dot), and KTH=0.25 (ng/$\mu$sec.dot).

From these two relationships, in order to effectively control the ejection amount in the manner described above, it is desirable that the temperature width and/or pulse width are optimized since the relation shown in FIG. 8 is different for the curves b and c. As described in the foregoing, the optimum control parameters are read by the main assembly, and therefore, initial ejection amount correction and the control operation during the printing are changed whenever the recording head is replaced. Therefore, even if the recording head temperature varies due to the variation in the ambient temperature and the self temperature rise due to the printing operation, the ink ejection amount of the recording head can be controlled to be constant. In this embodiment, the recording head chip is provided with the discrimination function, but the same or similar structure may be provided in the ink container.

When a permanent recording head is used for the color printer, the adjustment operations are carried out before being dispatched from the factory, and therefore, all the adjustments are desirably carried out in a short period. To remove the record density in response to input signals, gamma corrections are carried out conventionally for the cyan, magenta, yellow and black recording heads, respectively, so that the color balance is adjusted to suppress the deterioration of the color reproducibility attributable to the ejection amount variation. It was possible to provide good color balance for the half tone, but the fundamental ejection amount correction for solid image was not possible. If this is done by changing the gamma correction, the density decreases, or another problem arises.

According to this embodiment of the present invention, it is possible to correct the ejection amount in response to the read of the correcting data from the recording head. This can be carried out automatically during the assembling operation. Therefore, the necessity for undesirably changing the gamma corrections can be eliminated. In the case of the permanent recording head, the service life thereof is equivalent to that of the main assembly of the ink jet recording apparatus. Therefore, if the ejection amount changes during the use, the recording head or heads are replaced, conventionally. According to this embodiment of the invention, the readjustment can be easily carried out.

As described in the foregoing, according to the embodiment of the present invention, the recording head is provided with information transmitting means in one form or another in an ink jet recording apparatus usable with a replaceable recording head. The main assembly of the recording apparatus receives the information from the information transmitting means of the recording head, and the pointer or table for the divided pulse width modulation driving method is changed in accordance with the information, so as to change the pre-heat pulse width P1. By doing so, the ejection amount of the recording head can be changed so that the ejection amounts of the recording heads become uniform. Therefore, the variations of the ejection amounts of the individual recording heads unavoidably resulting from the manufacturing, can be avoided. Additionally, the variations in the ejection amounts of the individual recording heads can be removed, so that color difference or color reproducibility deterioration due to the disturbance to the color balance in the full-color image formation can be eliminated, and therefore, the image quality is improved. Furthermore, the change of the control property is effective to enhance the halftone reproducibility of color images. For the monochromatic images such as black, red, blue, green or the like, the density variation can be removed. Using the method of this embodiment, the recording head conventionally rejected due to the too large or small ejection amount can be usable, by which the manufacturing yield of the recording heads is remarkably improved, and therefore, the cost of the recording head can be reduced.

Embodiment 3

The description will be made as to the method for reducing variation in the ink ejection amount attributable to the temperature distribution produced over the ejection outlets used in the recording. The main control and the initial jam check routine of the ink jet recording apparatus of this embodiment are the same as in Embodiment 2, and the flow charts of the operations are shown in FIGS. 23, 24, 25, 26 and 27. The main control is generally the same as in the second embodiment 2, and therefore, the description thereof are omitted for simplicity.

Figure 36:
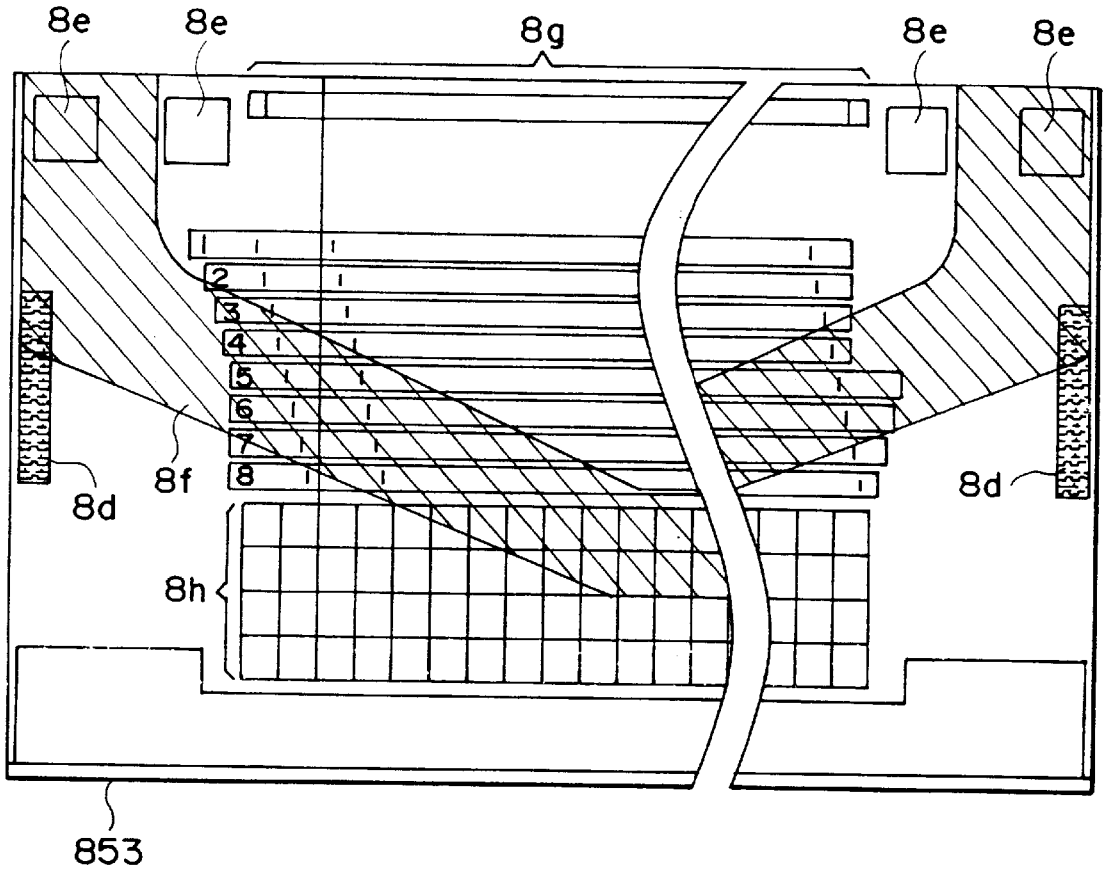
FIG. 36 shows a relation among a temperature sensor, a subordinate heater, a main (ejection) heater in a recording head used in an embodiment of the present invention.

The recording apparatus of this embodiment is usable with a replaceable recording head (cartridge type) as in the foregoing embodiment. Similarly, again, the recording head is driven through a divided pulse width modulation (PWM) driving method. Similarly to the previous embodiment, in order to correct the ejection amount change attributable to the temperature change, the ink jet recording head used in this embodiment is provided with plural ejection heaters and temperature sensors corresponding to the ink ejection outlets. FIG. 36 shows a heater board HB of the recording head used in this embodiment. There are disposed on one base plate temperature sensors 8*e*, subordinate heaters 8*d*, ejecting portion 8*g* having ejection (main) heaters 8*c* and driving elements 8*h* in the positional relations in this Figure. By disposing these elements on the same base plate, the head temperature can be efficiently detected and controlled. In addition, the size of the head can be reduced, and the manufacturing steps can be simplified. In this Figure, a positional relation with outer peripheral wall sections 8*f* of a top board for separating between the region filled with the ink and the region not filled with the ink. As shown in the Figure, the temperature sensors 8*e* are.disposed outside the outer peripheral wall 8*f* toward the ejection outlet side, that is, the region filled with the ink, and in the neighborhood of the ejection outlets. By this arrangement, the head temperature in the neighborhood of the ejection outlets can be efficiently detected. Similarly to the Embodiments 1 and 2, the temperature detection is effected as an average of the temperature sensors. That is, the temperature TH is detected as (THL+THR)/2, where THL and THR are temperatures detected by the left and right temperature sensors.

Figure 37:
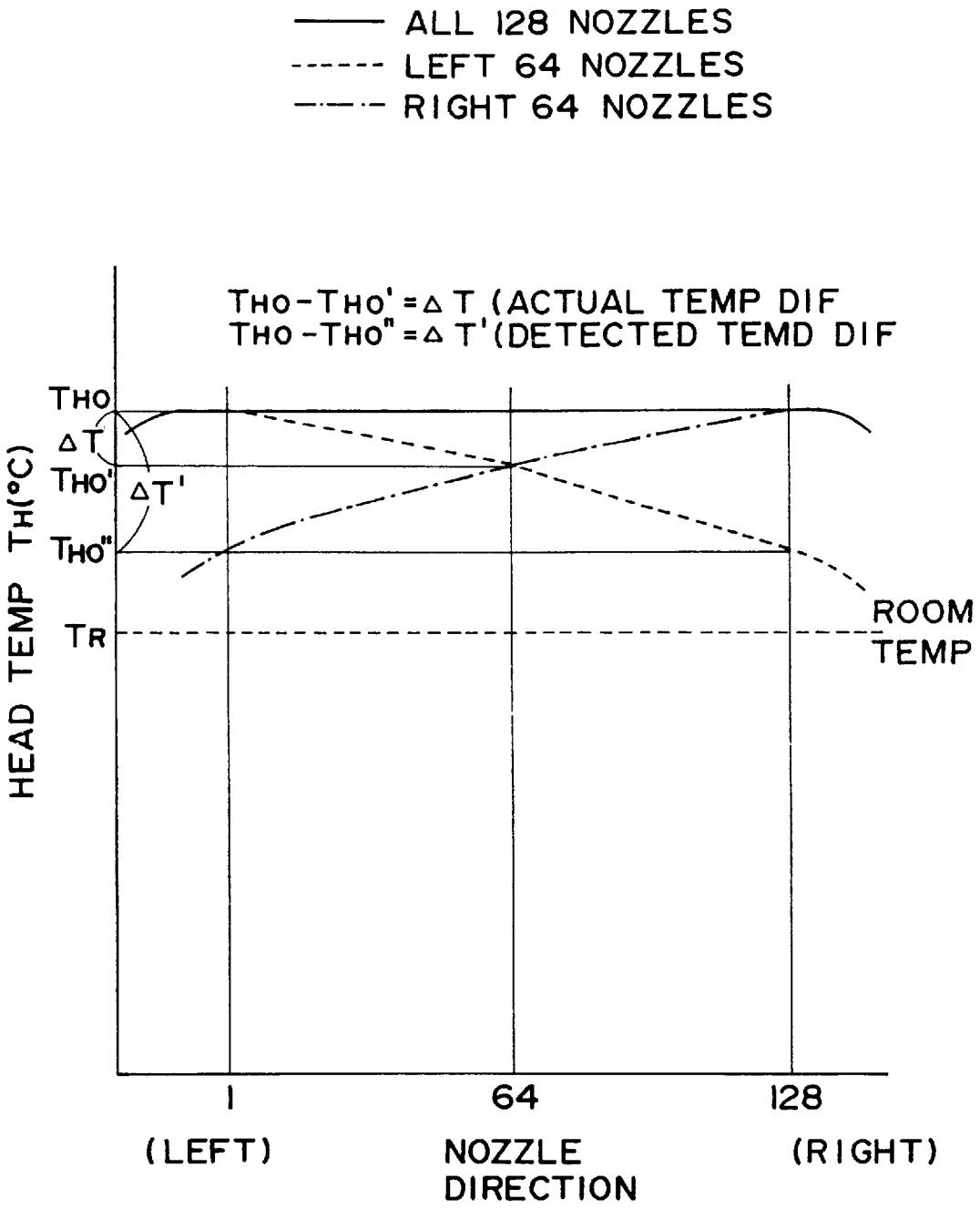
FIG. 37 is a graph of a recording head temperature distribution.

When only the left half of the head nozzle (ejection outlet) are used, the temperature distribution becomes as shown by (2) in FIG. 37. This tendency becomes remarkable with increase of the printing duty. During the printing, the left temperature sensor always shows high temperature, and the right temperature sensor always shows low temperature. When the recording head is driven on the basis of the head temperature TH thus measured, the control is effected on the basis of a temperature which is lower than the temperature THL (THL>TH) of the actually operating nozzles. Therefore, the control operation is such as to increase the ejection amount, that is, the control is going to make the pre-heat pulse width P1 longer. Desirably, the control is so as to decrease the ejection amount, and therefore, the control is not stabilized. In addition, since the temperature rise due to the ejection increases with increase of the pre-heat pulse width, and therefore, the left and right temperature difference increases more.

In order to remove the vicious circle, the control in this embodiment is effected on the basis of a corrected temperature TH'=(XTHL+YTHR)/(X+Y), that is, the left and right temperatures are weighted. In this embodiment, X=4 and Y=1 are set in the main assembly beforehand for the the ejecting operation by the left half nozzles. For example, if the temperatures THLMAX=40° C., and THRMAX=30° C. are detected on the first line of the printing operation of 50% printing duty:

(1) In the normal control:

TH=(40+30)/2=35° C. is used as a base for the control of the pre-heat pulse width P1, and therefore, the difference from THLMAX=5° C.:

(2) In this embodiment:

TH'=(160+30)/5=38° C. is used as a base for the pre-heat pulse width P1 control, and therefore, the difference from THLMAX is 2° C., thus decreasing the difference from the true temperature, by which the more accurate head drive control is performed.

Another example of this embodiment will be described. In this example, the head temperature correction is effected in the head driving. This example is incorporated in a monochromatic printer.

In the apparatus of this example, the average of three left temperature outputs and three right temperature sensor outputs (THL=[THLN−2+THLN−1+THLN]/3) are used during the printing operation to control left and right temperature control subordinate heater of the recording head. The temperature difference which results from the number and positions of the used nozzles and which is detected by the left and right temperature sensors, is detected, and the power control is performed so as to remove the temperature distribution by waiting the energy supplied to the subordinate heaters.

When only the left half nozzles are used, the head temperature has the distribution shown by (2) in FIG. 37. The tendency becomes more remarkable with increase of the printing duty. The left temperature sensor shows always high temperature during printing operation, whereas the right temperature shows always low temperature. In consideration of the head temperature difference ΔTH thus detected, the subordinate heater is driven. More particularly, the detected recording head temperature THL at the left side where the nozzles eject ink, is discriminated in consideration of the head temperature difference ΔTH, and a low target temperature is selected to decrease the subordinate heater power. On the other hand, the recording head temperature THR at the right side where the nozzles do not eject the ink, is discriminated in consideration of the recording head temperature difference ΔTH, and a high target temperature is selected to increase the power. By doing so, the right and left temperature difference will be reduced.

In this manner, the temperature difference between the left and right temperature sensor outputs are considered, the power supplies to the left and right subordinate heaters are weighted in the power controls. It is assumed that the ejections are effected only at the left half nozzles of the recording head, the head temperature is 35° C. before the start of the printing, and that the printing duty is 50%. It is further assumed that the temperatures THLMAX=45° C. and THRMAX=35° C. are detected on the first printing line. Then, ΔTH=THLMAX−THRMAX=10° C.

(1) Under the normal control, the left target temperature THL=35° C., the right target temperature THL=35° C., therefore, the control system does not change the target temperature.

(2) In this embodiment, the left target temperature THL=TH−ΔTH/2=30° C., the right target temperature THR=TH+ΔTH/2=40° C., the target temperature is changed on the basis of the difference from the true temperature, and therefore, the control is carried out to reduce the temperature difference between the right and left portions. In this method, too, the main assembly has a table or tables for the positions and number of nozzles used for the temperature difference ΔTH.

A color copying machine of this embodiment will be described.

In the case of color copying machine, the printer is driven in accordance with the image signals supplied from an image reader, and therefore, the relation between the printing region and the recording head printing width is not always such that it is an integer multiple of the printing width. Accordingly, on the bottom line of the printing, only a part of the nozzles is used. In the serial printing type ink jet recording apparatus, the sheet feeding accuracy is stabilized by the normal feeding (head width). Therefore, if the sheet feeding is changed particularly for the reducing printing, the feeding accuracy decreases with the result of joint stripe (image disturbance). In view of this, two path printing in which two printing operations are carried out for one sheet feed, is effective. In this case, the number of operating nozzles is changed. For example, upon 50% reduction operation, left and right 64 nozzles are alternately used to effect the two path printing.

In this example, on the basis of the temperature difference ΔTH provided by the left and right temperature sensors, the driving pulse is changed in the control, for the respective blocks, for example. In this apparatus, an average of three left sensor outputs and three right sensor outputs (THL=[THLN−2+THLN−1+THLN]/3) is used as the head temperature TH to control the recording head drive. The temperature difference attributable to the positions and number of the used nozzles is detected, and the driving pulse applied to the recording head is weighted to reduce the temperature difference.

Only when the left half nozzles are used, the recording head temperature distribution is as shown by (2) (printing) in FIG. 37. The tendency is more remarkable with increase of the printing duty. During the printing operation, the left temperature sensor shows always a high temperature, and the right temperature sensor shows always low temperature. The recording head is driven in consideration of the head temperature difference ΔTH. More particularly, the recording head driving pulse P1L for the ejecting nozzles (left half), are supplied with short pulses to reduce the ejection amount, whereas the non-ejecting nozzles (right half) is supplied with driving pulses P1R having a large width to increase the ejection amount (increase the temperature) so as to make the ejection amount (temperature) distribution more uniform. The similar operations are effected when only the right half head nozzles are actuated.

In this manner, the difference in the temperatures detected by the left and right temperature sensors, and the driving pulses for the blocks are weighted in controlling the power. It is assumed that the left half nozzles are actuated with the driving pulse P1=1.87 micro-sec, and that the operation is started with the temperature TH=25° C. It is further assumed that the printing duty is 50%, and the temperatures detected on the first line are THLMAX=45° C. and THRMA=35° C. Then, ΔTH=(THLMAX−THRMAX)=10° C.

(1) Under normal control, left side pre-heat pulse width P1L=P1 usec, right side pre-heat pulse width P1R =P1 usec, and therefore, the control system does not work, that is, the control is effected to provide the pulse width P1

(2) In this embodiment,

ΔP1=P1·ΔTH/20° C., the left side pre-heat pulse width P1L=(P1−ΔP1) micro-sec, and the right side pre-heat pulse width P1R=(P1+ΔP1) micro-sec, so that the driving parameters are made different at the left side and the right side so as to reduce the ejection amount difference. In other words, the control is effected with (P1±ΔP1).

When the temperature difference ΔTH is equal to or higher than 20° C., the control operation is not possible, and error signal is produced. In this embodiment, the pre-heat pulses are supplied to the non-ejecting nozzles to increase the temperature thereof, however, the pre-heat pulses are not required to be supplied to the non-ejecting nozzles, in the control.

According to this embodiment, in the ink jet recording apparatus using thermal energy, the driving parameters or conditions (temperature control method, driving pulse or the like) is changed in accordance with the number of used nozzles, and therefore, the temperature distribution of the recording head is made more uniform, and therefore, the ejection amount distribution can be made more uniform. By doing so, the density non-uniformity or joint stripe can be avoided. Even in the bottom line printing or the reduction printing, the image density and/or the color balance can be stabilized.

Embodiment 4

A fourth embodiment of the present invention uses a divided pulse width modulation (PWM) driving method.

In this embodiment, by modulating a waveform of a leading signal amount plural signals constituting the driving signal so as to control the expansion speed of the bubble produced in the ink, by which the ink ejection speed can be controlled, and in addition, the ink refilling action is optimized. The ink jet recording apparatus and the PWM driving method used in this embodiment are the same as in the first embodiment shown in FIGS. 1–5. Briefly, as described in the foregoing in conjunction with FIGS. 1–5, the first pulse of the divided pulses (driving signal for the heat generating element) is modulated to stabilize the ejection amount. On the other hand, the temperature of the recording head can be efficiently controlled. The controllable range of the recording head temperature is relatively large, as shown by T0–TL as shown in FIG. 8.

Figure 38:
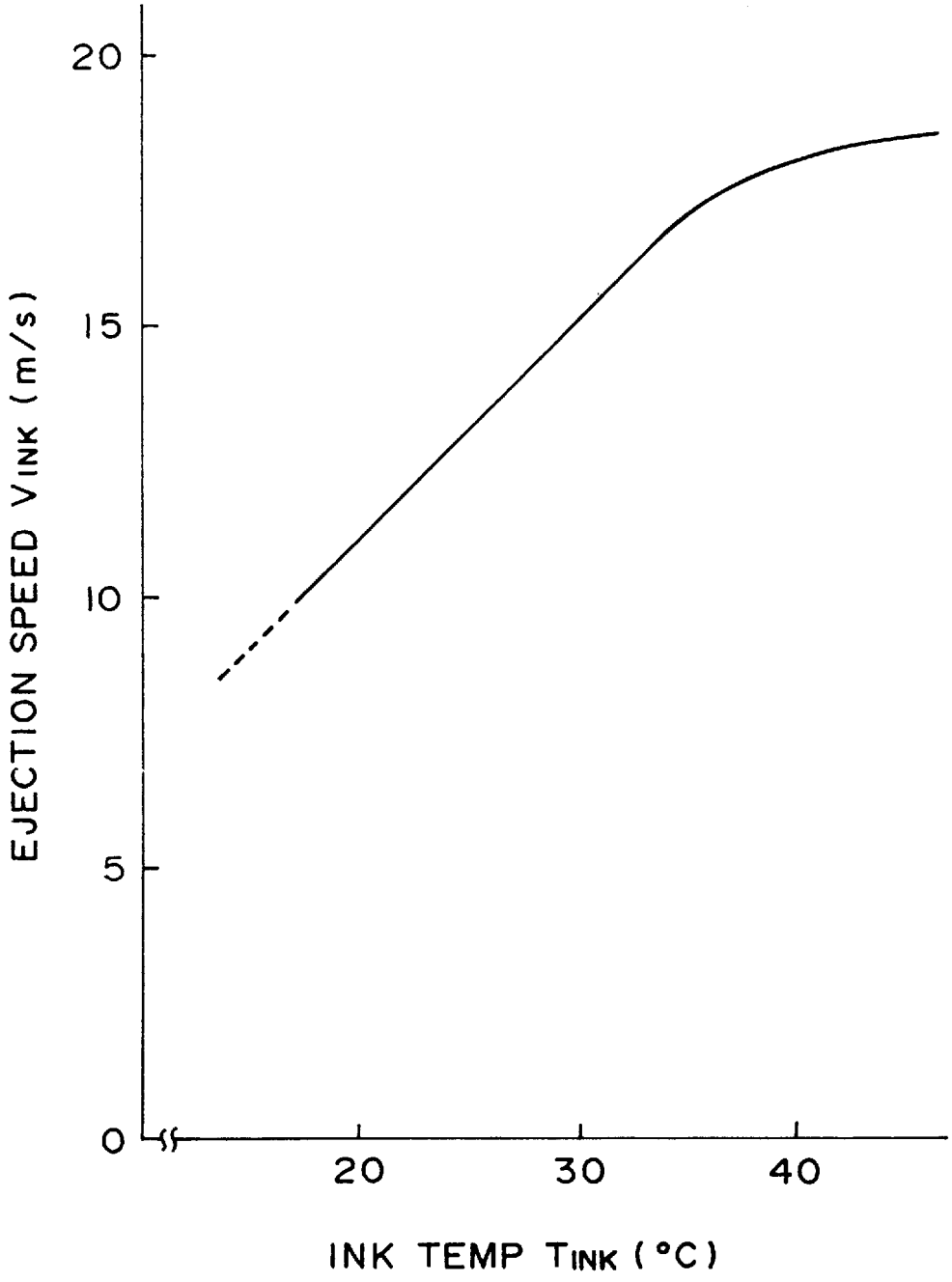
FIG. 38 illustrates a relation between a ink temperature and an ejection speed.

The relation between the ink ejection speed and the ink temperature is generally as shown in FIG. 38. More particularly, the ejection speed increases with increase of the temperature. Up to a certain temperature, the ejection speed linearly increases with increase of the ink temperature. The relation between the ink temperature and the ejection speed can be explained as follows.

The ejection speed Vink, ejection amount Mink and a volume Vb of a bubble produced in the ink by the heat provided by the heat generating element, satisfy:

$$Vink-k(\partial Vb/\partial t)/Mink$$

where k is constant, $\partial/\partial t$ is partial differential with time.

As described from the foregoing, the ejection speed is proportional to the bubble expansion speed, and is reversely proportional to the ejection amount. Therefore, if the ejection amount is decreased, and/or the bubble expansion speed is increased, for example, the ejection speed is increased. The reduction of the ejection amount (change) is not preferable because it produces image density non-uniformity or the like, as has been described in conjunction with FIGS. 1–11. Therefore, the control is generally effected to stabilize the ejection amount. For these reasons, the ink ejection speed is frequently determined by the bubble expansion speed. The bubble expansion speed is dependent on the ink temperature (recording head temperature).

Figure 39:
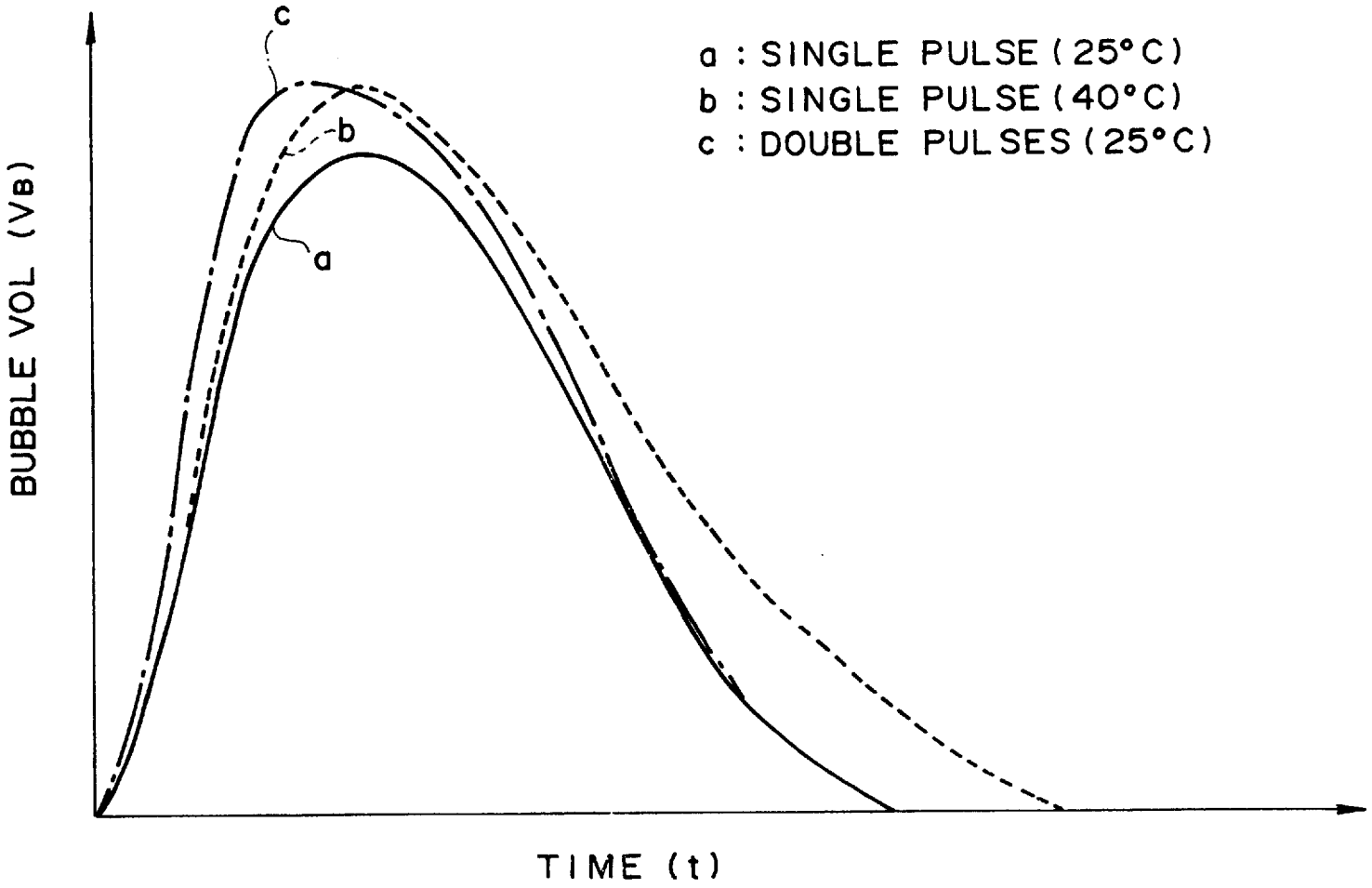
FIG. 39 is a graph illustrating the bubble developing process in ink.

FIG. 39 shows a relation between the bubble creating time t and the bubble volume Vb. Curves a and b represent the cases in which the recording head temperatures are 25° C. and 40° C., respectively, when the driving pulse is nondivided single pulse. As will be understood from this, when the volume Vb of the bubble increases (expands), the inclination of the curve, that is, the expansion speed is higher with the curve b having a relatively high head temperature.

From the foregoing, the relation shown in FIG. 38 is understood, that is, the ejection speed increases with increase of the recording head temperature, that is, the ink temperature in the ink passage or the common liquid chamber.

Although the ejection speed can be increased by increasing the recording head temperature, the bubble volume Vb reducing speed (contraction speed) is relatively smaller, and therefore, the bubble extinguishing time is relatively longer in the curve b providing the higher ejection speed. As a result, the refilling frequency lowers, which leads to the above-described problems.

These phenomena can be explained by the fact that the curve b has a longer bubble extinction time because of the higher temperature of the ink around the bubble.

Therefore, in this embodiment, the temperature of the ink to be involved in the ejection is increased to increase the ejection speed, while maintaining low temperature of the recording head, that is, the temperature of the ink around the bubble during the bubble contraction period.

Figure 40:
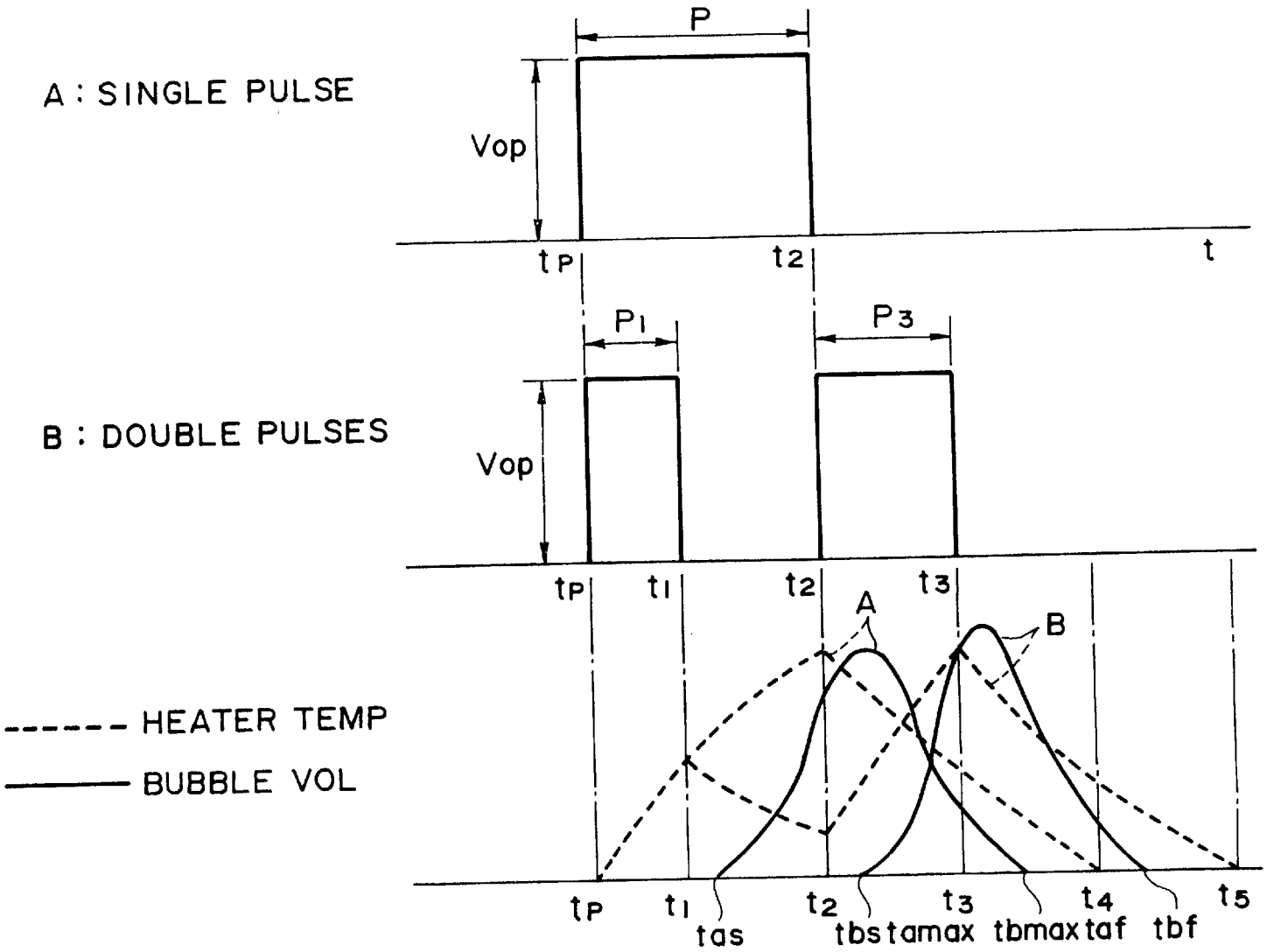
FIG. 40 is a graph showing heat generating element temperature and bubble volume change relative to the driving pulse applied to the heat generating element.

FIG. 40 is a graph showing a relation between the pulse for driving the heat generating element and the change of the bubble volume with time. In this Figure, when a single pulse A is applied to the heat generating element, the heat generating element temperature and the volume of the bubble change with time t. More particularly, the driving pulse rises at a point of time $t_p$, and at $t_{as}$, the film boiling starts, so that the bubble starts to expand. At time $t_2$, the driving pulse falls, but the bubble volume continues to increase up to $t_{amax}$ (maximum volume). Then, it starts to contract until it extinguishes at $t_{af}$. The bubble volume changes in the similar manner, when the double pulse B is applied.

The extinguishing periods (from the maximum bubble volume to the extinction) and the expansion periods (from start of the expansion to the maximum volume) in the cases of the single pulse A at the double pulse B are compared. Assuming that the bubble extinguish times are substantially the same, the expansion period in the case of the double pulse B is shorter. That is, the expansion speed is larger. This is understood from comparison between the curves a and c in FIG. 13.

Therefore, even if the bubble extinguishing time is the same, the ejection speed can be increased by application of the double pulses. This is because the ink temperature influential to the ejection is increased by the first part of the double pulses. By doing so, the resistance against the ink ejection due to the ink viscosity is lowered so that the bubble expansion speed is increased. thus, the ejection speed can be increased. Accordingly, by modulating the first pulse width P1, the ejection speed can be controlled.

When the heat generating elements are driven by the double pulses, the recording head temperature can be relatively easily controlled, as described in conjunction with FIGS. 1–15. Therefore, the temperature of the recording head can be lowered, thus shortening the bubble extinguishing time, and simultaneously, the ejection amount of the ink can be stabilized.

The description will be made as to the preferable setting of the bubble width in view of the head driving condition and the image forming condition on the recording material, for the double pulses (divided pulses).

1) First, the signals P1, P2 and P3 will be dealt with. Conventionally, the double pulses are simply considered as a combination of the pulses P1 and P3. The interval P1 between the pulses is not considered. It has been found that by properly setting the interval P1, the heat amount supplied by the pulse P1 can sufficiently affect the bubble creation by the pulse P3, with the heating amount P1 being changed.

In this embodiment, the consideration is paid this, and the interval P2 is made larger than or equal to the pulse application period P1, by which the step tone level (gray scale) by the pulse application P1 can be expanded, and therefore, the desired conditions can be efficiently achieved. In addition, the period P2 desirably satisfies P2<P3, by which the efficient ink droplet formation is achieved in the driving frequency of the apparatus.

Accordingly, in the apparatus in which the pre-heat pulse P1 is controlled, it is desirable that $P1 \leqq P2 \leqq P3$ are satisfied. In the double pulses, when the bubble is created using thermal energy, one skilled in the art knows that the laser thickness of the heat generating resistor and the resistance thereof are more or less limited. More particularly, the voltage is 15–30 V. The above conditions $P1 \leqq P2 < P3$ is particularly effective in such a range. The conditions are particularly effective in a high frequency region such as not less than 5 KHz, preferably not more than 8 KHz and further preferably not less than 10 KHz of the maximum driving frequency.

As regards the pulse width P3, $1\ \text{usec} \leqq P3 < 5\ \text{usec}$ are desirable from the standpoint of stabilization of the bubble creation. In this range, the above condition $P1 \leqq P2 < P3$ is very effective.

2) The description will be made as regards the ejection amount on recording materials.

The ink ejection amount Vd (pl/dpt) is determined on the basis of the picture element density and the ink feathering rate on the recording material (in consideration of the area factor). For example, in order to enable the solid image recording at the picture element density of 400 dpi, approximately 8 nl/mm$^2$ ink shot is required. In order to obtain this amount by one or several shots, the ejection amount Vd is 5–50 (pl/dot).

In the axial apparatus, the pulse width P1 is changed so as to provide the above ejection amount Vd while satisfying the above conditions $P1 \leqq P2 < P3$, by which the driving conditions can be easily selected to meet the recording material and the recording method.

3) The description will be made as to the maximum range of the driving frequency. The driving frequency f (KHz) is dependent on the recording speed and the refilling characteristics. However, if the ejection amount is selected under the above paragraph 1), the driving frequency is determined, accordingly. More particularly, if the ejection amount is small, the driving frequency is high, and on the contrary, if the ejection amount is large, the driving frequency is high. As a result, if the consideration is paid to the range provided Vd=5–50, the driving frequency f is 2–20 KHz.

4) The description will be made as to the block driving system in which the number of ejection outlets of the recording head is $n_N$ and the ejection outlets are grouped into $n_B$ blocks sequentially actuated with the number of segments Nseg (the number of ejection outlets/the number of blocks).

Here, the pulse width Pd of the double pulses is defined as Pd=P1+P2+P3. Then, the maximum of the pulse width Pd is theoretically $T/n_B$ where T is the driving period. However, if the width Pd is selected to be $T/n_B$ electrical crosstalk may occur between block drivings with the possible result of unnecessary bubble creation in the ink. Or, the switching time period of the transistor is required for switching the blocks. Therefore, a rest period is required for the pulse between the blocks. If the time period is $\alpha$, the time required for one double pulse application $Pn=Pd+\alpha$.

Therefore, under the conditions 1)–5), the maximum (Pn)max of the width Pn is $(Pn)max=T/n_B=1/(n_Bf)$, and $Pd<1/(n_Bf)$. For example, under the condition 3), $2\leqq f\leqq 20$, and therefore, $Pd<(2n_B)$ when the driving frequency is in this range. It is assumed that one block contains 8 ejection outlets, then, the number $n_B$ is 8, 16 or 32 if the number of ejection outlets $n_N$ is 64, 128 or 256, respectively. If the divided drive is not carried out, then $n_B=1$ irrespective of the number of ejection outlets. Therefore, if $n_B=8$, for example, then $Pd<1/(2\times 8)$ msec, that is, 6.25 $\mu$sec<Pd<62.5 $\mu$sec in the above driving frequency range.

Similarly if $5\leqq f$ ($\leqq 20$), then $Pd<1/(5n_B)$; if $8<f$ ($\leqq 20$), then $Pd<1(8n_B)$; and if $10\leqq f$ ($\leqq 20$), then $Pd<1/(10n_B)$.

The pulse or interval widths P1, P2 and P3 satisfying $Pd=P1+P2+P3<1/(n_Bf)$, are related as follows:

1) however small is the pulse width P1, the width P3 is required to be sufficiently large to create the bubble;

2) the maximum of the width P1 is not sufficient to create the bubble by the pulse P1 alone; and 3) the interval P2 is preferably as long as possible, provided that it does not exceed (Pn)max.

The description will be made as to an example of an ink jet recording apparatus in which the ejection speed control described in the foregoing is introduced in which the distance between the recording head and the recording material is variable in accordance with the material of the recording material.

When coated paper, for example, is used, the distance between the recording head and the recording material can be set relatively short. However, the plain paper or OHP sheet exhibiting poor ink absorbing characteristics require the large distance because the direct contact between the recording head and the recording medium is relatively easily occurs because of the cockling and the beading. In view of this, for the coated sheet, the interval is set 0.7 mm, and the ejection speed is set 12 m/sec; for the plain paper or the like, the sheet interval is set 1.2 mm, and the ejection speed is set 16 m/sec.

Such control of the ejection speed can be accomplished by setting the temperature of the recording head by the recording head temperature control described in conjunction with FIGS. 1–15, and by modulating the first part of the double pulses.

As described in the foregoing, by increasing the ejection speed when the distance between the recording head and the recording material is large, the deviation of the ink droplet deposition position can be avoided, thus avoiding the shot accuracy deterioration.

The description will be made as to an example of a monochromatic printer incorporating this embodiment.

This printer is usable with a replaceable recording head detachably mountable to the printer. Therefore, it is desirable that the refilling frequency proper to the mounted recording head is set in accordance with the using conditions or the like of the printer to which the recording head is mounted. Among the monochromatic printer, the relatively low driving frequency printer (low speed printer) will be satisfied by relatively low refilling frequency. Therefore, the recording head temperature is not lowered, and the ejection speed can be controlled by the pulse width modulation in the double pulses.

As will be understood from the foregoing, according to the embodiment of the present invention, the preceding part of the plural signals is modulated in its waveform, by which the bubble expansion speed in the ink can be controlled, so that the ink ejection speed can be controlled. In addition, by the modulation of the preceding part, the ink temperature to be ejected can be locally controlled. By doing so, the temperature of the ink adjacent the bubble when the bubble contracts, can be selected to be lower independently of the control of the ejection speed and the ejection amount or the like. As a result, the contraction speed can be increased, and therefore, the refilling frequency can be increased.

Embodiment 5

The fifth embodiment will be described, in which the above-described divided pulse width modulation (PWM) driving method is used. In the PWM driving method, a driving signal is constituted by plural signal components, and the waveform of the preceding component is modulated to control the ejection amount.

In this embodiment, the PWM driving method is used for the recording density control on the overhead projector (OHP) sheet. In the case of the recording on the OHP sheet, the image has to be clear when it is projected, and therefore, the high density record is desired. By simply modulating the pulse width in accordance with the recording head temperature to control the ejection amount, it is not possible to provide a desired relatively high density record particularly on the OHP sheet.

The description will be made referring to the Figures. The structure of the ink jet recording apparatus and the PWM driving method used in this embodiment, are similar to those described in the first embodiment shown in FIGS. 1–15. Briefly, the first pulse component of the divided pulse of the driving signal for the heat generating element, the ejection amount can be stabilized. On the other hand, it is possible to efficiently control the recording head temperature. In addition, the controllable range of the recording head temperature is relatively large (T0–TL) as shown in FIG. 8.

When the printing is effected on the OHP sheet, it is desirable to correct the variation of the ejection amount, but frequently it is also desired that the record has the high density. Therefore, when the printing is effected on the OHP sheet, the PWM control in accordance with the recording head temperature is not carried out, and the pulse width P1 is fixed at the maximum possible level, thus increasing the ejection amount to realize the high density recording.

Figure 41:
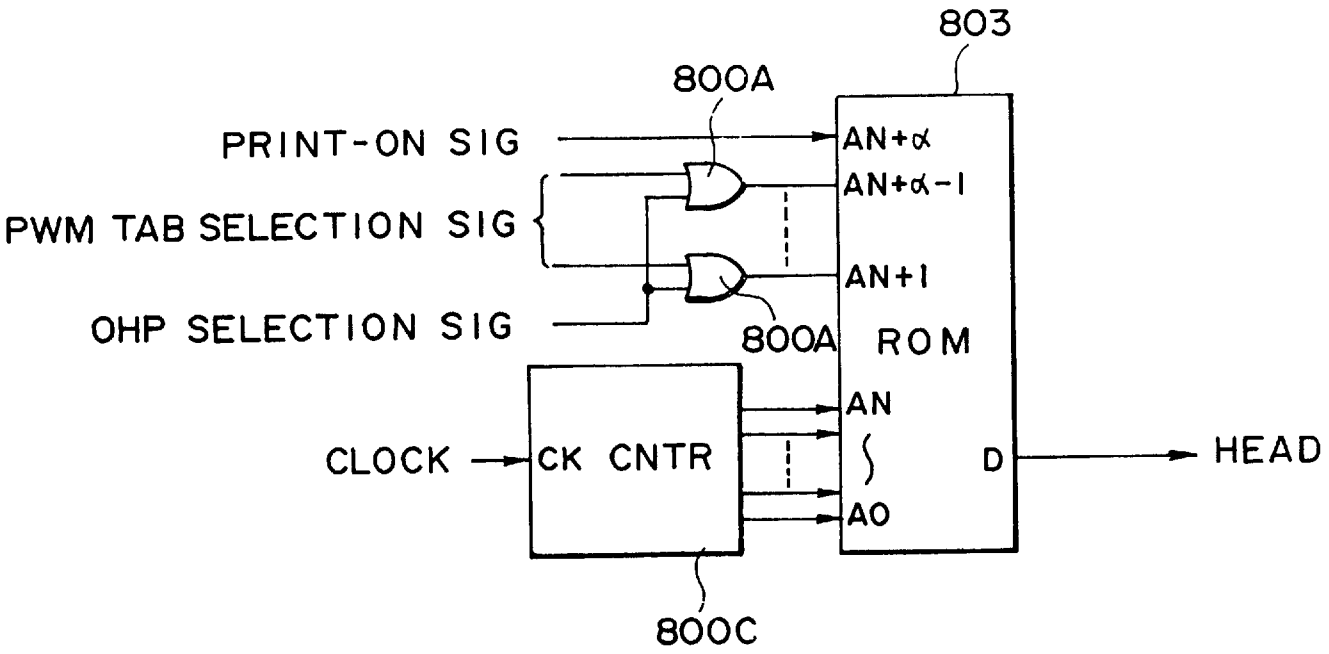
FIGS. 41 and 42 are a block diagram of a recording head drive control system and a timing chart of the signals in the control system, according to an embodiment of the present invention.
Figure 42:
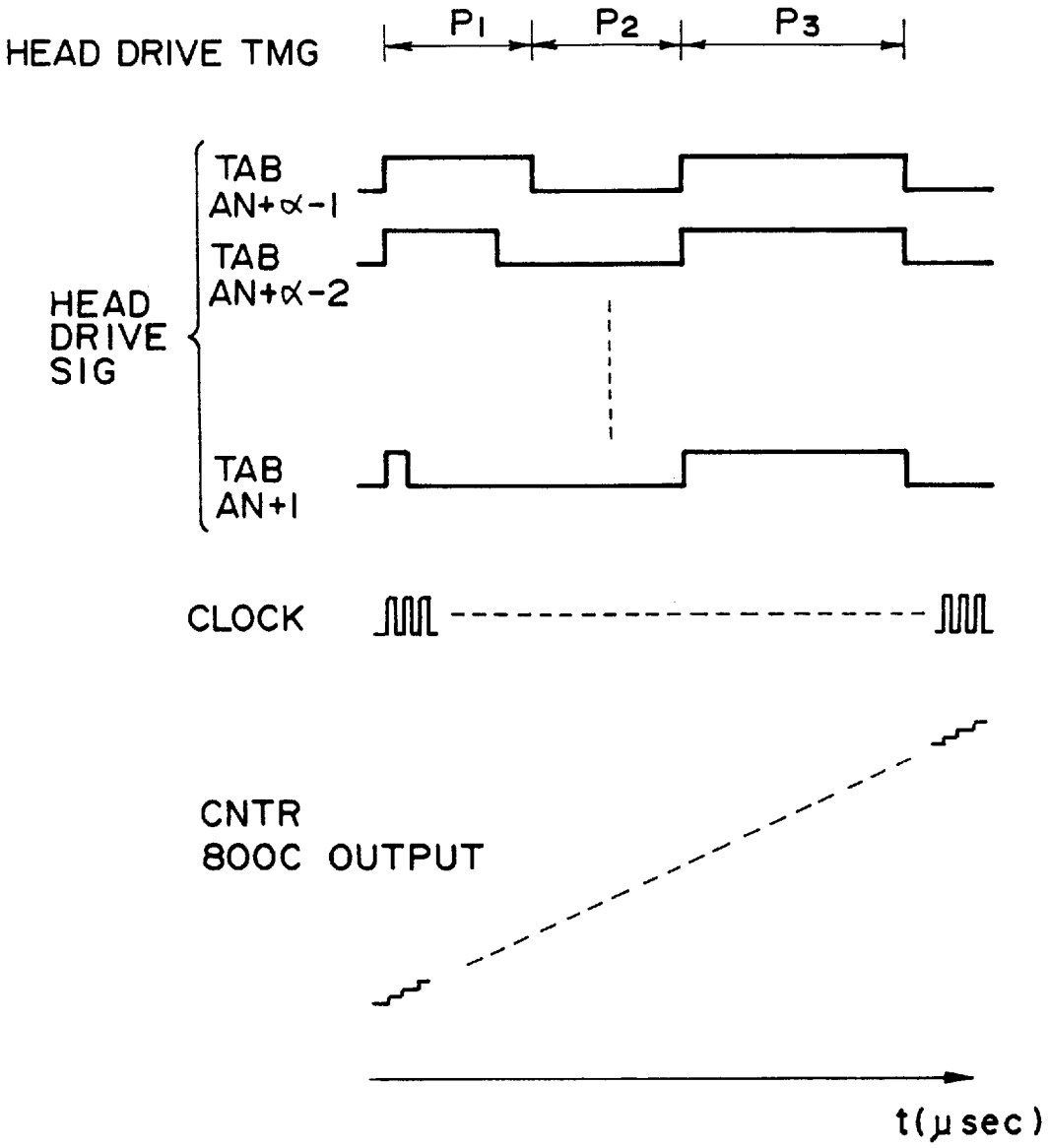

FIG. 41 is a block diagram illustrating the head drive control according to an embodiment of the present invention, and FIG. 42 is a timing chart for various signals in this structure.

The pattern of the head drive signal waveform is stored beforehand in a ROM 805. At the output timing of the head drive signal, clock pulses are supplied to a counter 800C in a controller 800 shown in FIG. 15. Each time the clock signals are supplied, the output of the counter is incremented by 1. By doing so, the content of the ROM 803 is outputted as head drive signals with the counter outputs used as the address signals.

The head drive signals are outputted on the basis of selection from the PWM control table storing the pulse widths for the pre-pulse P1 for the respective temperatures. As shown in FIG. 42, the head drive signal having the waveform in accordance with the selected table is produced. The selection of the head drive signal table is determined on the basis of the PWM control table selection signal supplied to the ROM 803. When the OHP sheet selection signal is "H", all the input signals for the PWM table selection signals to the ROM 803 become all "H"by the operation of the OR gate 800A, so that a table $AN+\alpha-1$ is selected irrespective of the PWM table selection signal. By this, the pre-pulse width P1 is fixed at its maximum shown in FIG. 42 as the maximum more particularly, P1=2.618 micro-sec, and P3=4.114 micro-sec.

FIG. 42 shows the head driving signal when the printing is effected with the print ON signal being "H". When the print ON signal is "L", the head driving signal in FIG. 42 is "L" level in connection with the pulse P3.

In this embodiment, the ejection amount is increased only by setting the pre-pulse P1 at its maximum level. The ejection amount may be further increased by increasing the recording head temperature. More particularly, the target temperature of the recording head control is increased from normal 25° C. to 40° C. If the temperature is increased more, the recording head temperature may approach the limit temperature TLIMIT=60° C., since the temperature rise due to the printing may be approximately 15° C.

The above-described drive control is performed by transferring the operation mode to the OHP mode when the OHP mode is discriminated upon detection of the material of the recording material. In this embodiment, the description has been made with respect to the PWM control of the pre-pulse of the divided pulse. In the case of the PWM control of a single pulse, the fixed pulse may be used in the OHP mode to increase the ejection amount. In addition, the above-described temperature control change may be added.

Figure 43:
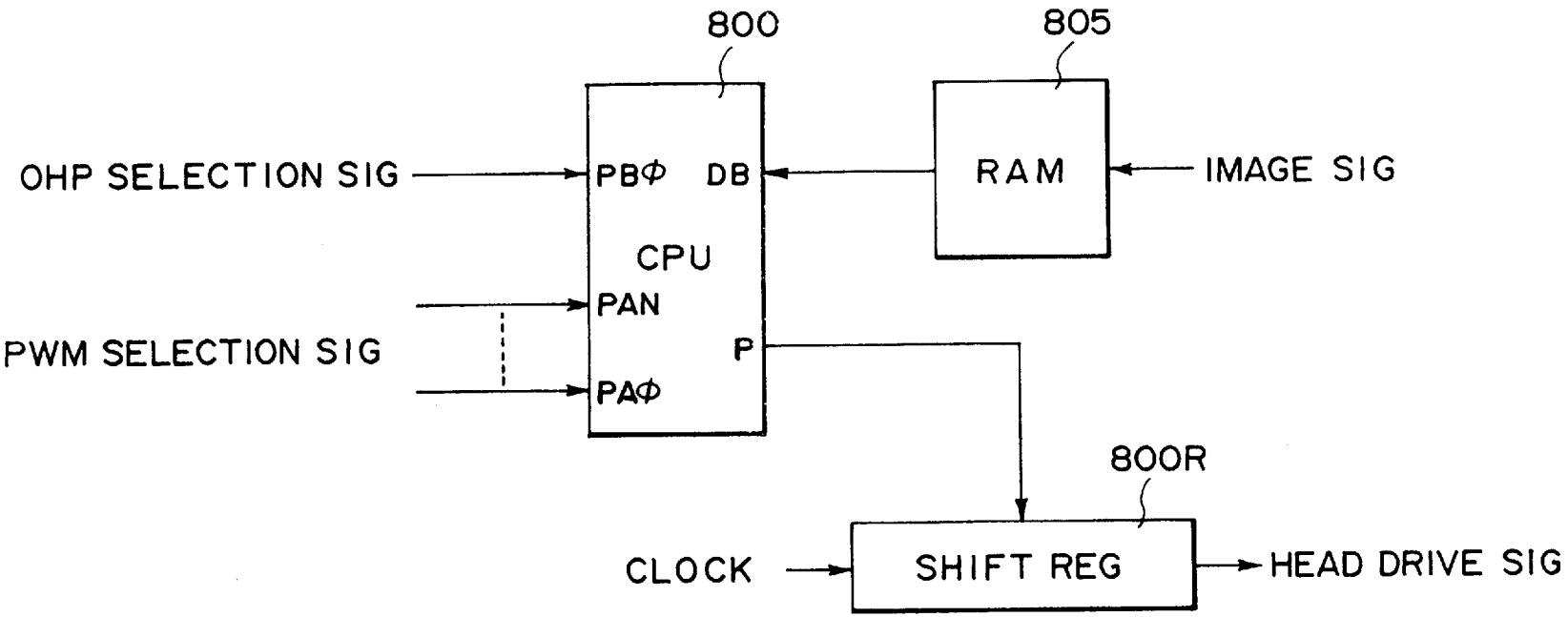
FIGS. 43, 44 and 45 are a block diagram of a recording head driving control system, a timing chart of the control system and a flow chart of the sequential operations.
Figure 44:
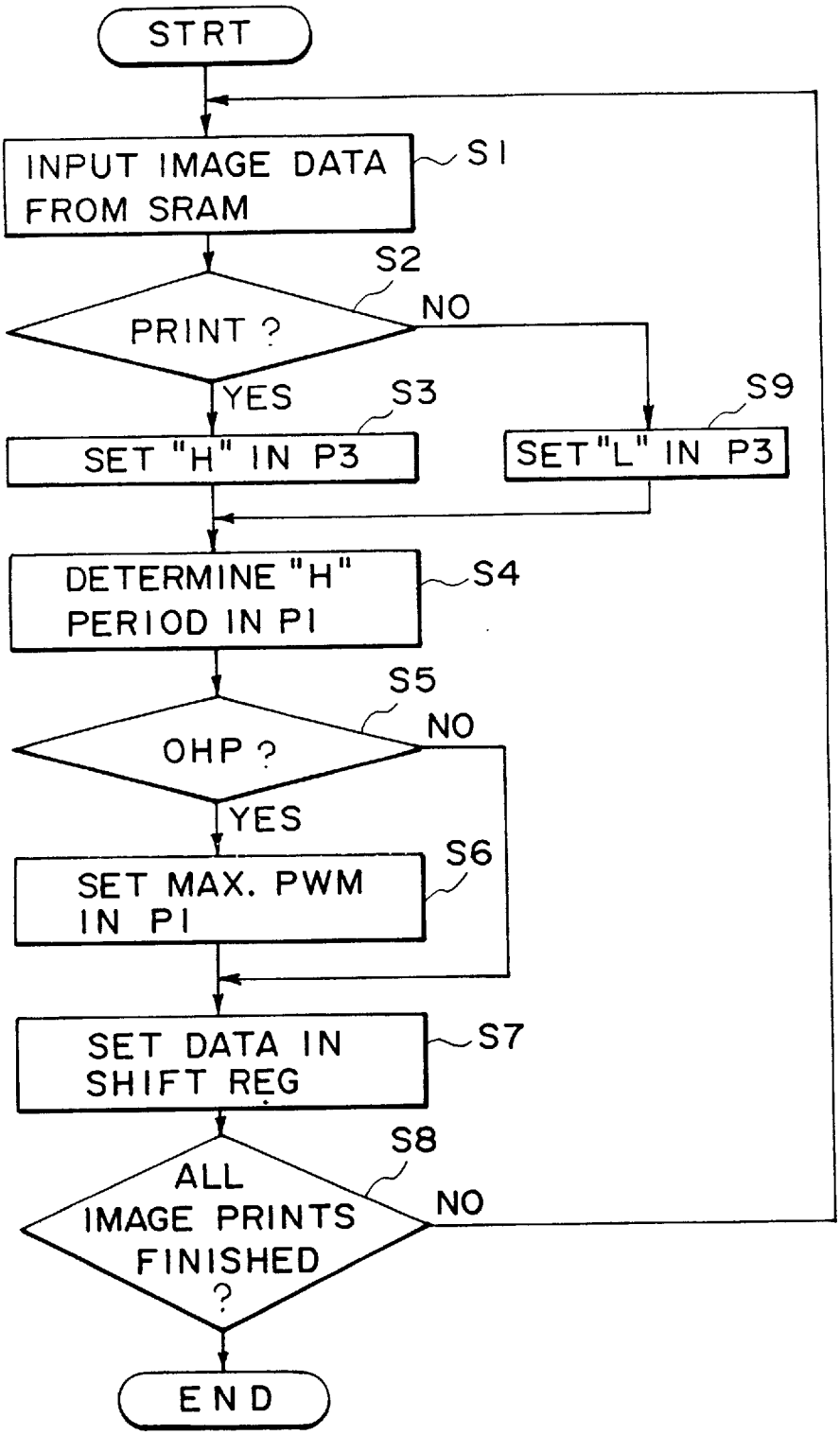
Figure 45:
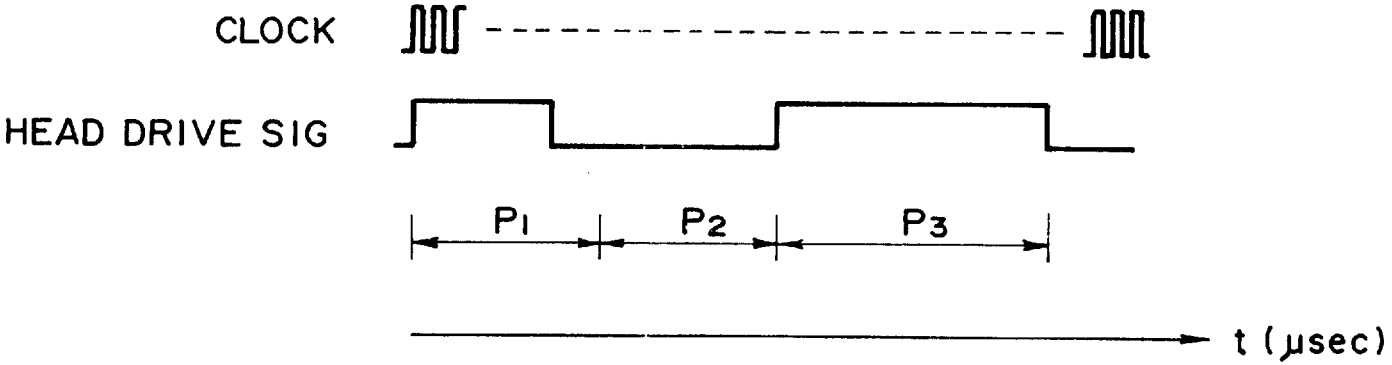

Referring to FIGS. 43 and 44, a further embodiment of the head drive control will be described. In FIG. 43, the image signal in the form of print data is stored in the RAM 805. At the point of time when the image signal is stored in the RAM 805, the CPU 800 supplies the image data to the shift resistor 800R, and the head drive signals are produced. The detailed description will be made referring to the flow chart of FIG. 44.

In FIG. 44, at step S1, the CPU 800 reads out of the RAM 805 the image data or datum for one picture element, and the operation proceeds to step S2, where the discrimination is made as to the data or datum represents the printing action, that is, whether or not the ink is to be ejected or not. If the ink is to be ejected, the operation proceeds to step S3. If not, a step S9 is executed. At step S3, the register 12 of the CPU 800 stores "H" for the period of the main pulse P3, and the operation proceeds to step S4. At step S4, the PWM selection signal is read in, the "H" level width of the pre-pulse P1 is stored in the resistor 12 of the CPU 800, and the operation proceeds to step S5, where the OHP selection signal is read in. If it indicates the OHP sheet printing mode, the operation proceeds to step S6. If not, step S7 is executed.

At step S6, the H level with of the pre-pulse P1 determined at step S4 is changed to the selectable maximum width, and is stored in the resistor of the CPU 800. Then, the operation proceeds to step S7, where a head drive signal is produced using the pre-pulse P1 information and the main pulse P3 information, and the signal is stored in the shift register 800R. Then, step S8 is performed, in which the head drive signal stored in the shift register 800R is produced from the shift register 800R in synchronism with the clock.

At step S8, the discrimination is made as to whether or not the image data stored in the RAM 805 is all outputted. If so, the operation ends. If not, the operation returns to the step S1.

Figure 9:
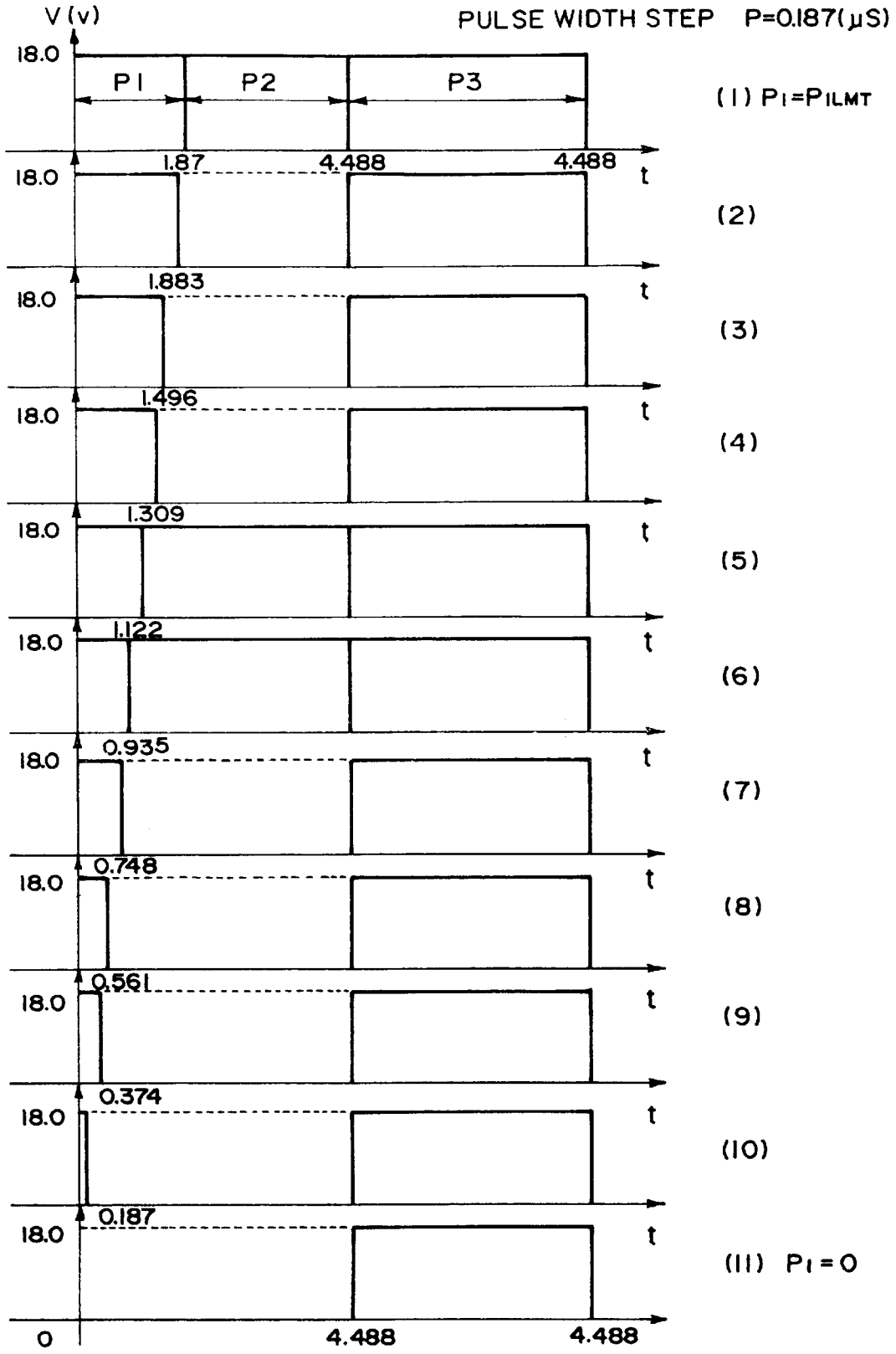
FIG. 9 shows a pulse waveform set in a table according to an embodiment of the present invention.

FIG. 9 shows the waveform of the selectable driving pulse in the above-described PWM control.

When the used recording material is usual recording material other than the transparent OHP sheet or the like, the PWM control selects the waveforms 1–11 in FIG. 9 in accordance with the detected temperature or the like.

When the recording is carried out on the OHP sheet, only the pulses shown by 1 in FIG. 9 is used.

As a modification of these embodiments, the used pulse may not be fixed to the one driving pulse, but relatively large width pulses of the pre-pulses in FIG. 9 are selected, and the PWM control is effected within the range of the selected relatively large pulses, when the OHP sheet is used. By doing so, the high image density can be provided with the high image quality, particularly when the full-color images are recorded.

As for the selectable range of the pulses, there are pulses shown by 1–4 in FIG. 9, the pulses shown by 1 and 2 of the same Figure, and a combination of the pulse shown by 1 in the same Figure and one or more pulses having larger pre-pulse width P1, for example.

As will be understood from the foregoing, according to the present invention, when a recording material (OHP sheet, for example) having transparent part is used, a signal is produced which indicates the event that a recording mode in which the waveform modulation is to be effected within a high temperature region as compared with the usual recording material, is selected. In response to this, the driving control means controls the pre-heat pulse modulation in the divided pulse drive method, for example, so as to effect the modulation within a predetermined range where the pulse width is relatively large, as long as that mode selection signal is produced. The head drive signal may have the pulse width of the pre-heat pulse which is fixed in this range.

As a result, the ink ejection amount can be increased by fixing the pulse width in a higher driving condition range providing larger pulse width and fixing it at a point within this range. Therefore, the high image density printing is possible on the OHP sheet or the like.

In the foregoing embodiments, the ejection amount is controlled and stabilized in accordance with the output of the temperature sensor. However, the present invention is not limited to this case, but is usable in the case in which the ejection amount is changed in accordance with the tone level signal instructing the tone of the record dot. On the basis of the temperature change detected by the sensor, the ejection amount may be changed in accordance with the tone signal to obtain stabilization in a wide range.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording method in which ink is ejected by thermal energy produced by a heat generating element of a recording head in response to application of driving signals thereto, the driving signals being of plural waveforms including a fixed waveform, said method comprising the steps of:

detecting a temperature of the recording head; and applying the driving signals to the heat generating element of the recording head, wherein the waveforms of the driving signals are changed in accordance with the temperature of the recording head when the temperature of the recording head is below a predetermined level, and the waveforms of the driving signals comprise the fixed waveform when the temperature of the recording head exceeds the predetermined level.

2. A method according to claim 1, wherein each of the driving signals is in the form of a pulse, and said signal applying step is effected by changing a width of the pulse when the temperature of the recording head is below the predetermined level.

3. A method according to claim 1, wherein the thermal energy is sufficient to produce film boiling of the ink.

4. A recording method according to claim 1, wherein each of the driving signals comprises a plurality of pulses.

5. A recording method according to claim 4, wherein the pulses comprise a first pulse for applying thermal energy insufficient to eject the ink, and a second pulse sufficient to eject the ink.

6. A recording method in which ink is ejected by thermal energy produced by a heat generating element in a recording head in response to application of driving signals thereto, each of the driving signals comprising a waveform, said method comprising the steps of:

detecting a temperature of the recording head; and applying the driving signals to the heat generating element of the recording head, wherein the waveform of each of the driving signals is changed in accordance with the temperature of the recording head and changing of the waveform in said applying step is effected in a different manner in accordance with the temperature of the recording head.

7. A method according to claim 6, wherein an interval of the driving signal changes is decreased with increase of the temperature.

8. A method according to claim 6, wherein a width of the waveform is increased with increase of the temperature.

9. A method according to claim 6, wherein each of the driving signals is in the form of a pulse, and changing of the waveform is effected by changing a width of the pulse.

10. A method according to claim 6, wherein the thermal energy is sufficient to produce film boiling of the ink.

11. A recording method according to claim 6, wherein each of the driving signals comprises a plurality of pulses.

12. A recording method according to claim 11, wherein the pulses comprise a first pulse for applying thermal energy insufficient to eject the ink, and a second pulse sufficient to eject the ink.

13. An ink jet recording apparatus in which ink is ejected, comprising:

a recording head having a heat generating element to eject the ink by thermal energy produced by the heat generating element in response to driving signals applied thereto, the driving signals being of plural waveforms including a predetermined waveform;

temperature detecting means for detecting a temperature of the recording head;

driving signal changing means for applying the driving signals to said heat generating element of said recording head and changing the waveform of the driving signals in accordance with an output of said detecting means; and control means for disabling said changing means and applying the predetermined waveform of the driving signal to said heat generating element of said recording head when the output of said detecting means is indicative of a predetermined temperature or higher.

14. An apparatus according to claim 13, wherein said changing means effects its changing operation in different weights in accordance with different outputs of said detecting means.

15. An apparatus according to claim 14, wherein an interval of changing of said changing means decreases with increase of the temperature detected by said detecting means.

16. An apparatus according to claim 14, wherein change of the waveform is increased with increase of the temperature detected by said detecting means.

17. An apparatus according to claim 13, wherein each of the driving signals comprises a plurality of pulses.

18. An apparatus according to claim 17, wherein the pulses comprise a first pulse for applying energy insufficient to eject the ink, and a second pulse sufficient to eject the ink.

* * * * *

UNITED STATES PATENT AND TRADEMARK OFFICE

CERTIFICATE OF CORRECTION

PATENT NO. : 5,861,895 Page 1 of 7

DATED : January 19, 1999

INVENTOR(S) : TAJIKA ET AL.

It is certified that error appears in the above-indentified patent and that said Letters Patent is hereby corrected as shown below:

COLUMN 1:

Line 31, "temperature for" should read --temperature sensor for--.

Line 53, "feedback:" should read --feedback;--.

Line 55, "feedback:" should read --feedback;--.

Line 58, "feedback:" should read --feedback;--.

COLUMN 3:

Line 7, "occurs," should read --occur,--.

Line 13, "ink indivisual" should read --individual ink--.

Line 29, "nozzle." should read --nozzles.--.

Line 44, "tion is" should read --tions are--.

COLUMN 4:

Line 1, "appear" should read --appears--.

Line 16, "material" should read --materials--.

Line 42, "rejection heads" should read --rejected heads--.

COLUMN 5:

Line 37, "67(A), 7(B) and 7(C)" should read --6A, 6B and 7A-7C--.

Line 63, "a graph" should read --graphs--.

UNITED STATES PATENT AND TRADEMARK OFFICE

CERTIFICATE OF CORRECTION

PATENT NO. : 5,861,895 Page 2 of 7

DATED : January 19, 1999

INVENTOR(S) : TAJIKA ET AL.

It is certified that error appears in the above-indentified patent and that said Letters Patent is hereby corrected as shown below:

COLUMN 6:

Line 44, "a" should read --an--.

COLUMN 7:

Line 15, "roll" should read --role--.

Line 32, "are" should read --are a--.

Line 66, "saturate" should read --saturates--.

COLUMN 8:

Line 48, "or" should read --on--.

Line 53, "3," should read --4,--.

Figure 6A:
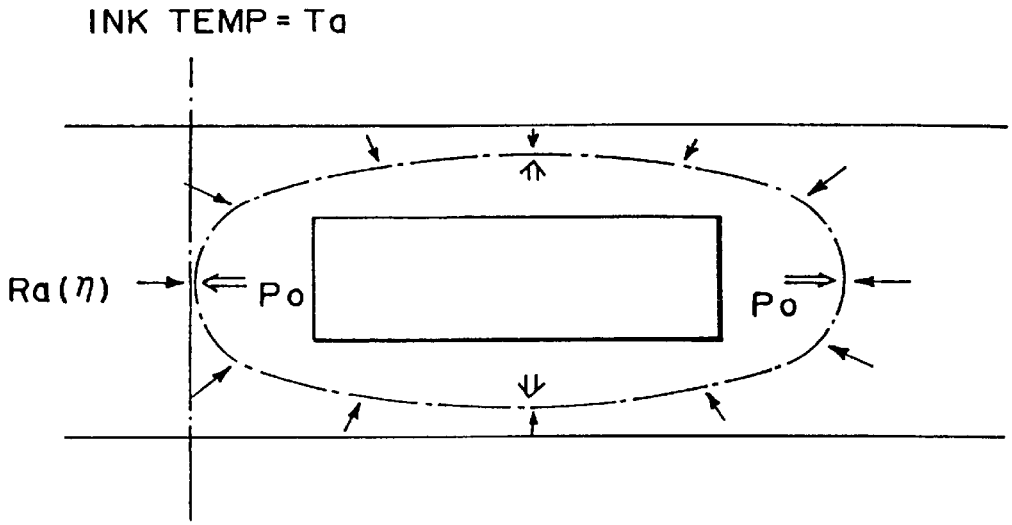
Figure 6B:
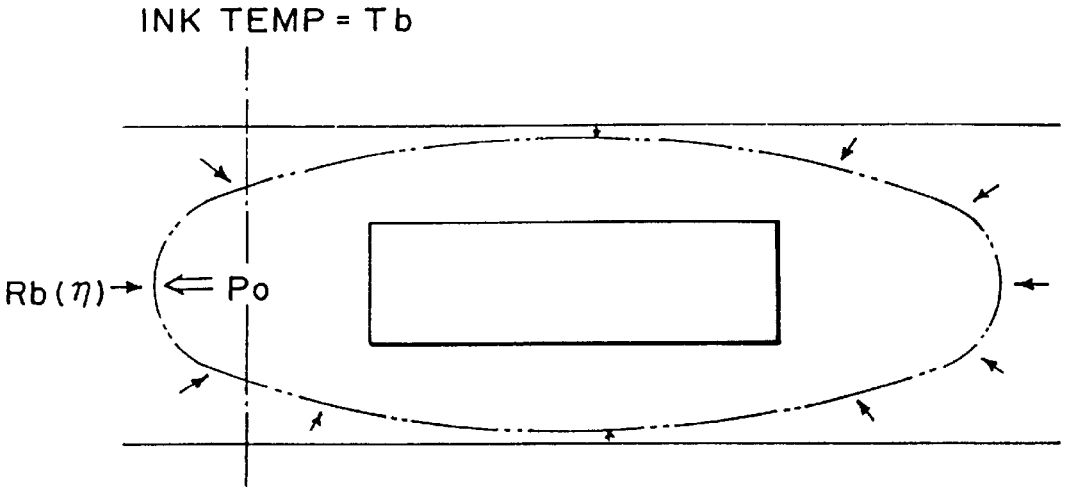

Line 63, "FIG. 6" should read --FIG. 6, which is comprised of FIGS. 6A and 6B,--.

COLUMN 9:

Line 1, "of (A) of FIG. 6," should read --of FIG. 6A,--.

Line 6, "of (B) of FIG. 6," should read --of FIG. 6B,--.

Line 10, "In" should read --In an--.

Line 11, "at an" should read --at--.

Line 17, "temperature" should read --temperature be increased--.

Line 20, "a ink" should read --an ink--.

Line 23, "time. After" should read --time after--

UNITED STATES PATENT AND TRADEMARK OFFICE

CERTIFICATE OF CORRECTION

PATENT NO. : 5,861,895 Page 3 of 7

DATED : January 19, 1999

INVENTOR(S) : TAJIKA ET AL.

It is certified that error appears in the above-indentified patent and that said Letters Patent is hereby corrected as shown below:

COLUMN 12:

Line 7, "correspond" should read --corresponds--.

Line 20, "change" should read --changes--.

Line 21, "feed back" should read --feedback--.

Line 27, "because" should read --because of--.

Line 51, "In this" should read --This--.

COLUMN 13:

Line 23, "each" should read --and each--.

Line 25, "Each of the" should read --Each--.

COLUMN 14:

Line 3, "another" should read --other--.

Line 4, "RAM 805" should read --and RAM 805--.

Line 11, "switches" should read --switches, including--.

Line 63, "pattern" should read --patterns--.

COLUMN 15:

Line 10, "represent" should read --represents--.

COLUMN 16:

Line 1, "increment." should read --increments.--.

UNITED STATES PATENT AND TRADEMARK OFFICE

CERTIFICATE OF CORRECTION

PATENT NO. : 5,861,895 Page 4 of 7

DATED : January 19, 1999

INVENTOR(S) : TAJIKA ET AL.

It is certified that error appears in the above-indentified patent and that said Letters Patent is hereby corrected as shown below:

COLUMN 18:

Line 23, "ia" should read --a--, and "riving" should read --driving--.

Line 34, "of" should read --of a--.

Line 37, "generator." should read --generator may be used.--.

Line 45, "erty" should read --erly--.

Line 59, "is" should read --are--.

Line 66, "ROM" should read --the ROM--.

COLUMN 19:

Line 42, "flat" should read --flag--.

COLUMN 20:

Line 20, "removal of bubbles after the printing," should be deleted.

Line 24, "decrease" should read --is decreased--.

Line 58, "feeing" should read --feeding--.

COLUMN 21:

Line 40, "In the apparatus in which" should read --The apparatus of--.

Line 60, "results " should read --results in--.

UNITED STATES PATENT AND TRADEMARK OFFICE

CERTIFICATE OF CORRECTION

PATENT NO. : 5,861,895 Page 5 of 7

DATED : January 19, 1999

INVENTOR(S) : TAJIKA ET AL.

It is certified that error appears in the above-indentified patent and that said Letters Patent is hereby corrected as shown below:

COLUMN 22:

Line 7, "quality." should read --quality occurs.--.

COLUMN 23:

Line 4, "TA3" should read --TA3 is used--.

Line 33, "upon" should read --Upon--.

Line 35, ", the" should read --the--.

Line 62, "the" should read --and the--.

COLUMN 24:

Line 12, "(ng/dot)." should read --(ng/dot) are usable--.

Line 37, "proper" should read --a proper--.

Line 40, "FIGS. 32B show" should read --FIG. 32 shows--.

COLUMN 27:

Line 26, "a" should be deleted.

Line 27, "positional relation with" should be deleted.

Line 28, "board" should read --board are used--.

Line 30, "are. disposed" should read --are disposed--.

UNITED STATES PATENT AND TRADEMARK OFFICE

CERTIFICATE OF CORRECTION

PATENT NO. : 5,861,895 Page 6 of 7

DATED : January 19, 1999

INVENTOR(S) : TAJIKA ET AL.

It is certified that error appears in the above-indentified patent and that said Letters Patent is hereby corrected as shown below:

Line 40, "nozzle" should read --nozzles--, and "outlet)" should read --outlets)--.

Line 56, "and therefore," should be deleted.

Line 63, "the the" should read --the--.

COLUMN 28:

Line 23, "waiting" should read --weighting--.

COLUMN 31:

Line 52, "thus," should read --Thus,--.

COLUMN 32:

Line 6, "the" (first occurrence) should be deleted, and "this," should read --to this,--.

Line 20, "is" should read --are--.

COLUMN 33:

Line 35, "is" should be deleted.

Line 58, "printer," should read --printers,--.

COLUMN 35:

Line 37, "to" should read --to whether--.

COLUMN 36:

Line 2, "is" should read --are--

UNITED STATES PATENT AND TRADEMARK OFFICE

CERTIFICATE OF CORRECTION

PATENT NO. : 5,861,895 Page 7 of 7

DATED : January 19, 1999

INVENTOR(S) : TAJIKA ET AL.

It is certified that error appears in the above-indentified patent and that said Letters Patent is hereby corrected as shown below:

COLUMN 37:

Line 29, "and" should read --or--.

Line 30, "head" should read --heads--.

Line 50, "single" should read --single head--.

Line 51, "plural" should read --plural heads--.

Line 52, "color and density." should read --colors and densities.--.

COLUMN 38:

Line 1, "is the" should read --is applied. The--.

Line 2, "the" should read --a--.

Line 6, "left," should read --left unused,--.

Line 7, "the application" should read --upon the application--.

Signed and Sealed this

Twelfth Day of October, 1999

*Attest:*

*Attesting Officer*

Q. TODD DICKINSON

*Acting Commissioner of Patents and Trademarks*